US006633272B1

(12) United States Patent
Kumagawa et al.

(10) Patent No.: US 6,633,272 B1
(45) Date of Patent: Oct. 14, 2003

(54) DRIVING METHOD, DRIVE IC AND DRIVE CIRCUIT FOR LIQUID CRYSTAL DISPLAY

(75) Inventors: Katsuhiko Kumagawa, Osaka (JP); Akira Kawaji, Nara (JP); Masahito Matsunami, Ishikawa (JP); Takeshi Okuno, Ishikawa (JP); Tohru Suyama, Kyoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/516,951

(22) Filed: Mar. 1, 2000

Related U.S. Application Data

(62) Division of application No. 08/833,275, filed on Apr. 4, 1997.

(30) Foreign Application Priority Data

Apr. 5, 1996 (JP) ..... 8-084346
Jun. 28, 1996 (JP) ..... 8-170215
Oct. 1, 1996 (JP) ..... 8-260400

(51) Int. Cl.[7] ..... G09G 3/36
(52) U.S. Cl. ..... 345/98; 345/96; 345/58
(58) Field of Search ..... 345/95, 96, 100, 345/94, 97, 98, 87, 55, 58, 208, 209, 210; 349/139, 147; 367/907

(56) References Cited

U.S. PATENT DOCUMENTS 5,010,326 A 4/1991 Yamazaki et al.
5,130,703 A * 7/1992 Fairbanks et al. ..... 345/94
5,179,371 A * 1/1993 Yamazaki ..... 340/784
5,184,118 A 2/1993 Yamazaki
5,253,187 A * 10/1993 Kaneko et al. ..... 367/907
5,606,342 A * 2/1997 Shoji et al. ..... 345/97
5,627,558 A * 5/1997 Hotto ..... 345/94
5,650,834 A * 7/1997 Nakagawa et al. ..... 349/139
5,691,739 A 11/1997 Kawamori et al.
5,742,271 A * 4/1998 Imamura et al. ..... 345/23
5,856,816 A * 1/1999 Youn ..... 345/103
6,232,944 B1 * 5/2001 Kumagawa et al. ..... 345/58

FOREIGN PATENT DOCUMENTS

JP 60-19195 * 1/1985
JP 1-266906 * 10/1989
JP 4-360192 * 12/1992
JP 5-333315 * 12/1993
JP 8-292744 * 11/1996

OTHER PUBLICATIONS

Ideno, et al., "The Improvement of the Multiplex Driving Method for Large Area LCDs", *The Technical Report of Japanese Television Gakkai*, IPD82–4 (1993), pp. 21 1.29–22 1.29; and English translation.*
Yamazaki, "Improvement in Display Quality in Achieving Higher Duty", *The Second Fine Process Technology Japan '92*, Professional Skill Seminar (Jul. 2, 1992), Seminar Text, pp. 8 1.22–9 1.3, 11 18–36; and English translation.*

* cited by examiner

*Primary Examiner*—Dennis-Doon Chow
(74) *Attorney, Agent, or Firm*—Merchant & Gould P.C.

(57) ABSTRACT

A compact and inexpensive LCD is provided by improving a drive method for compensating a crosstalk using a compensating pulse added to a signal voltage so that a drive IC and a periphery of the LCD panel are reduced in size. Only one of positive and negative compensating pulses is added in accordance with a predetermined period. Alternatively, the two compensating pulses are added at different times from each other in one horizontal scanning period. The compensating pulse preferably has a waveform including low frequency components. A width or a height of the compensating pulse varies in accordance with a location of the signal electrode, display pattern or other factors.

5 Claims, 48 Drawing Sheets

DRIVING METHOD, DRIVE IC AND DRIVE CIRCUIT FOR LIQUID CRYSTAL DISPLAY

This application is a Divisional of application Ser. No. 08/833,275, filed Apr. 4, 1997, which application(s) are incorporated herein by reference.

BACKGROUND OF THE INVENTION

The present invention relates to a method of driving a liquid crystal display (LCD), especially a simple matrix type LCD, a drive IC for the method and a drive circuit using the drive IC.

An LCD has been widely used in a personal computer, a word processor, and other electronic equipment for its thin and light features, while its display capacity has been increased rapidly. Especially, a super twisted nematic (STN) type LCD is widely used in inexpensive equipment since its cost is lower than a thin film transistor (TFT) type LCD.

An STN type LCD increases its display capacity by increasing a twist angle of a liquid crystal molecule more than two hundred degrees so as to sharpen electro-optical properties of a threshold characteristic of the LCD. The STN type LCD can be manufactured at a low cost compared to a TFT type LCD that has an active matrix structure with a switching element for each pixel.

A multiplex drive method is generally used for driving a simple matrix type LCD including the STN type LCD. The simple matrix LCD has no switching element for each pixel, so that a display intensity of a pixel depends on a root mean square (rms) value voltage including a state in which the scanning electrode of the pixel is not selected. This multiplex drive method keeps display uniformity by making rms voltages equal between enabled pixels as well as disabled pixels.

FIG. 47 shows the above mentioned drive method. Numeral 503 is an LCD panel, 504–507 are scanning electrodes, and 508–511 are signal electrodes. A scanning voltage pulse (+Vs) 501 is applied to the scanning electrodes in order, and signal voltage 502 is applied to the signal electrode, where the signal voltage 502 corresponds to on/off states of the pixel on the selected scanning electrode. The signal voltage is −Vd for the on state and +Vd for the off state. The polarity of the voltage is reversed over a predetermined period to apply an alternating voltage to the liquid crystal.

In a real LCD panel, there is a switching distortion of the voltage wave form applied to the liquid crystal, due to a CR circuit made of an electrode resistance of the scanning electrode and/or the signal electrode, an output resistance of the drive IC and a capacitance of the liquid crystal. Therefore, the rms voltage applied to each pixel deviates from an ideal value, so that the intensity of the pixel, which should be constant, varies depending on a display pattern of other parts. This phenomenon is so-called "crosstalk".

There are several causes of such a crosstalk. The most important and basic cause is a switching distortion of a data signal. In FIG. 47, though only four scanning electrodes 504–507 are shown, there are plural electrodes following the electrode 507, and all pixels are supposed to be in the on state (i.e., white is displayed). For example, the signal voltage applied to the signal electrode 509 is switched three times between off and on states during scanning periods of the scanning electrodes 504–507, while the signal voltage applied to the signal electrode 508 maintains the on state without switching. Therefore, pixels on the signal electrode 509 are provided with a lower rms voltage due to the switching distortion compared with the pixels on the signal electrodes 508. As a result, the white level of the pixels on the signal electrode 509 is darker than that of the pixels on the signal electrode 508, so that stripes are displayed even though the display data are all white. This crosstalk is called a character crosstalk.

In a liquid crystal display, a dc voltage is prevented from being applied to the liquid crystal by switching the polarity of the scanning voltage as well as the polarity of the signal voltage of the data signal in a predetermined period. A drive method for decreasing the character crosstalk is disclosed in Japanese laid open patent application (Tokukai-Sho) 60-19195 and the technical report of Japanese Television Gakkai, IPD82-4 (1983). In this drive method, the switching frequency of the driving voltage polarity is increased in a constant intensity display part by switching drive voltage polarity based on a period of plural horizontal scanning periods that is shorter than one frame. Currently, it is normal to switch the polarity every 10–30 horizontal scanning periods, that is one to several tens of switching frequency per one frame in an LCD having 200–500 scanning lines.

However, this drive method can not eliminate the character crosstalk completely. In addition, this drive method may create another crosstalk (vertical line crosstalk) when a vertical bar is displayed since the polarity switching generates a voltage distortion on the scanning electrode (refer the text of The Second Fine Process Technology Japan '92 Seminar R17).

Another drive method is explained in Japanese laid open patent application (Tokukai-Hei) 4-360192 or 8-292744. This method suppresses the crosstalk by shifting the output level of the signal voltage so as to compensate the switching distortion when the signal voltage switches its level with regard to the non-selected level of the scanning voltage. As shown in FIG. 48, when the output level of the signal voltage is switched, a compensating pulse 521 is added, which shifts the output level of the signal voltage for a predetermined period, so as to compensate for an rms voltage decrease due to the waveform distortion. In this Figure, the non-selected level of the scanning voltage is shifted from V1 to V4 when the polarity of the scanning voltage is switched, for controlling the output voltage of a scanning IC.

FIG. 49 shows a drive circuit for obtaining the wave form shown in FIG. 48 as disclosed in Tokukai-Hei 4-360192. This drive circuit generates four additional voltage levels VDD, V2, V3, V5. An LCD driving voltage generator 525 generates ten voltage levels VDD, VDD', V1–V5, V2', V3' and V5', and eight levels of them are supplied to a signal drive circuit 523. Numeral 522 is an LCD panel and 524 is a scan drive circuit.

If the non-selected level of the scanning voltage is a constant value V1, the signal voltage waveform is as shown in FIG. 50. This is obtained by shifting the latter half of the signal voltage waveform in FIG. 48. The scanning IC is required to output positive and negative pulses (+/−Vs), and the lower half of the voltage level generated by the LCD scan voltage generator 525 is not necessary.

In the drive method disclosed in Tokukai-Hei 8-292744, a compensating pulse is superimposed on the supplied voltage to the signal drive circuit for obtaining the waveform shown in FIG. 48 or FIG. 50. This drive method makes the output of the signal drive IC high impedance so that the compensating pulse does not reach the signal electrode when the signal voltage is not switched (is not inverted), and turn on the output of the signal drive IC so that the compensating pulse is applied to the signal electrode when the signal voltage is switched (is inverted).

Another drive method is disclosed in Tokukai-Hei 5-33331. This drive method adds a pulse voltage that decreases the rms signal voltage when the signal voltage is not inverted, opposite to the above mentioned method disclosed in Tokukai-Hei 4-360192 or 8-292744, so as to generate a waveform distortion that may occur when the level is inverted and makes both rms voltages equal. The non-selected level of the scanning electrode or the opposite level of the signal voltage (the off level when continuing on signal, and the on level when continuing off signal) is used as a compensation voltage level, so that the crosstalk is suppressed without additional voltage levels.

The above mentioned drive methods in the prior art have some disadvantages as explained below.

In the method of Tokukai-Hei 4-360192, the number of the voltage levels supplied to the LCD drive IC is increased, along with the numbers of bus wires and switches in the drive IC as well as the numbers of connections between the drive IC and a power source circuit. The number of the voltage levels supplied to the signal drive IC is increased from four to eight when using the waveform of FIG. 48, and from two to four when using the waveform of FIG. 50, by adding the compensating pulse. Thus, areas of the drive IC and the connecting portion are increased, so that the cost of the IC rises and the area of a peripheral portion of the LCD panel increases.

In the drive method disclosed in Tokukai-Hei 8-292744, while the output of the signal drive IC is in a high impedance state, the signal electrode corresponding to the output is in a floating state, so that the signal electrode discharges. As a result, contrast of the LCD drops, and an uneven display state may occur.

In the drive method disclosed in Tokukai-Hei 5-333315, the level of the compensation voltage is shared with another voltage level, so that the voltage switching width for the compensation is large. In this method, a large voltage switching occurred once during one horizontal scan period when the signal voltage is inverted, and twice for leading and falling edges of the compensating pulse during one horizontal scan period when the signal voltage is not inverted. On the other hand, the drive method without compensation of the crosstalk does not caiuse the voltage switching when the signal voltage is not inverted. When the number of scan lines is n, the signal voltage switchings occur n–2n times in the drive method disclosed in Tokukai-Hei 5-333315. This number n–2n is much bigger than 0-n that is the number of switching in the drive method without compensation of the crosstalk. The consumption of power also increases along with the number of switchings.

Furthermore, in any drive method mentioned above, the compensation waveform has high frequency components, so that the compensation is not even in the screen, and compensation characteristics may vary depending on a size of the LCD panel, a number of pixels and physical constants of the liquid crystal.

The main purpose of the present invention is to improve the above mentioned drive method in the prior art so that the crosstalk is eliminated or decreased and to suppress increasing of the area of the peripheral portion of an LCD as well as a cost and a power consumption of a drive IC, thus realizing an inexpensive and low-power LCD.

SUMMARY OF THE INVENTION

A first drive method according to the present invention comprises the steps of applying a scanning voltage to the plural scanning electrodes in order; applying a signal voltage to the plural signal electrodes; adding a compensating pulse to the signal voltage of the signal electrode that changes from a negative level to a positive level for two consecutive horizontal scanning periods during a first predetermined period so as to compensate a drop of a rms voltage due to a waveform distortion accompanying the level change of the signal voltage; and adding a compensating pulse to the signal voltage of the signal electrode that changes from a positive level to a negative level between two consecutive horizontal scanning periods during a second predetermined period so as to compensate a drop of a rms voltage due to a waveform distortion accompanying the level change of the signal voltage.

A second drive method according to the present invention comprises the steps of applying a scanning voltage to the plural scanning electrodes in order; applying a signal voltage to the plural signal electrodes; adding a compensating pulse to the signal voltage of the signal electrode that maintains a positive level for two consecutive horizontal scanning periods during a first predetermined period so as to give a drop of a rms voltage that would be generated if the level of the signal voltage changes its level and generates a waveform distortion; and adding a compensating pulse to the signal voltage of the signal electrode that maintains a negative level for two consecutive horizontal scanning periods during a second predetermined period so as to give a drop of a rms voltage that would be generated if the level of the signal voltage changes its level and generate a waveform distortion.

According to the above mentioned first or second method, variability of the rms signal voltage is suppressed by the compensating pulse, so that the crosstalk is reduced. In addition, since signal electrodes, to which the compensating pulse is added, are restricted as mentioned above, the number of required voltage levels is decreased compared with the case where there is not such a restriction. Therefore, a number of switches and wires in a drive IC is reduced, the area of a drive IC is reduced, a peripheral portion of the display becomes compact, and the drive IC becomes inexpensive. In addition, power consumption does not increase, and the display unevenness due to a power source noise hardly appears.

In the first and second drive method, it is preferable that the first and second predetermined periods are substantially equal for preventing a dc voltage from being applied to the liquid crystal when adding the compensating pulse. If the dc voltage is applied, the properties of the liquid crystal may deteriorate.

It is also preferable in the first and second drive method that the first and second predetermined periods are set in accordance with a polarity signal (signal for inverting the polarity), so that the first and second predetermined periods can be adjusted without using a special control signal. In this case, it is preferable to determine wheather or not to add the compensation pulse in accordance with a logic condition using the display data for simplifying the logic table or circuit.

Alternatively, the first and second predetermined periods can be set using not only the polarity signal but also another control signal. For example, the relation between the two predetermined periods and the polarity signal may be inverted with every period of the control signal that is longer than the polarity changing period. In this case too, it is preferable to determine wherather or not to add the compensation pulse in accordance with a logic condition using the display data.

Alternatively, the first and second predetermined periods can be set using only another control signal set independently from the polarity signal.

A third drive method according to the present invention comprises the steps of applying a scanning voltage to the plural scanning electrodes in order; applying a signal voltage to the plural signal electrodes; and adding a compensating pulse to the signal voltage of the signal electrode that changes its level for two consecutive horizontal scanning periods so as to compensate a drop of a rms voltage due to a waveform distortion accompanying the level change of the signal voltage, in such a way that the positive and negative compensating pulses do not overlap in a horizontal scanning period.

A fourth drive method according to the present invention comprises the steps of applying a scanning voltage to the plural scanning electrodes in order; applying a signal voltage to the plural signal electrode; and adding a compensating pulse to the signal voltage of the signal electrode that maintains the same level for two consecutive horizontal scanning periods so as to give a drop of a rms voltage that would be generated if the level of the signal voltage changes its level and generates a waveform distortion, in such a way that the compensating pulses, which are added to the signal electrodes whose signal voltage maintains a positive or negative level, do not overlap in a horizontal scanning period.

According to the third or fourth drive method, the variability of the rms signal voltage is suppressed by the compensating pulse, so that the character crosstalk is eliminated or reduced. Moreover, the signal electrodes to which the compensating pulse is added are restricted as mentioned above, so that the required voltage levels are not many. As a result, the area of the drive IC can be reduced, the peripheral area of the LCD can be compact, and the drive IC can be inexpensive. In addition, compared with the first or second drive method, the third drive method disposes the positive and negative compensating pulses closely to each other, so that the dc voltage and low frequency components of the pixel voltage are reduced and a flicker is hardly generated.

It is preferable in the third or fourth drive method to add a first kind of compensating pulse in a first period of the horizontal scanning period, and to add a second kind of compensating pulse in a second period. Thus, a circuit for obtaining the waveforms mentioned above can be easily made.

A fifth drive method according to the present invention comprises the steps of applying a scanning voltage to the plural scanning electrodes in order; applying a signal voltage to the plural signal electrodes via a first electric path; and adding a compensating pulse to the signal voltage via a second electric path whose impedance is higher than that of the first electric path, so as to compensate a drop of a rms voltage due to a waveform distortion accompanying the level change of the signal voltage. This drive method can be combined with the first through fourth drive methods.

Thus, the area of the drive IC can be reduced since the impedance of the second electric path for the compensating pulse (the signal voltage with the compensating pulse), i.e., an output resistance or bus resistance, can be higher than the first electric path for the normal signals. As a result, peripherals of the LCD can be compact, and the drive IC can be inexpensive. A power source for the compensating pulse can be inexpensive and easy to design since a power source with low current capacity can be used.

A sixth drive method according to the present invention comprises the steps of applying a scanning voltage to the plural scanning electrodes in order; applying a signal voltage to the plural signal electrodes; and adding a compensating pulse to the signal voltage of the signal electrode that changes its level for two consecutive horizontal scanning periods so as to compensate a drop of a rms voltage due to a waveform distortion accompanying the level change of the signal voltage, wherein a width of the compensating pulse is more than one and one half of the time constant Bin of a pixel, which is given by the following equation, $$\mathrm{Bin}=(R\mathrm{pix}\times n)\times(C\mathrm{pix}\times n)/2,$$

where Rpix is a resistance of the signal electrode per one pixel, Cpix is a capacitance per one pixel, and n is a number of pixels per one signal line.

A seventh drive method according to the present invention comprises the steps of applying a scanning voltage to the plural scanning electrodes in order; applying a signal voltage to the plural signal electrodes; and adding a compensating pulse to the signal voltage of the signal electrode that maintains the same level for two consecutive horizontal scanning periods so as to give a drop of a rms voltage that would be generated if the level of the signal voltage changes its level and generates a waveform distortion, wherein a width of the compensating pulse is more than one and one half of the time constant Bin of a pixel, which is given by the above mentioned equation in the sixth drive method.

According to the sixth or seventh drive method of the present invention, a voltage difference of the compensating pulse in the LCD panel due to the decrease or distortion of the compensating pulse can be suppressed, so that a uniform display in the LCD panel can be obtained. It is more preferable that the width of the compensating pulse is more than four times of the time constant Bin in the sixth and seventh drive method.

An eighth drive method according to the present invention comprises the steps of applying a scanning voltage to the plural scanning electrodes in order; applying a signal voltage to the plural signal electrodes; and adding a compensating pulse to the signal voltage of the signal electrode that changes its level for two consecutive horizontal scanning periods so as to compensate a drop of a rms voltage due to a waveform distortion accompanying the level change of the signal voltage, wherein the compensation pulse has a shape whose frequency component is lower than that of a rectangular wave.

A ninth drive method according to the present invention comprises the steps of applying a scanning voltage to the plural scanning electrodes in order; applying a signal voltage to the plural signal electrodes; and adding a compensating pulse to the signal voltage of the signal electrode that maintains a same level for two consecutive horizontal scanning periods so as to give a drop of a rms voltage that would be generated if the level of the signal voltage changes its level and generates a waveform distortion, wherein the compensation pulse has a shape whose frequency component is lower than that of a rectangular wave.

According to the eighth or ninth drive method of the present invention, a voltage variability of the compensating pulse in the LCD panel due to the decrease or distortion of the compensating pulse can be suppressed, so that a more uniform display in the LCD panel can be obtained compared with the sixth or seventh drive method. For example, a sine wave, a triangle wave or an arc wave can be used as well as a rectangular wave for the compensating pulse. The rectangular wave can simplify the power source circuits. On the other hands, the sine wave can provide an effective compensation since the sine wave includes low frequency components and is hardly distorted or decreased.

A tenth drive method according to the present invention comprises the steps of applying a scanning voltage to the plural scanning electrodes in order; applying a signal voltage to the plural signal electrodes; and adding a compensating pulse to the signal voltage of the signal electrode in accordance with a level change of the signal voltage for two consecutive horizontal scanning periods, wherein the signal voltage has gentle rising and falling edges. According to this drive method, the distortion of the signal voltage is small and a small compensation amount is enough to compensate a small crosstalk. In addition, uniformity of a display can be obtained easily.

An eleventh drive method according to the present invention comprises the steps of applying a scanning voltage to the plural scanning electrodes in order; applying a signal voltage to the plural signal electrodes; and adding a compensating pulse to the signal voltage of the signal electrode in accordance with a level change of the signal voltage for two consecutive horizontal scanning periods, wherein add timing and a pulse width of the compensating pulse are controlled by a compensating pulse control signal set according to a count value of a clock. According to this drive method, the rms voltage of the compensating pulse can be adjusted easily according to the properties of the LCD panel.

A twelfth drive method according to the present invention comprises the steps of applying a scanning voltage to the plural scanning electrodes in order; applying a signal voltage to the plural signal electrodes; and adding a compensating pulse to the signal voltage of the signal electrode in accordance with a level change of the signal voltage for two consecutive horizontal scanning periods, wherein at least one of the height and width of the compensating pulse varies gradually from the point nearest to a power source to the point farthest from a power source. The amount of the crosstalk due to the waveform distortion usually varies in accordance with the distance from the scan drive circuit. According to the twelfth drive method of the present invention, uniformity of display can be maintained in spite of the above mentioned phenomenon since the width and/or height (i.e., the compensation amount) is varied in accordance with the amount of the crosstalk.

A thirteenth drive method according to the present invention comprises the steps of applying a scanning voltage to the plural scanning electrodes in order; applying a signal voltage to the plural signal electrodes; and adding a compensating pulse to the signal voltage of the signal electrode in accordance with a level change of the signal voltage for two consecutive horizontal scanning periods, wherein at least one of the height and width of the compensating pulse is controlled in accordance with a difference of numbers of on-pixels or off-pixels between two scanning electrodes corresponding to the two consecutive horizontal scanning periods. According to this drive method, the compensation amount can be adjusted in accordance with a crosstalk amount due to a voltage distortion on the scanning electrode from a specific a display pattern, so that the uniformity of a display is improved.

A fourteenth drive method according to the present invention comprises the steps of applying a scanning voltage to the plural scanning electrodes in order; applying a signal voltage to the plural signal electrodes; and adding a compensating pulse to the signal voltage of the signal electrode in accordance with a level change of the signal voltage for two consecutive horizontal scanning periods, wherein the compensating pulse added in the upper part and the compensating pulse added in the lower part are controlled independently from each other. According to this drive method, the compensation amount can be controlled in accordance with a crosstalk amount that may be different between upper and lower parts of the display depending on the specific display pattern. Thus the crosstalk compensation can be performed properly both in the upper and lower parts of the display, and a boundary line between the upper and lower parts of the display can be suppressed.

A fifteenth drive method according to the present invention comprises the steps of applying a scanning voltage to the plural scanning electrodes in order; and applying a signal voltage to the plural signal electrodes, wherein the signal voltage includes positive and negative halves of a sine wave voltage. According to this drive method, the rising and falling edges of the signal voltage become gentle so that the waveform distortion is hardly generated. In addition, when the polarity does not change, the rms voltage drop is generated in the same way as when the polarity changes since the voltage drops once and returns to the original level.

In the above mentioned drive method, it is preferable to cut at least one of the positive and negative compensating pulses partially by a phase control. Thus, the compensation amount is adjusted between the positive and negative compensating pulses to obtain good display properties.

According to each drive method mentioned above, the polarity of the scanning voltage is not required to change so often. It is preferable that the change period of the scanning voltage polarity is longer than one fourth of the frame period. In other words, it is preferable to change the polarity of the scanning voltage less than four times per one frame. There is no problem if the polarity of the scanning voltage is changed only once per one frame. Thus, the vertical line crosstalk due to the distortion of the scanning voltage can be reduced.

A first configuration of the drive IC for an LCD according to the present invention that is suitable for the above mentioned drive methods comprises a first latch circuit for keeping first signal data in a first horizontal scanning period; a second latch circuit for keeping second signal data in a second horizontal scanning period; a set of switch circuits for selecting one of plural input voltages and supplying the selected voltage in accordance with output signals of the first and second latches; and a plurality of bus lines, at least one of which is used by plural voltage levels (preferably voltage levels of the compensating pulse). According to this configuration, the numbers of bus lines and output switches are reduced, so that the area of the drive IC can be reduced, the peripheral portion of the LCD panel can be compacted and the drive IC can be reduced in cost.

A second configuration of the drive IC for an LCD according to the present invention comprises a first latch circuit for keeping first signal data in a first horizontal scanning period; a second latch circuit for keeping second signal data in a second horizontal scanning period; a set of switch circuits for selecting one of plural input voltages and supplying the selected voltage in accordance with output signals of the first and second latches; a plurality of bus lines; and an inverter circuit for inverting at least one of the voltage levels (preferably a voltage level of the compensating pulse) on the plural bus lines in accordance with a control signal. According to this configuration, the numbers of bus lines and output switches are reduced, so that the area of the drive IC can be reduced, the peripheral portion of the LCD panel can be compacted and the drive IC can be reduced in cost.

A third configuration of the drive IC for an LCD according to the present invention comprises a first latch circuit for keeping first signal data in a first horizontal scanning period; a second latch circuit for keeping second signal data in a second horizontal scanning period adjacent to the first horizontal scanning period; and a set of switch circuits for selecting one of plural input voltages and supplying the selected voltage in accordance with output signals of the first and second latches, wherein at least one of the switch circuits has a larger output resistance than other switch circuits.

It is preferable that the switch circuit for selecting the voltage level of the compensating pulse has a larger output resistance than other switch circuits. Moreover, it is preferable that the switch circuit connected to the bus line that is used by plural voltage levels has a larger output resistance than other switch circuits. Alternatively, it is preferable that the switch circuit connected to the bus line whose voltage level is inverted has a larger output resistance than other switch circuits. In addition, the switch circuit has an output resistance preferably within 2–50 times and more preferably within 5–20 times of the resistance of other switch circuits.

Thus, the area of the drive IC can be reduced for compacting the peripheral circuit of the LCD panel and reducing the cost of the drive IC.

A fourth configuration of the drive IC for an LCD according to the present invention comprises a first latch circuit for keeping first signal data in a first horizontal scanning period; a second latch circuit for keeping second signal data in a second horizontal scanning period adjacent to the first horizontal scanning period; a set of switch circuits for selecting one of plural input voltages and supplying the selected voltage in accordance with output signals of the first and second latches; and a plurality of bus lines, wherein at least one of the bus lines (preferably the bus line to which the voltage level of the compensating pulse is supplied) has a larger resistance than other bus lines. According to this configuration, the width of the bus line can be narrow so that the area of the drive IC can be reduced for compacting the peripheral circuit of LCD panel and reducing the cost of the drive IC.

A fifth configuration of the drive IC for an LCD according to the present invention comprises a first latch circuit for keeping first signal data in a first horizontal scanning period; a second latch circuit for keeping second signal data in a second horizontal scanning period adjacent to the first horizontal scanning period; a set of switch circuits for selecting one of plural input voltages and supplying the selected voltage in accordance with output signals of the first and second latches; a plurality of bus lines, with the switch circuits selecting one of three voltages including a compensating voltage having a varying level. By this configuration too, the area of the drive IC can be reduced for compacting the peripheral circuit of LCD panel and reducing the cost of the drive IC.

A first configuration of the drive circuit for an LCD according to the present invention comprises a signal drive circuit using the above explained drive IC and a power source circuit, wherein a voltage level of the compensating pulse supplied from the power source to the signal drive circuit is changed in accordance with a control signal. The control signal is preferably a polarity signal. According to this configuration, the peripheral circuit including the power source circuit and drive IC can be simplified, so that a compact and inexpensive LCD can be realized while suppressing the crosstalk properly.

A second configuration of the drive circuit for an LCD according to the present invention comprises a signal drive circuit using the above explained drive IC and a power source circuit, wherein a voltage level of the compensating pulse supplied from the power source to the signal drive circuit is changed in one horizontal scanning period. By this configuration too, the peripheral circuit including the power source circuit and drive IC can be simplified, so that a compact and inexpensive LCD can be realized while suppressing the crosstalk properly.

A third configuration of the drive circuit for an LCD according to the present invention comprises a power source circuit for generating voltage levels for a signal voltage and a compensating pulse having a predetermined waveform; and a drive IC having an input terminal for receiving the voltage levels. According to this configuration, uniform display properties can be obtained. It is preferable that the power source circuit includes at least one of a half-wave rectifier circuit and a triangle wave generator circuit. Using such a simple signal generator circuit, an LCD having uniform display properties can be provided.

A fourth configuration of the drive circuit for an LCD according to the present invention comprises a power source circuit for generating voltage levels of a scanning voltage, a signal voltage and a compensating pulse; a signal drive circuit including a drive IC having an input terminal for receiving the signal voltage, with the power source circuit including a voltage divider circuit using resistors for generating the voltage level of the compensating pulse. It is preferable that the power source circuit further includes an inverter circuit for inverting the voltage level of the compensating pulse. It is also preferable that the voltage level of the compensating pulse varies along with a drive voltage of the liquid crystal display. Thus, good display properties can be maintained without losing the condition of the crosstalk compensation when readjusting an intensity of the display or changing the bias resistor to optimize the display properties in the manufacturing process.

A fifth configuration of the drive circuit according to the present invention is for an LCD that includes a plurality of scanning electrodes and signal electrodes arranged in a matrix, and the signal electrodes are divided into upper and lower parts. This drive circuit comprises two compensating pulse control circuits for controlling the upper and lower parts independently from each other. According to this configuration, the compensation amount can be controlled in accordance with a crosstalk amount that may be different between upper and lower parts of the display depending on the display pattern. Thus the crosstalk compensation can be performed properly both in the upper and lower parts of the display, and a boundary line between the upper and lower parts of the display can be suppressed.

DETAILED DESCRIPTION OF THE PREFERRED EMBODIMENTS

First Embodiment

Figure 1:
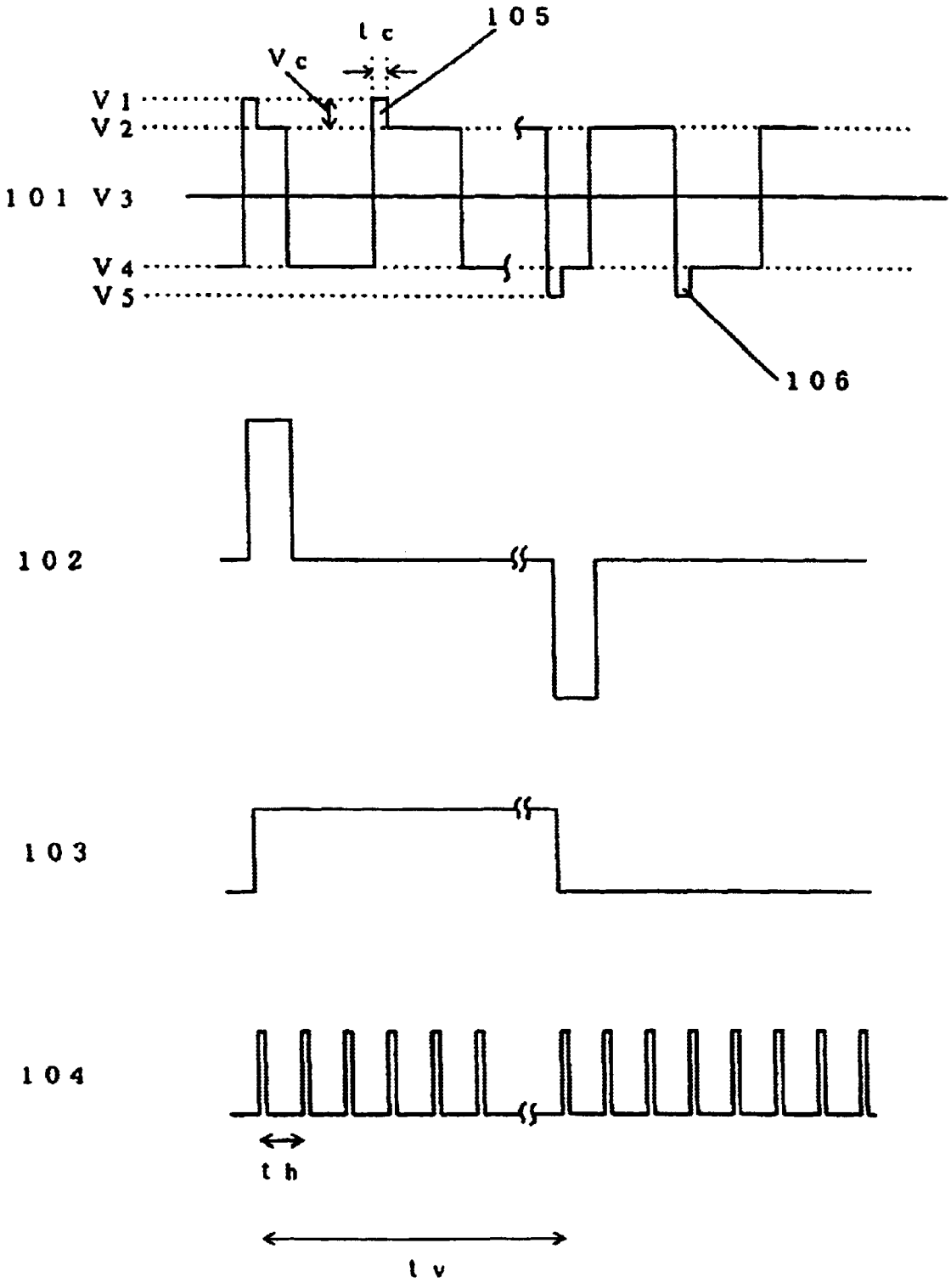
FIG. 1 shows waveforms for a method of driving an LCD according to a first embodiment of the present invention.

FIG. 1 shows drive waveforms for a method of driving a liquid crystal display, according to a first embodiment of the present invention. In this Figure, 101 shows a data voltage signal including voltage levels V2 and V4 depending on a display data. Numeral 102 shows a scanning voltage; 103 shows a polarity signal. Numeral 104 shows a latch pulse including a horizontal scanning period th for scanning one horizontal line of a picture frame, and a frame period tv for scanning one frame of the picture.

In the drive method of this embodiment, a positive compensating pulse 105 is added to the signal voltage 101 when the signal voltage changes from the negative level V4 to the positive level V2 during a first predetermined period, and a negative compensating pulse 106 is added to the signal voltage 101 when the signal voltage changes from the positive level V2 to the negative level V4 during a second predetermined period.

The first and second periods can be determined in accordance with a polarity signal 103. In FIG. 1, while the polarity signal 103 is high (the first predetermined period), scanning is performed by the positive scanning voltage 102. Pixels on the selected scanning line are in the off-state if the data signal 101 is at the positive level V2, and in the on-state if the data signal 101 is at the negative level V4. On the contrary, while the polarity signal 103 is low (the second predetermined period), the positive level V2 means on-level, and the negative level V4 means off-level. Thus, data signal levels V2 and V4 correspond to on and off of the display data, and the corresponding relation changes in accordance with the predetermined period.

In FIG. 1, the compensating pulse 105 or 106 having a height Vc and a width tc is added to the data signal when the signal voltage changes from on-level to off-level. The positive compensating pulse 105 is added to the signal voltage when the signal voltage changes from V4 to V2 if the polarity signal is high, while the negative compensating pulse 106 is added to the signal voltage when the signal voltage changes from V2 to V4 if the polarity signal is low. The period of the changing polarity signal corresponds to the frame period.

Figure 2A:
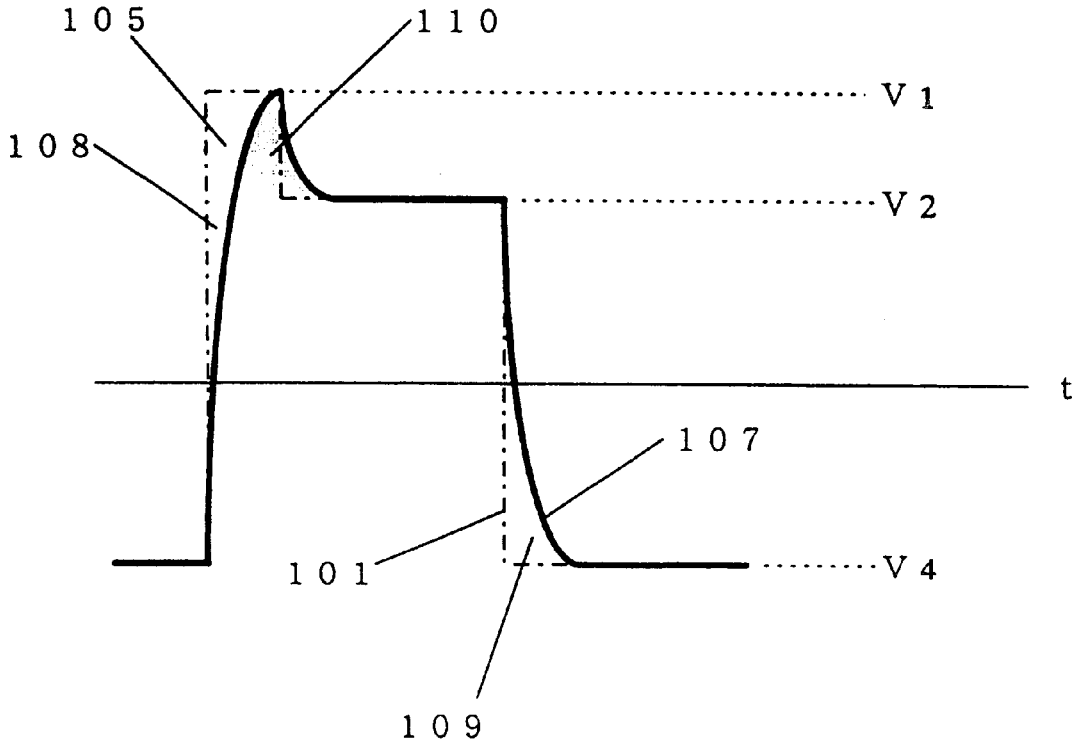
FIGS. 2A and 2B show waveforms for explaining the effect of the compensating pulse of the drive method shown in FIG. 1.
Figure 2B:
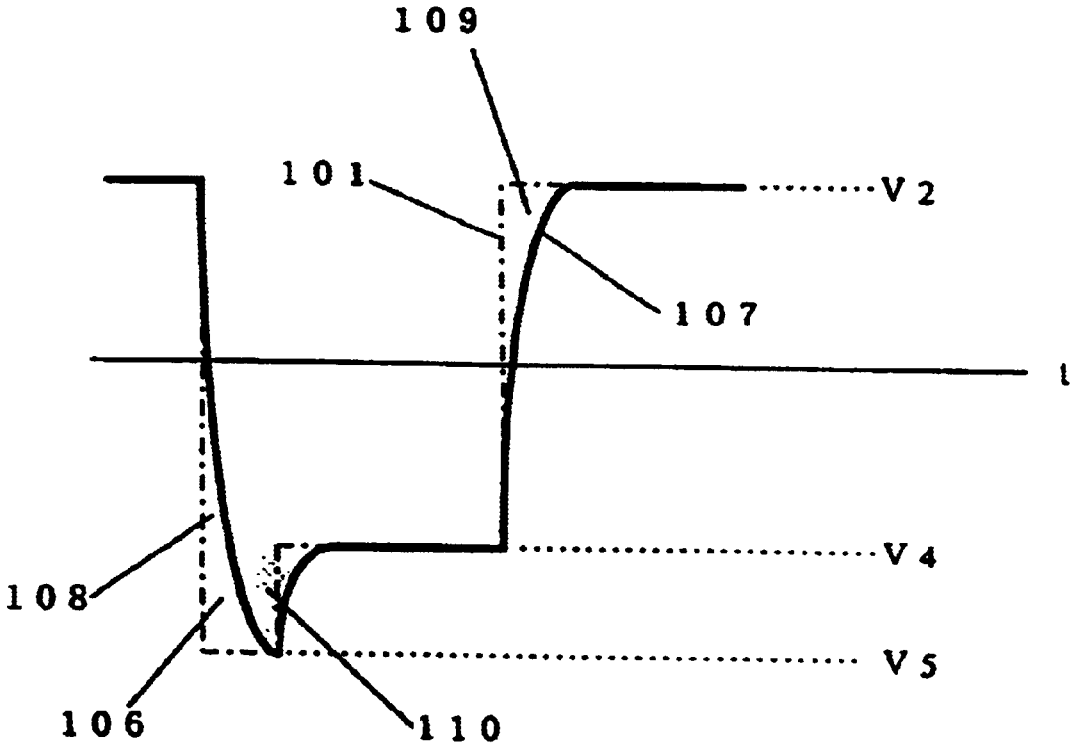

An effect of the above mentioned compensating pulse is explained using FIGS. 2A and 2B. FIG. 2A shows a voltage waveform when the polarity signal in FIG. 1 is high, and FIG. 2B shows a voltage waveform when the polarity signal is low. In both cases, the data signal voltage 101 has a distortion due to a CR circuit of the liquid crystal panel, so that the real signal to be applied on pixels is like a waveform 107. The route mean square (rms) voltage of the signal drops by the eliminated portion 108, 109, which are compensated by compensating pulses 105, 106 that generate exceeding voltage portions 110. Thus, an adequate rms voltage is applied to the pixels.

If the data signal voltage does not change, the compensating pulse is not added as shown in FIG. 1. In this case too, an adequate rms voltage is applied to the pixels since no waveform distortion is generated. Therefore, an adequate rms voltage is applied to the pixels independently from the display data, so that the character crosstalk is eliminated or substantially reduced.

If the compensating pulse is added only to one of the two levels V2 and V4 of the signal voltage, an imbalance may be generated between the positive and negative levels, so that a direct current component may be applied to the liquid crystal. However, in the drive method of this embodiment, the polarity of the compensating pulse is inverted along with the inverting scanning voltage, so the direct current component is eliminated. Especially, while a display pattern does not change, the direct current component is completely eliminated since the waveform changes the same times between the positive and negative scanning periods.

In the driving waveform shown in FIG. 1, the number of level changes of the signal voltage from V2 to V4 is equal to that of the signal voltage from V4 to V2. Therefore, it is preferable that the height Vc and the width tc of the compensating pulse are selected so that the effective portion 110 of the compensating pulse compensates the eliminated portion 108 and 109 of the rms voltage. In an example, the product of Vc and tc was selected within 0.4–10 volt microseconds, preferably 1.0–6.0 volt microseconds using a color STN type 10.4 inch 640×480 dots LCD panel whose electrodes have a sheet resistance of 7.5 ohm, and the signal electrode is not divided into the upper and lower parts.

If the condition of the LCD panel is different from the above mentioned condition, the product of Vc and ct should be adjusted to the condition. The distortion of the signal waveform depends on the load of the signal electrode. Therefore, the voltage distortion due to switching of the signal voltage is substantially proportioned to A shown in the following equation.

$$A=(R\text{pix}\times n)\times(C\text{pix}\times n)\times(V2-V4), \quad (1)$$

where Rpix is a resistance of the signal electrode per one pixel, Cpx is a capacitance per one pixel, and n is a number of the pixels on one signal line.

Preferable and more preferable value ranges of the product of Vc and ct are shown in the following expressions using the above mentioned value of A.

$$0.08\times A<Vc\times ct<1.80\times A, \quad (2)$$

$$0.18\times A<Vc\times ct<1.00\times A, \quad (3)$$

Capacitance Cpix may be an average value of pixels in the on-state and pixels in the off-state since the capacitance of the liquid crystal layer varies in accordance with the applied voltage. If the pulse width is too small, high frequency components of the compensating pulse may be attenuated and the compensation amount varies. Therefore, an excessively narrow pulse width should be avoided. A preferable pulse width will be explained later in a fourteenth embodiment.

In the above mentioned drive method, the polarity signal determines which of the positive and negative compensating pulses 105, 106 is to be used for all signal electrodes. Either one of the compensating pulses is added at one time. Therefore, three kinds of levels V2, V3, and V1 or V5 are required at a minimum for the drive IC for the signal side. On the contrary, four levels V1, V2, V4 and V5 are required for the drive IC in the prior art. Thus, the drive method according to the present invention has an advantage in that the drive IC or circuit can be simplified compared with that of the prior art.

Though the compensating pulse is added to the signal voltage when the signal voltage changes from on-level to off-level, the compensating pulse may be added when the signal voltage changes from off-level to on-level for obtaining the same effect. Moreover, these two conditions for adding the compensating pulse can coexist by changing these two conditions every proper period. In this case, an influence of a delicate character difference between the positive and negative voltages of the drive IC or circuit on the display properties can be relieved.

The timing when the compensating pulse is added (phase in the data signal voltage waveform) is not limited to the rising edge or the falling edge of the data signal voltage. The compensation of the crosstalk can be performed whenever the timing is in the horizontal scanning period th.

Distortion of the compensating pulse is generated when the voltage level undergoes a large change from V4 to V1 (or from V2 to V5) if the compensating pulse is added to the data signal at the rising or falling edge. On the contrary, if the compensating pulse is added at some period away from the rising or falling edge, the distortion of the compensating pulse is generated when the voltage level changes from V2 to V1 (or from V4 to V5). This voltage change is rather small and the distortion amount is smaller than that when the voltage level change is large as mentioned above. If the distortion is small, the product Vc×tc of the compensating pulse can be small.

A CR time constant B can be calculated from a distributed constant circuit and is shown by the following approximate equation.

$$B=(R\text{out}+R\text{pix}\times n)\times(C\text{pix}\times n)/2, \quad (4)$$

where Rout is a resistance of one line excluding a pixel portion, i.e., a sum of panel wiring resistance, connection resistance and IC output resistance.

If the period between the start of the horizontal scanning period th and adding of the compensating pulse is more than double the CR time constant B, the product Vc×tc can be lowered to about 80%. However, the pulse width tc is preferably set within a range that will be explained later in the fourteenth embodiment.

As mentioned above, the first and second predetermined periods, for adding the positive or negative compensating pulse, are set in accordance with the polarity signal. Thus, according to the changing direction of the display data, the compensating pulse is added or not to each signal electrode. In addition, an additional control signal is not required for selecting the positive or negative compensation signal to be added.

However, the above selection can be based on another control signal that is independent from the polarity change of the scanning pulse. Thus, the condition for adding the compensating pulse can be determined adequately for the LCD panel properties. The first and second predetermined period are preferably set to be equal, so that a direct current is not supplied to the LCD panel. The crosstalk can be compensated properly even if the three voltage levels are supplied to the drive IC.

It is preferable that the first and second predetermined period do not exceed one frame period to prevent a flicker from being generated. If the predetermined periods are too short, switching of the compensating pulse in a power source or the drive IC may be increased, so that a power consumption may increase. This increase of the power consumption is very small for usual equipment. However, if the power consumption is required to be decreased, in portable equipment for example, it is preferable to make each predetermined period more than one tenth of the frame period.

Second Embodiment

Figure 3:
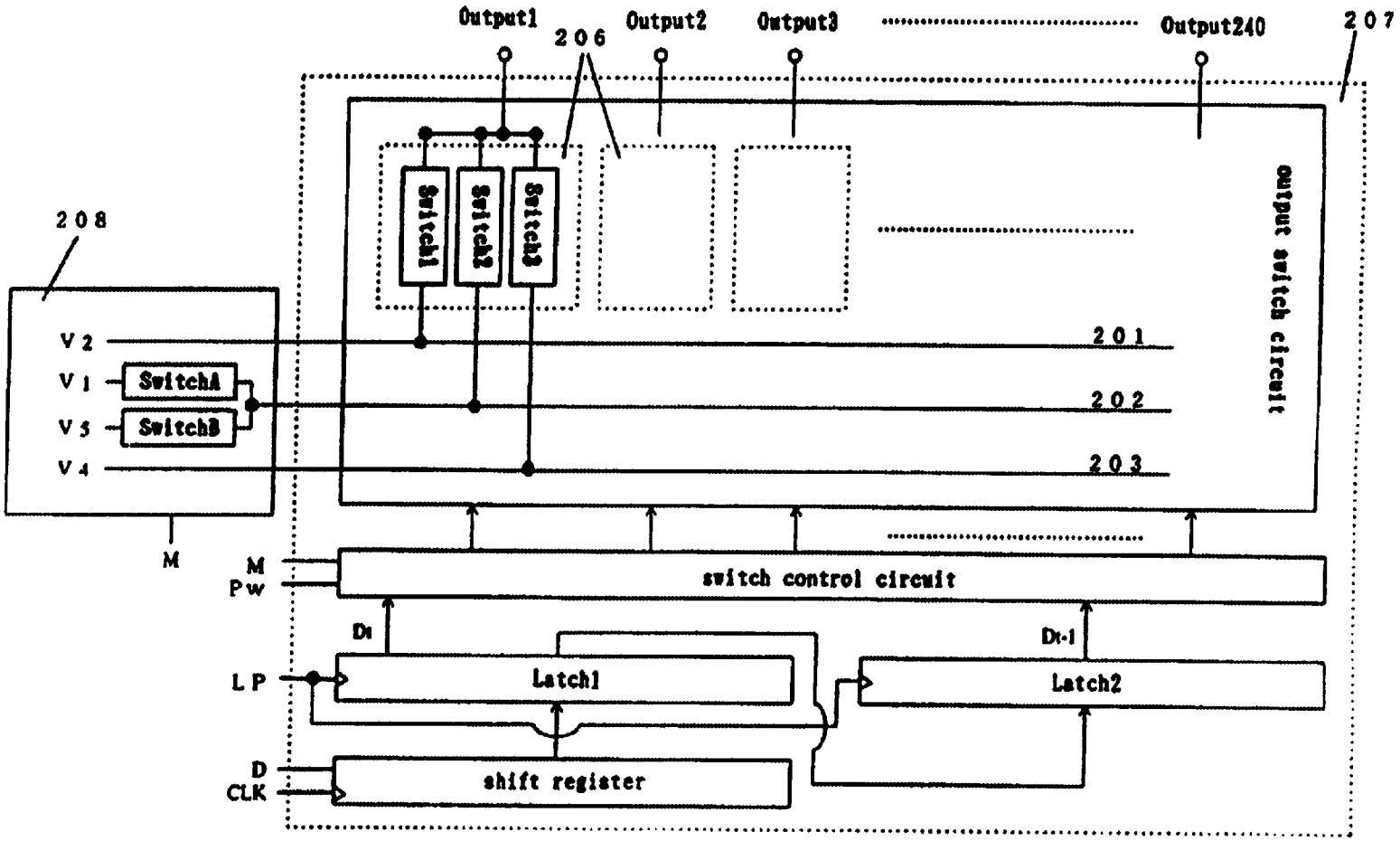
FIG. 3 is a block diagram showing a drive IC and circuit for an LCD according to a second embodiment of the present invention.

FIG. 3 shows a block diagram of a drive IC and circuit of the liquid crystal display according to a second embodiment of the present invention. This drive IC and circuit are used for performing the drive method according to the first embodiment of the present invention and generate the drive signals shown in FIG. 1. In FIG. 3, the drive IC 207 includes an output switch circuit, a switch control circuit, two latch circuits and a shift register. Only one part of the output switch circuit corresponding to an Output 1 is drawn. Other parts of the output switch circuit have the same configuration as the part for the Output 1.

The drive IC 207 is supplied power voltage levels and several control signals. Numeral 206 is a switch set and one of the three switches turns on to select one of IC output levels. Numerals 201–203 are bus connections for supplying DC voltage levels from an external power source to the switch set 206. The IC has 240 outputs for example.

Numeral 208 is an external power source including voltage sources V1, V2, V4 and V5 as well as the switch circuit. Either switch A or switch B turns on to select V1 or V5 for the supply voltage to the drive IC 207.

This drive IC and circuit operate as explained below. The external power source has a polarity signal M, which controls on and off of the switches A and B. For example, if the compensating pulse is added when the signal voltage changes from on-level to off-level, the switches A and B are controlled according to Table 1 so that the voltage level supplied to the bus line 202 of the drive IC is determined.

TABLE 1

| M | on switch | supplied voltage to bus 202 |
|---|---|---|
| H | Sw-A | V 1 |
| L | Sw-B | V 5 |

In Table 1, the polarity signal M shows a polarity (positive or negative) of the scanning voltage. The compensation voltage V1 is supplied to the drive IC when the scanning signal is positive, and the compensation voltage V5 is supplied when the scanning voltage is negative. Thus, different level of the compensation voltage is supplied to the bus line 202 of the drive IC depending on the time period.

A display data D for one scanning line is input synchronizing a clock signal CLK and the data is stored in the shift register. The data for one scanning line are sent to the Latch 1 by a latch pulse LP, and the data stored in the Latch 1 are sent to the Latch 2 simultaneously. The switch control circuit determine the output t for each output line in accordance with Table 2 using display data Dt of the pixel on the current scanning line that are supplied from the Latch 1, a display data Dt−1 of the pixel on the previous scanning line that are supplied from the Latch 2, the polarity signal M and the compensating pulse control signal Pw. Then, the switch control circuit controls the switch set 206 in accordance with the above mentioned determination. When the Switch 2 is in the on-state, the supply voltage to the bus line 202 makes an output voltage of the IC, and the bus line 202 is shared by two compensation voltages. Since the compensation voltage on the bus line 202 is determined by the M signal as shown in Table 1, the output voltage of the drive IC is as shown in Table 2.

TABLE 2

| D t-1 | D t | M | P w | on switch | output t |
|---|---|---|---|---|---|
| * | L | L | L | Sw-1 | V 2 |
| * | H | L | L | Sw-3 | V 4 |
| * | L | H | L | Sw-3 | V 4 |
| * | H | H | L | Sw-1 | V 2 |
| L | L | L | H | Sw-1 | V 2 |
| H | L | L | H | Sw-1 | V 2 |
| L | H | L | H | Sw-2 | V 5 |
| H | H | L | H | Sw-3 | V 4 |
| L | L | H | H | Sw-3 | V 4 |
| H | L | H | H | Sw-3 | V 4 |
| L | H | H | H | Sw-2 | V 1 |
| H | H | H | H | Sw-1 | V 2 |

*: L or H

In Table 2, the display data Dt and Dt−1 show the on-state by low-level and the off-state by high-level. The compensating pulse control signal Pw controls a width of the compensating pulse (tc in FIG. 1). Only when the compensating pulse control signal Pw is high-level, is the compensating pulse added. For example, the signal Pw is turned to the high level when the latch pulse rises, and is turned to the low level after the tc passes, so that the compensating pulse is added at the head of the signal voltage. The compensating pulse control signal Pw is high just after a scanning period starts, so that the compensation voltage V1 or V5 is output according to the condition of the data and the control signal. When the compensating pulse control signal Pw turns to the low level after the period tc, the output voltage changes to V2 if the output voltage was V1, and to V4 if the output voltage was V5. Thus the waveform shown in FIG. 1 can be obtained. The phase of the compensating pulse in one scanning period th can be controlled by adjusting the timing when the compensating pulse control signal Pw is changed from the low level to the high level.

In order to add the compensating pulse when the signal voltage changes from the off state to the on state, the supply voltage from the external power source to the drive IC and the output voltage of the drive IC are determined using the Table 3 and Table 4.

TABLE 3

| M | on switch | supplied voltage to bus 202 |
|---|---|---|
| H | Sw-B | V 5 |
| L | Sw-A | V 1 |

TABLE 4

| D t-1 | D t | M | P w | on switch | output t |
|---|---|---|---|---|---|
| * | L | L | L | Sw-1 | V 2 |
| * | H | L | L | Sw-3 | V 4 |
| * | L | H | L | Sw-3 | V 4 |
| * | H | H | L | Sw-1 | V 2 |
| L | L | L | H | Sw-1 | V 2 |
| H | L | L | H | Sw-2 | V 1 |
| L | H | L | H | Sw-3 | V 4 |
| H | H | L | H | Sw-3 | V 4 |
| L | L | H | H | Sw-3 | V 4 |
| H | L | H | H | Sw-2 | V 5 |
| L | H | H | H | Sw-1 | V 2 |
| H | H | H | H | Sw-1 | V 2 |

*: L or H

As mentioned before in the first embodiment, the changing condition of the data signal (from on to off, or from off to on), on which the compensating pulse added, can be controlled in a proper period independently by using another control signal for changing the set of the logic tables (Table 1 and 2, or Table 3 and 4). Alternatively, a new logic table including another control signal can be used for determining the output.

In an example, a STN type LCD was made for 800×600 dots color display using the above explained IC as a signal drive IC and a normal drive IC as a scanning drive IC. As a result, a very good display was obtained that scarcely had crosstalks. The period of polarity change was set to be equal to one frame period in this example.

By using the drive IC and drive method mentioned above, crosstalks can be compensated properly in spite of the use of only three bus lines and three switches for one output in the drive IC. Therefore, the chip area can be reduced by 10–20% compared with the conventional drive IC. Thus, the area of the periphery of the LCD panel can be reduced so that the LCD can be compacted and reduced in cost.

Third Embodiment

Figure 4:
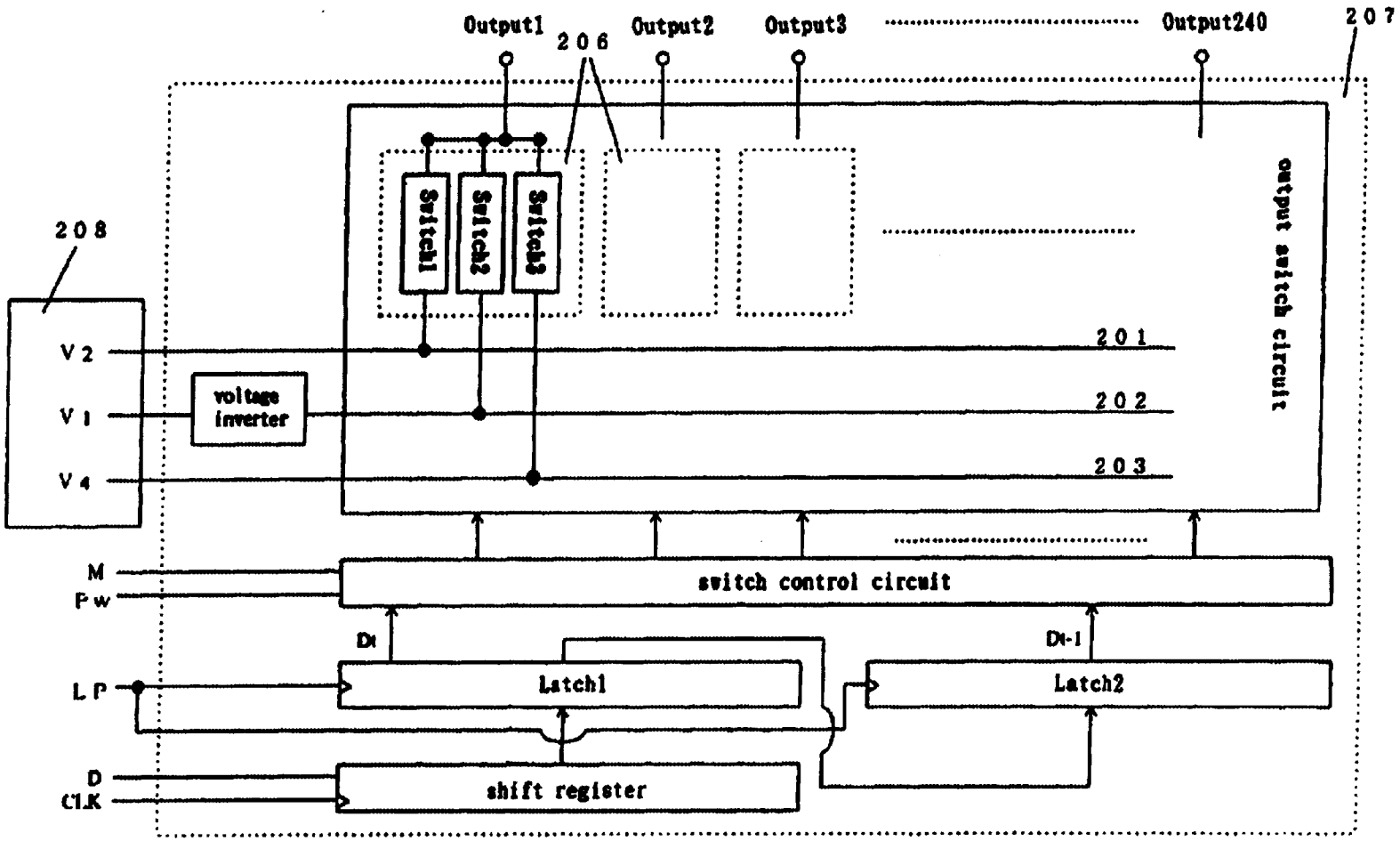
FIG. 4 is a block diagram showing a drive IC and circuit for an LCD according to a third embodiment of the present invention.

FIG. 4 shows a block diagram of a drive IC and circuit of LCD according to a third embodiment of the present invention. This drive IC and circuit are used for generating the drive signals shown in FIG. 1. In FIG. 4, the same elements as in FIG. 3 are indicated with the same number as in FIG. 3. The configuration of FIG. 4 is different from that of FIG. 3 in the point that there is no switch for changing the compensation voltage level in the external power source and the drive IC has a voltage inverter circuit.

The external power source supplies one voltage level V1 of the compensating pulse. Another voltage level V5 of the compensating pulse is generated by the voltage converter circuit in the drive IC in accordance with the polarity signal. As a result, the voltage level of the bus line 202 is the same as that shown in Table 1 or 3 of the second embodiment, so that the output voltage of the drive IC is determined in accordance with Table 2 or 4. The condition of the data signal for adding the compensating pulse can be made independent by the way shown in the second embodiment.

By using the drive IC and drive method explained above, crosstalk can be compensated properly in spite of the use of only three bus lines and three switches for one output in the drive IC. Therefore, a chip area can be reduced by 10–20% compared with the conventional drive IC. Thus, the area of the periphery of the LCD panel can be reduced so that the LCD can be compacted and reduced in cost. Though the area of the drive IC of this embodiment may be larger than that of the second embodiment, this embodiment has an advantage in that the external power source can be simplified.

In the second or third embodiment explained above, which one of the positive and negative compensating pulses is added (i.e., the first and second predetermined periods) is determined by the polarity signal. However, another signal can be used for determining the predetermined periods with minor revision to the logic table and by using the same drive IC and circuit.

Fourth Embodiment

In a fourth embodiment of the present invention, the compensating pulse is added in the first predetermined period when the signal voltage V2 is maintained, and in the second predetermined period when the signal voltage V4 is maintained, in such a way that the rms voltage of the data signal decreases.

The case, where the first and second predetermined periods are determined in accordance with the polarity signal, is explained below. In this case, V2 and V4 correspond to on and off of display data, and the corresponding relation is reversed according to the predetermined periods.

Figure 5:
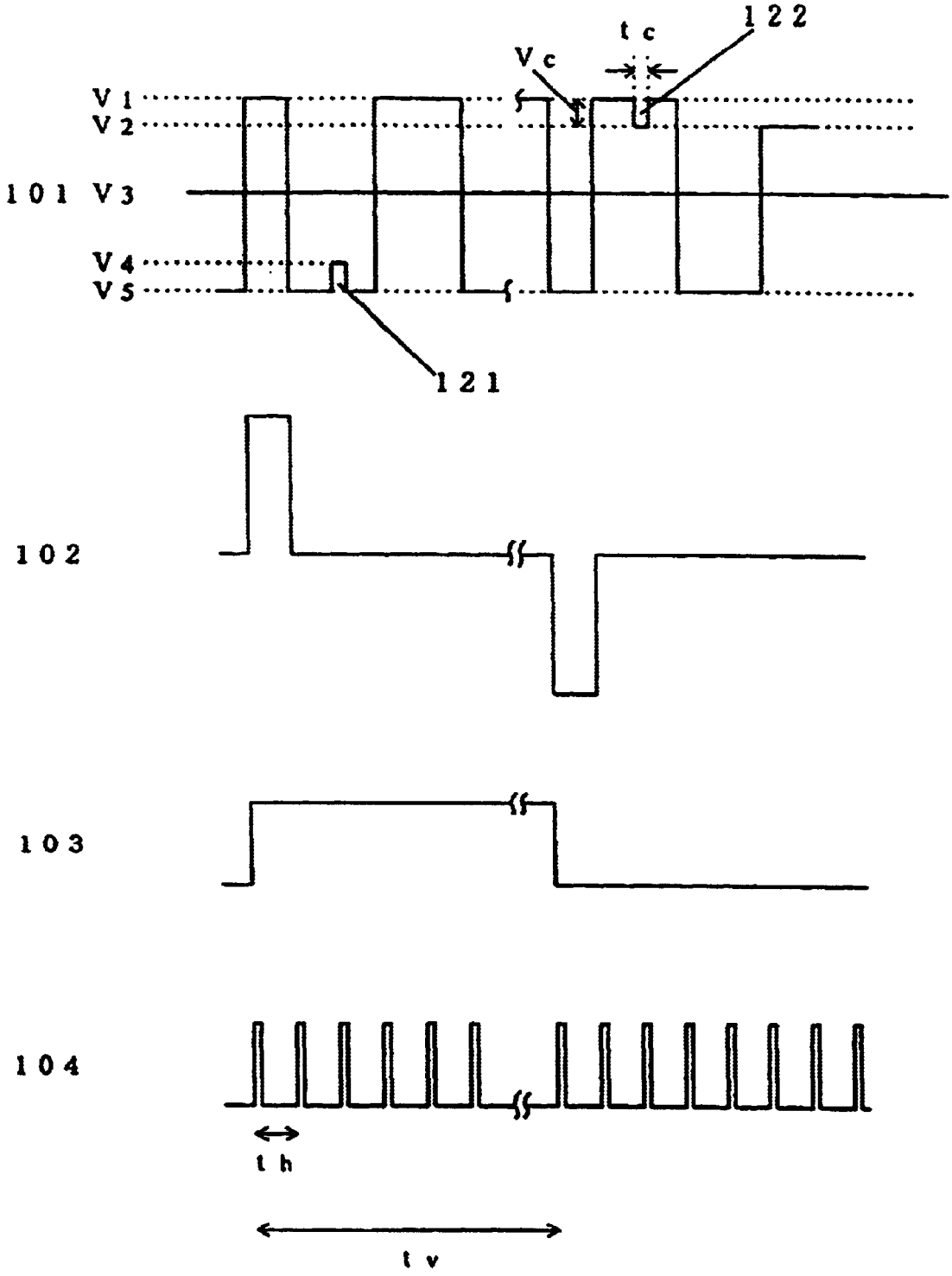
FIG. 5 shows waveforms for a method of driving an LCD according to a fourth embodiment of the present invention.

FIG. 5 shows waveforms of drive signals used in a drive method, according to a fourth embodiment of the present invention. In this drive method, the compensating pulses 121, 122 having a height Vc and a width tc are added in such a way that the rms voltage of the data signal decreases when the data signal is maintained on-level. As mentioned before, the rms (root mean square) voltage of the data signal decreases due to a waveform distortion at the rising and falling edges when the data signal is inverted. According to the drive method of this embodiment, the rms voltage decreases also when the data signal maintains on-level (i.e., is not inverted). Therefore, a difference between rms voltages of the signal lines due to the waveform distortion is relieved, so that the character crosstalk is suppressed or reduced.

Also in this embodiment, only the compensating pulse 121 is added when the polarity signal 103 is high-level, and only the compensating pulse 122 is added when the polarity signal 103 is low-level. Therefore, the signal IC outputs only three voltage levels simultaneously in the same way as the method of the first embodiment. Thus the drive IC and circuit can be simplified. The direct current component is prevented from being added to the liquid crystal by the polarity change.

This embodiment can obtain the effect of reducing crosstalk similarly to the first embodiment. In addition, this embodiment has an advantage in that the compensating pulse is added in such a way that the rms voltage of the data signal decreases. If the drive IC has an upper limit of allowed output voltage that is not high enough to increase the rms voltage of the data signal, or if the power source is not sufficient to increase the rms voltage of the data signal, it is difficult to add the compensation voltage in such a way that the rms voltage of the data signal increases. In such a case, the drive method of this embodiment is effective to add the necessary compensating pulses.

In general, the capacitance of each pixel in an LCD panel is different between an on-pixel and an off-pixel due to the dielectric anisotropism of the liquid crystal molecule. An on pixel usually has a capacitance of 1.2–3.0 times of that of an off-pixel. Therefore, a signal electrode connected to a lot of on-pixels causes larger waveform distortion and greater decrease of rms voltage than a signal electrode connected to a lot of off-pixels even if the data change frequencies are same. It is preferable to add the compensating pulse on the off-level of the data signal for relieving the distortion difference due to the capacitance difference since the compensating pulse is added in such a way that the rms voltage of the data signal decreases in this embodiment.

However, if the compensating pulse is added only on the off-level of the data signal, a signal electrode connected to a lot of on-pixels is scarcely provided with the compensating pulse. To avoid this situation, it is preferable to add the compensating pulse on the off-level of the data signal during a first period and on the on-level during a second period repeatedly. The most proper rate of the first period to the second period depends on the specification of the LCD panel, and the height and width of the compensating pulse. Usually, the first period is set to 1.2–3.0 times the second period so that a balance of compensation amount is obtained. The first and second periods are set independently from the first and second predetermined periods mentioned before.

As mentioned above, by changing the signal electrodes that are provided with the compensating pulse between one group maintaining the on-level and another group maintaining the off-level of the data signal, good display properties can be obtained even if the number of the on-pixels is different from that of the off-pixels on the signal electrode. In addition, an influence of the characteristic difference of the drive IC or circuit between the positive and negative levels on the display properties can be relieved.

In FIG. 5, the compensating pulses 121, 122 are added at the starting portion of the horizontal scanning period th. However, the compensation pulse can be added at any time during the horizontal scanning period th to compensate the crosstalk.

In this embodiment, the compensating pulse is added after the signal voltage becomes stable at the predetermined level V1 or V5. Therefore, the waveform distortion of the compensating pulse itself is smaller than that shown in FIG. 1 similarly to the case where the compensating pulse is added a predetermined period after the beginning of the horizontal scanning period tc. Thus, the product of the height Vc and the width tc is preferably set about at 80% of the value range shown in the expressions (2) and (3) in the first embodiment. A preferable value of the pulse width tc will be explained later in a fourteenth embodiment.

In this embodiment, which one of the positive and negative compensating pulses is added (i.e., the first and second predetermined periods) is determined by the polarity signal. Thus, the compensating pulse is added or not added according to the determination on the basis of the changing direction of the display data. In addition, another control signal is not required for selecting the positive or negative compensating pulse to be added.

However, a signal independent of the polarity change of the scanning pulse can be used for the above determination. Thus, a more desired condition for LCD panel properties can be set. The first and second predetermined periods are preferably set equal so that a direct current voltage is not applied to the LCD panel. In this case too, the crosstalk can be compensated adequately even though only three voltage levels are supplied to the signal drive IC.

It is preferable to set the first and second predetermined period in the value range explained in the first embodiment.

Fifth Embodiment

Figure 6:
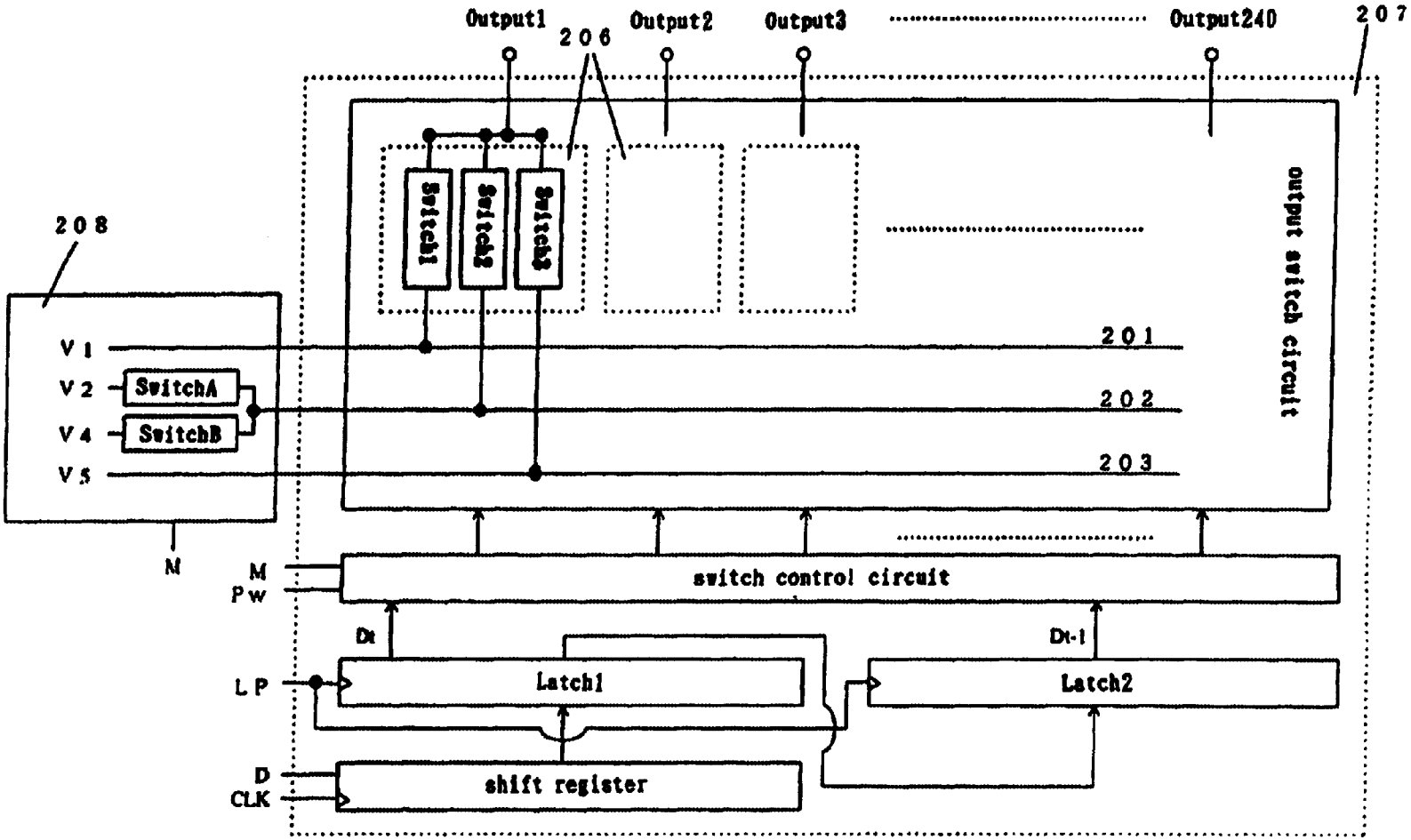
FIG. 6 is a block diagram showing a drive IC and circuit for an LCD according to a fifth embodiment of the present invention.

FIG. 6 shows a block diagram of a drive IC and circuit of an LCD according to a fifth embodiment of the present invention. The drive IC and circuit of this embodiment generate the drive waveforms shown in FIG. 5. In FIG. 6. the same members as in FIG. 3 of the second embodiment are indicated with the same numerals. The external power source of this embodiment is different from that of FIG. 3. The external power source in FIG. 6 has an on-level and an off-level V1 and V5, and compensation levels V2 and V4.

In the same way as the second embodiment, the compensation level that is added to the bus line 202 of the drive IC 207 is determined according to the polarity signal M using Table 5.

TABLE 5

| M | on switch | supplied voltage to bus 202 |
|---|---|---|
| H | Sw-B | V 4 |
| L | Sw-A | V 2 |

The operation of the drive IC is similar to that of the drive IC explained in the second embodiment. The output signal of each output line is determined in accordance with Table 6.

TABLE 6

| D t-1 | D t | M | P w | on switch | output t |
|---|---|---|---|---|---|
| * | L | L | L | Sw-1 | V 1 |
| * | H | L | L | Sw-3 | V 5 |
| * | L | H | L | Sw-3 | V 5 |
| * | H | H | L | Sw-1 | V 1 |
| L | L | L | H | Sw-2 | V 2 |
| H | L | L | H | Sw-1 | V 1 |
| L | H | L | H | Sw-3 | V 5 |
| H | H | L | H | Sw-3 | V 5 |
| L | L | H | H | Sw-2 | V 4 |
| H | L | H | H | Sw-3 | V 5 |
| L | H | H | H | Sw-1 | V 1 |
| H | H | H | H | Sw-1 | V 1 |

*: L or H

Tables 5 and 6 show the case in which the compensating pulse is added when the data signal maintains the on-level. If the compensation pulse is added when the data signal maintains the off-level, Table 7 and 8 are used for determining the supply voltage levels from the external power source to the drive IC and the output voltage of the drive IC.

TABLE 7

| M | on switch | supplied voltage to bus 202 |
|---|---|---|
| H | Sw-A | V 2 |
| L | Sw-B | V 4 |

TABLE 8

| D t-1 | D t | M | P w | on switch | output t |
|---|---|---|---|---|---|
| * | L | L | L | Sw-1 | V 1 |
| * | H | L | L | Sw-3 | V 5 |
| * | L | H | L | Sw-3 | V 5 |
| * | H | H | L | Sw-1 | V 1 |
| L | L | L | H | Sw-1 | V 1 |
| H | L | L | H | Sw-1 | V 1 |
| L | H | L | H | Sw-3 | V 5 |
| H | H | L | H | Sw-2 | V 4 |
| L | L | H | H | Sw-3 | V 5 |
| H | L | H | H | Sw-3 | V 5 |
| L | H | H | H | Sw-1 | V 1 |
| H | H | H | H | Sw-2 | V 2 |

*: L or H

The condition of the data signal for adding the compensating pulse (the data signal maintaining the on or off level) can be coexisted by alternating them for an adequate period. In this case, a set of Table 5 and 6 or a set of Table 7 and 8 can be used alternating them by another control signal, or another table including another control signal can be used.

In an example, a STN type LCD was made for 800×600 dots color display using the above explained IC as a signal drive IC and a normal drive IC as a scanning drive IC. As a result, a very good display was obtained that scarcely had crosstalk. The period of polarity change was set equal to one frame period in this example.

By using the drive IC and circuit explained above, crosstalks can be compensated properly in spite of the use of only three bus lines and three switches for one output in the drive IC. Therefore, the chip area can be reduced by 10–20% compared with the conventional drive IC. Thus, the area of the periphery of the LCD panel can be reduced so that the LCD can be compacted and reduced in cost.

Sixth Embodiment

Figure 7:
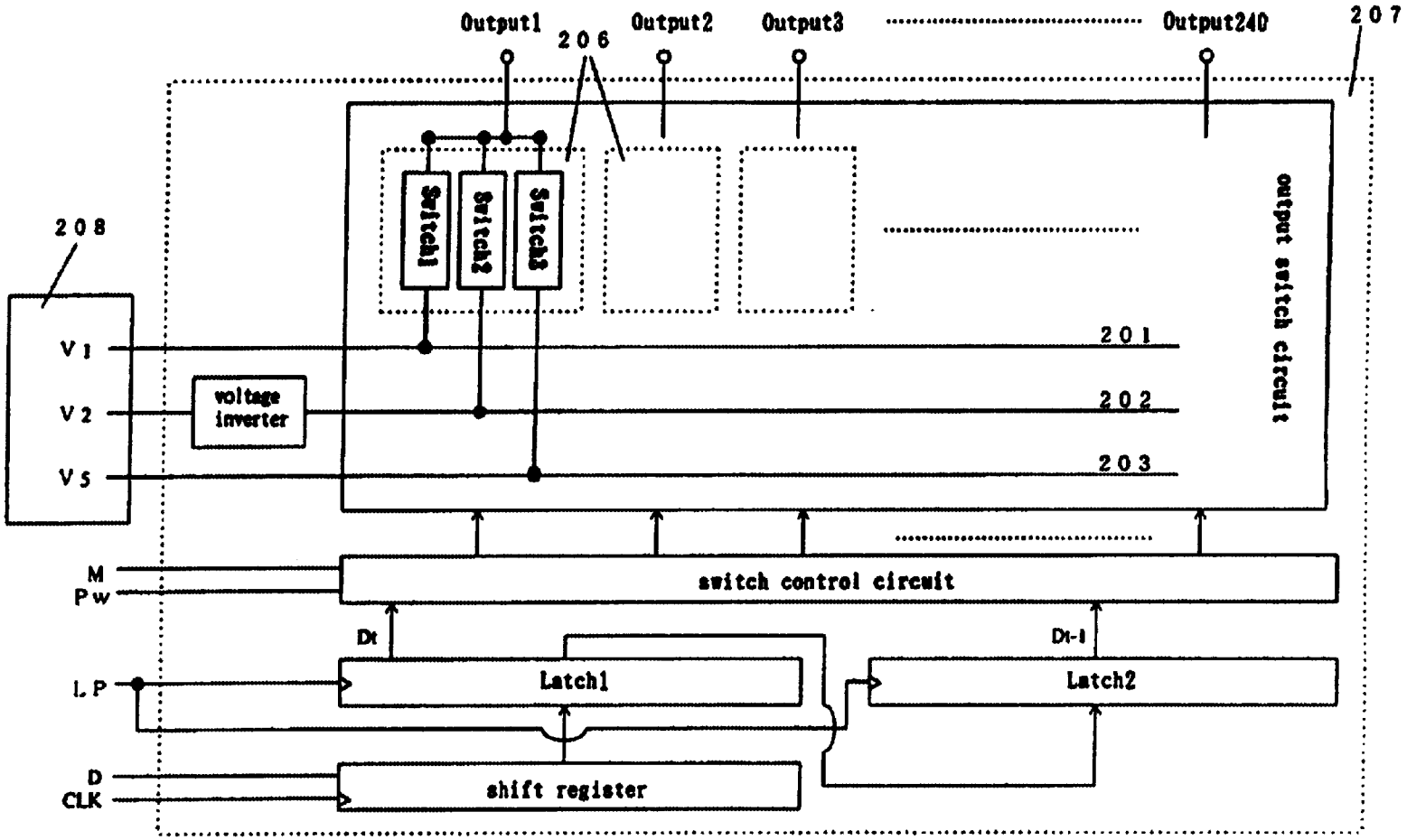
FIG. 7 is a block diagram showing a drive IC and circuit for an LCD according to a sixth embodiment of the present invention.

FIG. 7 shows a block diagram of a drive IC and circuit of an LCD according to a sixth embodiment of the present invention. This drive IC and circuit are used for generating the drive signals shown in FIG. 5. In FIG. 7, the same members as in FIG. 6 of the fifth embodiment are indicated with the same numerals. The external power source of this embodiment has no switch for changing the compensation voltage level and the drive IC has a voltage inverter circuit in the same way as the third embodiment.

The external power source supplies one voltage level V2 of the compensating pulse. Another voltage level V4 of the compensating pulse is generated by the voltage inverter circuit in the drive IC in accordance with the polarity signal. As a result, the voltage level of the bus line 202 is the same as that shown in Table 5 or 7 of the fifth embodiment, so that the output voltage of the drive IC is determined in accordance with Table 6 or 8.

By using the drive IC and drive method explained above, crosstalks can be compensated properly even though there are only three bus lines and three switches for one output in the drive IC. Therefore, the chip area can be reduced by 10–20% compared with the conventional drive IC. Thus, the area of the periphery of the LCD panel can be reduced so that the LCD can be compacted and reduced in cost. Though the area of the drive IC of this embodiment may be larger than that of the fifth embodiment, this embodiment has an advantage in that the external power source can be simplified.

In the fifth or sixth embodiment explained above, which one of the positive and negative compensating pulses is added (i.e., the first and second predetermined periods) is determined by the polarity signal. However, another signal can be used for determining the predetermined periods with minor revision to the logic table and by using the same drive IC and circuit.

Seventh Embodiment

Figure 19:
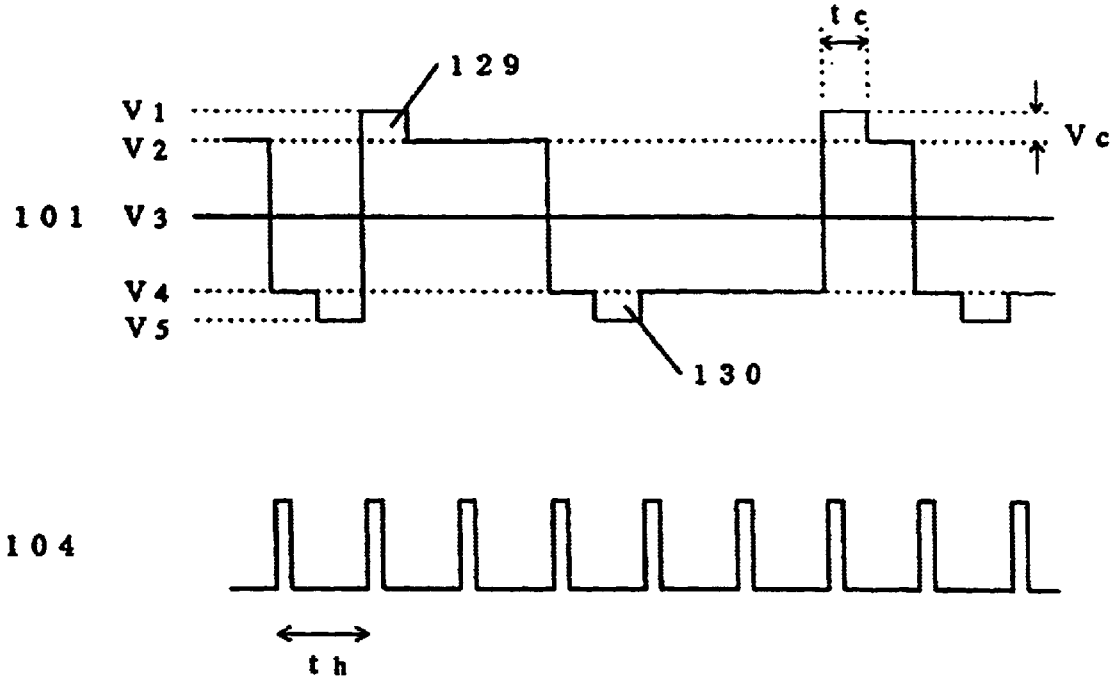
FIG. 19 shows waveforms for a method of driving an LCD according to a seventh embodiment of the present invention.

FIG. 19 shows drive waveforms for the drive method according to a seventh embodiment of the present invention. In this embodiment, the compensating pulses 129 and 130 are added when the signal voltage changes from V4 to V2 as well as from V2 to V4 in the same way as the conventional drive method. The effect of the compensating pulses that compensate the rms voltage decrease is the same as the conventional drive method.

The drive method of this embodiment is different from that of the conventional drive method in a following point. The timing (phase) of the compensating pulse 129, which is added to V2 when the signal voltage changes from V4 to V2, in the horizontal scanning period th is different from that of the compensating pulse 130 that is added to V4 when the signal voltage changes from V2 to V4. In FIG. 19, the compensating pulse 129 is added in the first half of the horizontal scanning period th, and the compensating pulse 130 is added in the second half of the horizontal scanning period th.

According to the drive method of this embodiment, the voltage level V1 of the compensating pulse 129 is output only in the first half of the horizontal scanning period th, and the voltage level V5 of the compensating pulse 130 is output only in the second period. Therefore, there is no time when two compensating pulses are output simultaneously, taking into account the plural signal electrodes. The signal drive IC output at most three voltage levels simultaneously, so that the drive IC and circuit can be simplified.

The drive IC and circuit of this embodiment may be the same as those shown in FIG. 3 or 4. The voltage that is applied to the bus line 202 is switched by an external switch in FIG. 3, while it is obtained by inverting the voltage level by the voltage inverter circuit in the drive IC in FIG. 4. Though the M signal (polarity changing signal) is used in the second or third embodiment, this embodiment controls the supply voltage so that V1 is supplied to the bus line 202 in the first half of the horizontal scanning period th, and V5 is supplied to the bus line 202 in the second half of the horizontal scanning period th. In addition, different logic tables are prepared for the first and second half of the horizontal scanning period, and the voltage level on the bus line 202 is output in the first half of the horizontal scanning period when the signal voltage changes from V4 to V2, while it is output in the second half of the horizontal scanning period when the signal voltage changes from V2 to V4. Thus, the drive waveform shown in FIG. 19 is obtained. The logic table can be made using signal voltage levels Vt−1 and Vt (without the compensating voltage) in two consecutive scanning periods, as shown in Table 9 for the first half and Table 10 for the second half of the horizontal scanning period.

TABLE 9

| V t-1 | V t | P w | on switch | output t |
|---|---|---|---|---|
| V 2 | V 2 | L | Sw-1 | V 2 |
| V 4 | V 2 | L | Sw-1 | V 2 |
| V 2 | V 4 | L | Sw-3 | V 4 |
| V 4 | V 4 | L | Sw-3 | V 4 |
| V 2 | V 2 | H | Sw-1 | V 2 |
| V 2 | V 2 | H | Sw-2 | V 1 |
| V 4 | V 4 | H | Sw-3 | V 4 |
| V 4 | V 4 | H | Sw-3 | V 4 |

TABLE 10

| V t-1 | V t | P w | on switch | output t |
|---|---|---|---|---|
| V 2 | V 2 | L | Sw-1 | V 2 |
| V 4 | V 2 | L | Sw-1 | V 2 |
| V 2 | V 4 | L | Sw-3 | V 4 |
| V 4 | V 4 | L | Sw-3 | V 4 |
| V 2 | V 2 | H | Sw-1 | V 2 |
| V 2 | V 2 | H | Sw-1 | V 2 |
| V 4 | V 4 | H | Sw-2 | V 5 |
| V 4 | V 4 | H | Sw-3 | V 4 |

The drive method of this embodiment has another merit of ease in adjusting the compensation amount between the positive and negative compensating pulses. By suppressing the output of the compensating pulse for a certain period in the first half of the horizontal scanning period th using the phase control technology, the compensation amount of the positive level can be reduced. By suppressing the output of the compensating pulse for a certain period in the second half of the horizontal scanning period th using the phase control technology, the compensation amount of the negative level can be reduced. Thus, the positive and negative compensation amounts can be adjusted easily by suppressing the output of the compensation pulse for a certain period. This method can be performed by making the periods, in which the compensation pulse control signal Pw is high, different between the first and second half of the horizontal scanning period. Alternatively, the voltage level of the external power source V1, V5 may be changed to V2 or V4 in a predetermined period in FIG. 3.

In this embodiment, the compensating pulse has the width that is approximately half of the horizontal scanning period th. However, the width of the compensating pulse may be shorter than the above mentioned value within the range explained later in the fourteenth embodiment. If the compensating pulse is added away from the beginning or the end of the horizontal scanning period th, the distortion of the data signal and the compensating pulse do not interfere with each other, so that the good display properties can be obtained. In addition, the resistance of the bus line 202 and the switch connected to the bus line 202 can be high, so that the drive IC and the external circuit can be designed easily. This advantage will be explained later in an eighth embodiment. In the drive method of this embodiment, where the double number of the compensating pulses are added compared with the first embodiment, it is preferable that the product of the height Vc and the width tc of the compensating pulse is approximately half of the value explained in the first embodiment.

The two kinds of compensation pulses are not always required to be separated at the beginning and the end of the horizontal scanning period respectively, as long as they are separated without an overlapping period.

By alternating the position (timing) of the compensating pulse for a proper period, the positive and negative waveforms may be balanced more so that the influence of the characteristic difference of the drive IC or circuit between the positive and negative levels on the display properties can be reduced. For example, the compensation pulse is added in the first half of the horizontal scanning period th when the data signal changes from on to off, while it is added in the second half of the horizontal scanning period th when the data signal changes from off to on. Thus, the timings in the horizontal scanning period, when V1 or V5 is output, alternate naturally according to the polarity signal. In this case, the data signal Dt−1, Dt and the polarity signal M are used instead of the signal voltage levels Vt−1 and Vt for making the logic table.

In another method for balancing the positive and negative compensating pulses, the positive compensating pulse is added in the first half and the negative compensating pulse is added in the second half of a certain horizontal scanning period, while the negative compensating pulse is added in the first half and the positive compensating pulse is added in the second half of the next horizontal scanning period. This method has another advantage in that the compensating pulse is changed between the positive and negative pulses only once per a horizontal scanning period, so that the changing frequency can be reduced by 50%.

In the drive method of this embodiment, the power consumption may be larger than the method of the first embodiment since the inverting frequency of the positive and negative compensating pulses is larger, but this embodiment has an advantage in that a flicker is hardly generated as explained below. In the drive method of this embodiment, a rising edge of the signal voltage with a positive compensating pulse is always followed by a falling edge of the signal voltage with a negative compensating pulse after some horizontal scanning periods for each pixel, so that the offset of the positive and negative compensating pulses is completed earlier than the drive method of the first embodiment. Therefore, a flicker is hardly generated due to the low frequency component of the pixel voltage. In addition, both of the positive and negative compensating pulses are output in a horizontal scanning period and distributed in a whole picture frame according to the drive method of this embodiment, so that the flickers are set off with each other. Thus, this embodiment is superior in flicker characteristics.

The above explanation is based on the drive method in which the compensating pulse is added for increasing the rms voltage when the data signal is changed. However, this embodiment can be applied to the drive method in which the compensating pulse is added for decreasing the rms voltage when the data signal maintains its level.

Eighth Embodiment

Figure 8:
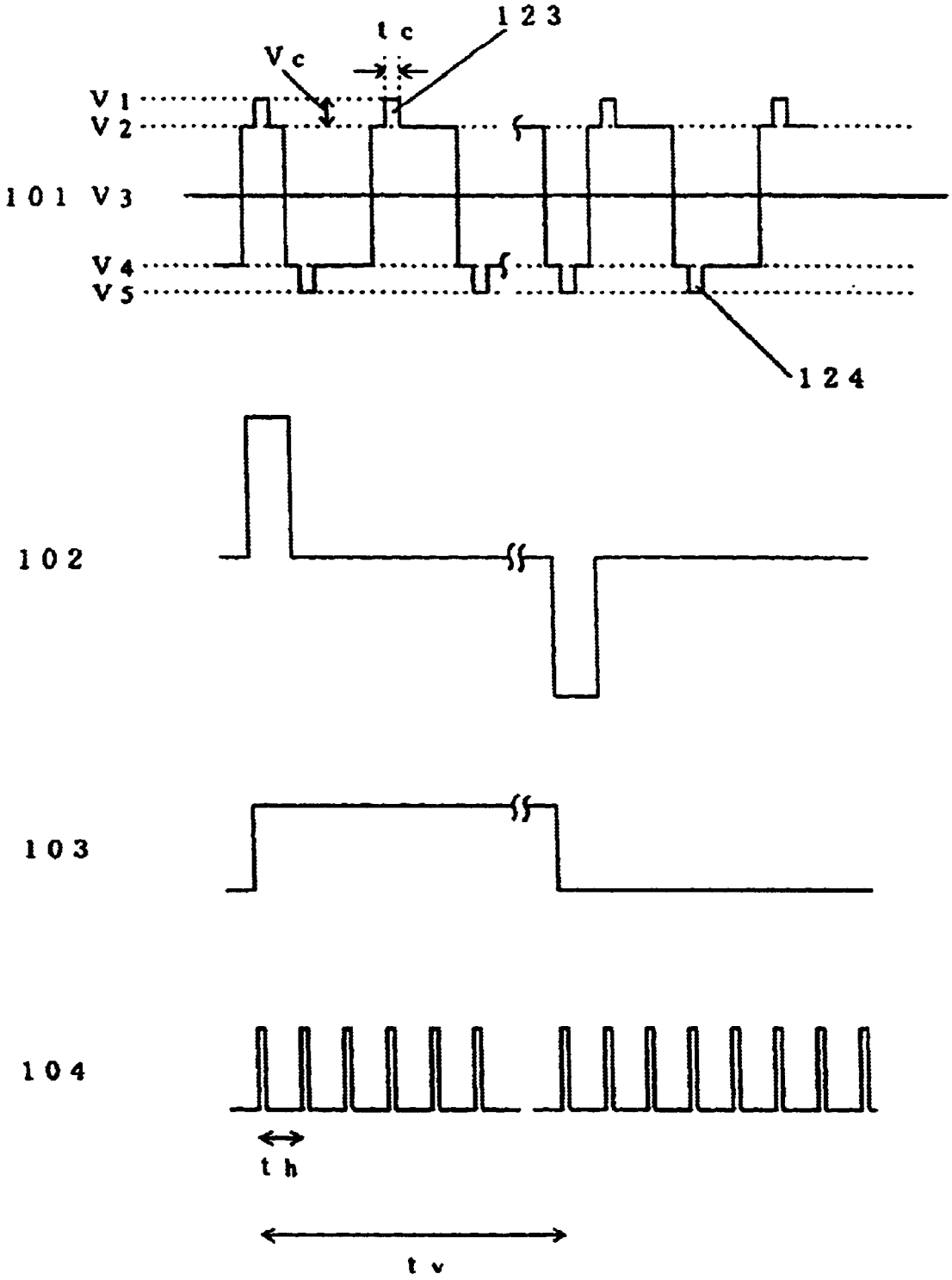
FIG. 8 shows waveforms for a method of driving an LCD according to an eighth embodiment of the present invention.

FIG. 8 shows drive waveforms for a drive method according to an eighth embodiment of the present invention. In FIG. 8, the compensating pulses 123, 124, which have a height Vc and a width tc, are added when the data signal voltage changes on/off state. The original signal voltage level V2 or V4 is output, and after that, the compensating pulse is added to the voltage level V2 or V4 so as to make the voltage level V1 or V5.

Figure 9:
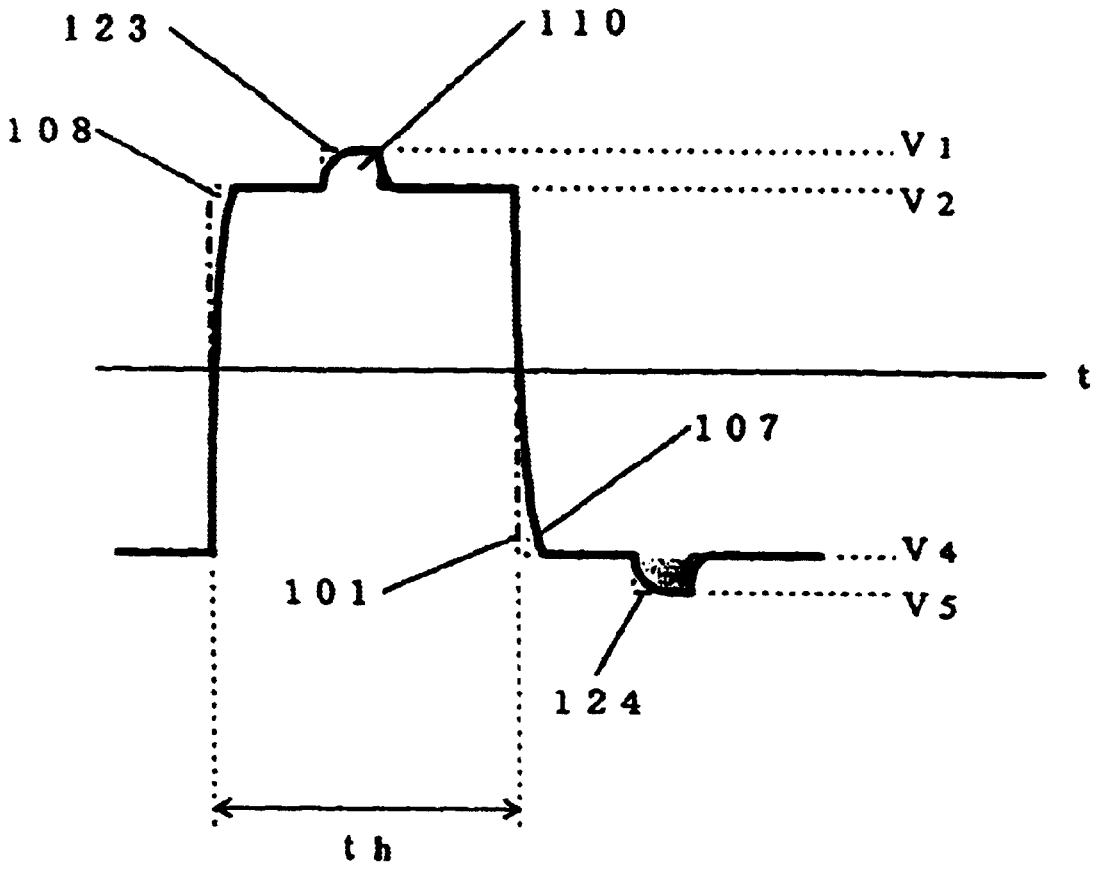
FIG. 9 shows waveforms for explaining the effect of the compensating pulse of the drive method shown in FIG. 8.

FIG. 9 shows the effect of the above mentioned compensating pulse. In the same way as the first embodiment, the decrease of the rms voltage 108 is compensated by the rms voltage compensating portion 110 of the compensating pulses 123, 124 so that each pixel is applied an adequate rms voltage.

This embodiment has an advantage in that the drive IC and the external power source are designed easily since the large voltage switching is always performed concerning the signal voltage level, and the switching of the compensating voltage is rather small as explained below in detail.

The signal voltages V2 and V4 are approximately +/−2 volts, so the waveform distortion occurs concerning the switching of about 4 volts voltage. This distortion generates a rms voltage loss 108 in FIG. 9. If the voltage loss is smaller, the compensating amount of the compensating pulse 123, 124 can be smaller.

In this embodiment, the distortion of the compensating pulse is generated when switching between V1 and V2 or between V4 and V5. Since the height of the compensating pulse is several tens to hundreds millivolts, a distortion of the compensating pulse is much smaller than that of the signal voltage, and does not have much influence on the whole rms voltage.

The rising or falling edge is generated toward every voltage level V1, V2, V4 or V5. However, the switching of the signal voltage is always toward V2 or V4. As explained above, the distortion of the signal voltage is better to be small, while the distortion of the compensating pulse can be large. Therefore, a resistance of the power supplying line and switch can be high for the voltages V1 and V5, though it should be low for the voltages V2 and V4. Thus the flexibility in designing the drive IC and circuit may be increased.

The compensating pulse is added to the signal voltage at the middle of the horizontal scanning period th in FIG. 8. However, it can be added anywhere in the horizontal scanning period th after the switching is completed.

A time constant of the switching toward V2 or V4 is given by the following approximate equation.

$$B=(R\text{out}+R\text{pix}\times n)\times(C\text{pix}\times n)/2, \quad (5)$$

where, Rout is a resistance of one line excluding a pixel portion, i.e., a sum of panel wiring resistance, connection resistance and IC output resistance. The IC output resistance is a value when the voltage V2 or V4 is output as it depends on an output voltage.

After switching, the voltage reaches 86% of the final voltage after the double period of the time constant passing, 95% after the triple period of the time constant passing, and 99% after the quintuple of period of the time constant passing. Therefore, the effect of the present invention may be obtained if the compensating pulse is added after the double period of the time constant passing. It is preferable to add the compensating pulse after the triple period of the time constant. If the compensating pulse is added after the quintuple period of the time constant, the effect may be obtained substantially completely. It is better to secure above mentioned period between the end of the compensating pulse and the end of the horizontal scanning period th, since the waveform distortion of the compensating pulse may interfere with the distortion of the signal voltage in the next horizontal scanning period if there is not enough time between them.

Ninth Embodiment

Figure 10:
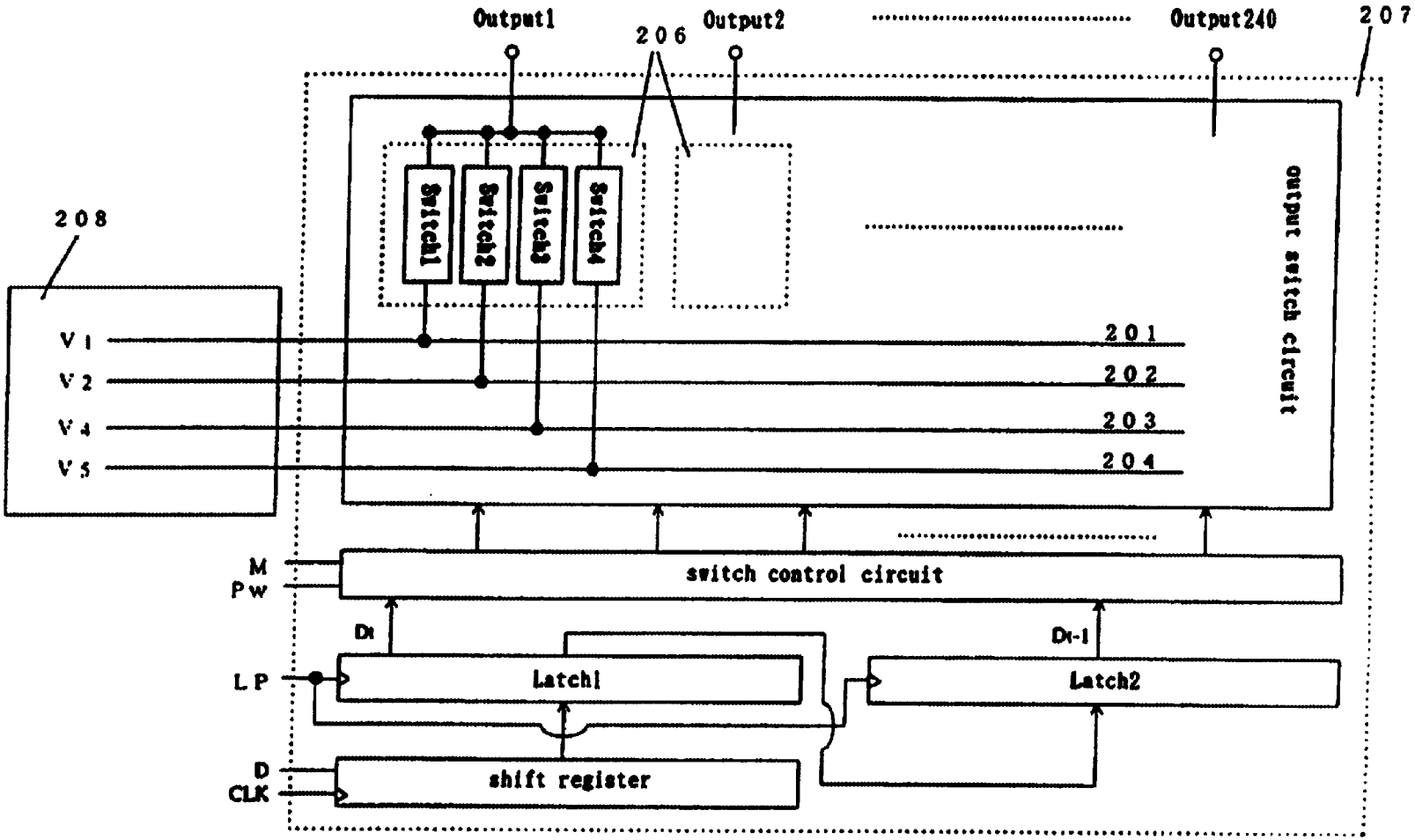
FIG. 10 is a block diagram showing a drive IC and circuit for an LCD according to a ninth embodiment of the present invention.

FIG. 10 shows a block diagram of a drive IC and circuit according to a ninth embodiment of the present invention. This drive IC and circuit are used for generating the drive signals shown in FIG. 8. In FIG. 10, the same elements as in FIG. 3 (second embodiment) are indicated with the same numbers as in FIG. 3. The configuration of FIG. 10 is different from that of FIG. 3 in the point that there is no switch in the external power source, there are four switches for one output of the drive IC, and a bus line 204 is added.

The operation of the drive IC is similar to that of the second embodiment. The output signal of each output line is determined in accordance with Table 11.

TABLE 11

| $D_{t-1}$ | $D_t$ | M | $P_w$ | on switch | output t |
|---|---|---|---|---|---|
| * | L | L | L | Sw-2 | V2 |
| * | H | L | L | Sw-3 | V4 |
| * | L | H | L | Sw-3 | V4 |
| * | H | H | L | Sw-2 | V2 |
| L | L | L | H | Sw-2 | V2 |
| H | L | L | H | Sw-1 | V1 |
| L | H | L | H | Sw-4 | V5 |
| H | H | L | H | Sw-3 | V4 |
| L | L | H | H | Sw-3 | V4 |
| H | L | H | H | Sw-4 | V5 |
| L | H | H | H | Sw-1 | V1 |
| H | H | H | H | Sw-2 | V2 |

*: L or H

The drive IC of this embodiment has a reduced chip size using the effect of the drive method according to the eighth embodiment. The output resistance of Switch 2 and Switch 3 for the signal voltage V2 and V4 is 500 ohm, while the output resistance of Switch 1 and Switch 4 for the compensating pulse is 5 kilohm. Thus, the areas for Switch 1 and Switch 4 can be reduced to one tenth, so that the chip area is reduced by approximately 10%. The distortion of the compensating pulse becomes large if the output resistance of Switch 1 and Switch 4 is too high, while if the resistance is too low, the effect of chip area reduction is not enough. The output resistance is preferably set within 1–25 kilohm, and more preferably set within 2–10 kilohm. In other words, the output resistance for the output of the compensating pulse is preferably set 2–50 times (more preferably 4–20 times) of the output resistance for the output of the signal voltage.

It is preferable to adjust the height Vc and the width tc of the compensating pulse according to the output resistance of the switch for the output of the compensating voltage. Using "A" in the equation (1) explained in the first embodiment, the product of Vc and tc is preferably set according to the following expression (6) and more preferably according to the expression (7) when the output resistance for the compensating voltage is at most five times that for the signal voltage.

$$0.032\times A<Vc\times ct<0.72\times A, \quad (6)$$

$$0.072\times A<Vc\times ct<0.40\times A, \quad (7)$$

The pulse width tc is preferably set within a range that will be explained in a fourteenth embodiment.

If the output resistance for the compensating voltage is approximately ten times that for the signal voltage, the product of Vc and tc is preferably set to about twice of the above mentioned value, and the value of tc is preferably set at twice of the above mentioned range.

If the output resistance for the compensating voltage is approximately twenty times that for the signal voltage, the product of Vc and tc is preferably set to about three times of the above mentioned value, and the value of tc is preferably set at three times of the above mentioned range.

In an example, a STN type LCD was made for 800×600 dots color display using the above explained IC as a signal drive IC and a normal drive IC as a scanning drive IC. As a result, a very good display was obtained that scarcely had crosstalk similarly to the one with the output resistance of 500 ohm for the Switch 1 and Switch 4. The period of polarity change was set equal to one frame period in this example.

By using the inexpensive and compact drive IC explained above, crosstalk can be compensated properly. As a result, the area of the periphery of the LCD panel can be reduced so that the LCD can be compacted and reduced in cost.

By using the drive method explained in the eighth embodiment, the resistance of the bus line 201, 204 can be set higher than that of the bus line 202, 203, so that the bus line 201, 204 can be made narrow to reduce the chip area. This chip area reduction can be performed independently from the area reduction of the Switch 1 and Switch 4 mentioned above.

In addition, by using the drive method explained in the eighth embodiment, the current capacity or the wire resistance for supplying V1 and V5 can be reduced from that for V2 and V4 in the external power source. Thus, the external power source can be compacted or reduced in cost.

Tenth embodiment

A tenth embodiment of the present invention uses the drive IC and circuit explained in the ninth embodiment, combined with the drive method where the compensating pulse is added for decreasing the rms voltage when the signal voltage is maintained at the same level.

Figure 11:
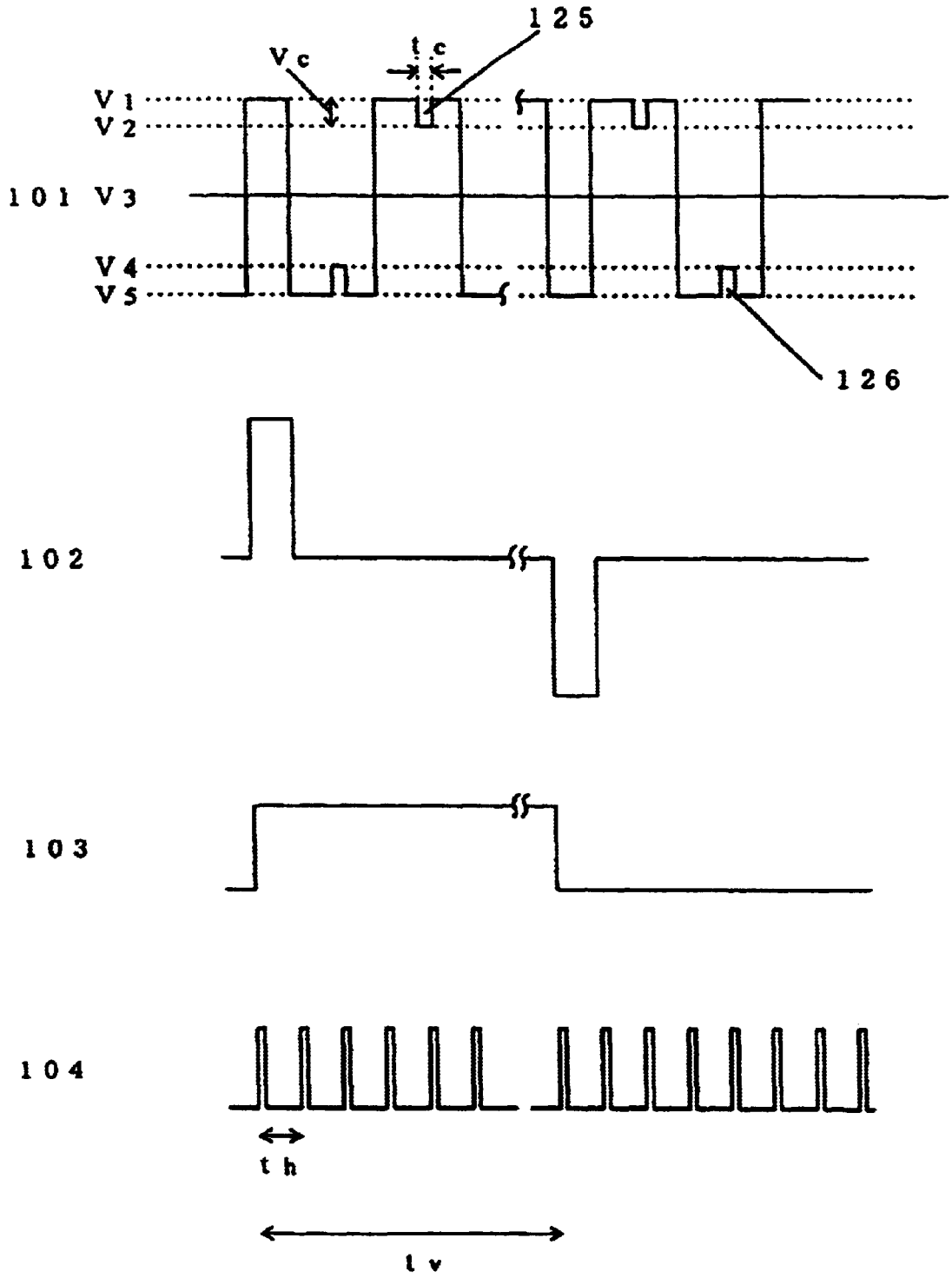
FIG. 11 shows waveforms for a method of driving an LCD according to a tenth embodiment of the present invention.

FIG. 11 shows drive waveforms, where the compensating pulse 125, 126 are added to the signal voltage for decreasing the rms voltage of the signal when the signal voltages maintained at the same level.

The drive IC and circuit is the same as the ninth embodiment (FIG. 10). The drive waveform shown in FIG. 11 is different from that shown in FIG. 8 in that V1 and V5 are the signal voltage levels and that V2 and V4 are the compensating voltage levels. Therefore the logic table for determining the output waveform is different between this embodiment and the ninth embodiment. Table 12 is the logic table used for this embodiment.

TABLE 12

| $D_{t-1}$ | $D_t$ | M | $P_w$ | on switch | output t |
|---|---|---|---|---|---|
| * | L | L | L | Sw-1 | V1 |
| * | H | L | L | Sw-4 | V5 |
| * | L | H | L | Sw-4 | V5 |
| * | H | H | L | Sw-1 | V1 |
| L | L | L | H | Sw-2 | V2 |
| H | L | L | H | Sw-1 | V1 |
| L | H | L | H | Sw-4 | V5 |
| H | H | L | H | Sw-3 | V4 |
| L | L | H | H | Sw-3 | V4 |
| H | L | H | H | Sw-4 | V5 |
| L | H | H | H | Sw-1 | V1 |
| H | H | H | H | Sw-2 | V2 |

*: L or H

In FIG. 11, wherever in the horizontal scanning period the compensating pulse is added to the signal voltage, a large change of the voltage is generated toward V1 or V5, and the switching of the compensating voltage does not generate a large reduction of the rms voltage. However, it is better to secure a sufficient period between the end of the compensating pulse and the end of the horizontal scanning period th, since the waveform distortion of the compensating pulse may interfere with the distortion of the signal voltage in the next horizontal scanning period if there is not a large enough period between them.

In this embodiment, V2 and V4 are compensating voltages. Therefore, by making the output resistance of the Switch 2 and Switch 3 high, the same effect as the ninth embodiment can be obtained. The output resistance is preferably set within the range explained in the ninth embodiment. By reducing the current capacity or the wire resistance for supplying V2 and V4, the LCD can be compacted and reduced in cost as mentioned in the ninth embodiment.

If the pulse width tc of the compensating pulse is too short, the frequency components of the compensating pulse become too high and easy to decrease, so that the adequate compensation is difficult. If the compensating voltage levels V2, V4 are equal to the data signal voltage levels V1, V5 or the non-selecting level V3, the level number is decreased, but the pulse height Vc becomes high. In this case, the pulse width tc should be short so that the adequate compensation becomes difficult. On the contrary, by using the drive IC and circuit, the adequate compensation can be obtained since the compensating voltage V2 and V4 can be set independently from other voltage levels so that the proper pulse height Vc and the pulse width tc can be obtained.

In addition, power consumption scarcely increases in switching of the compensation pulse since the pulse height Vc is set low enough by setting the compensating voltages V2, V4 independently from other voltage levels.

Eleventh Embodiment

Figure 12:
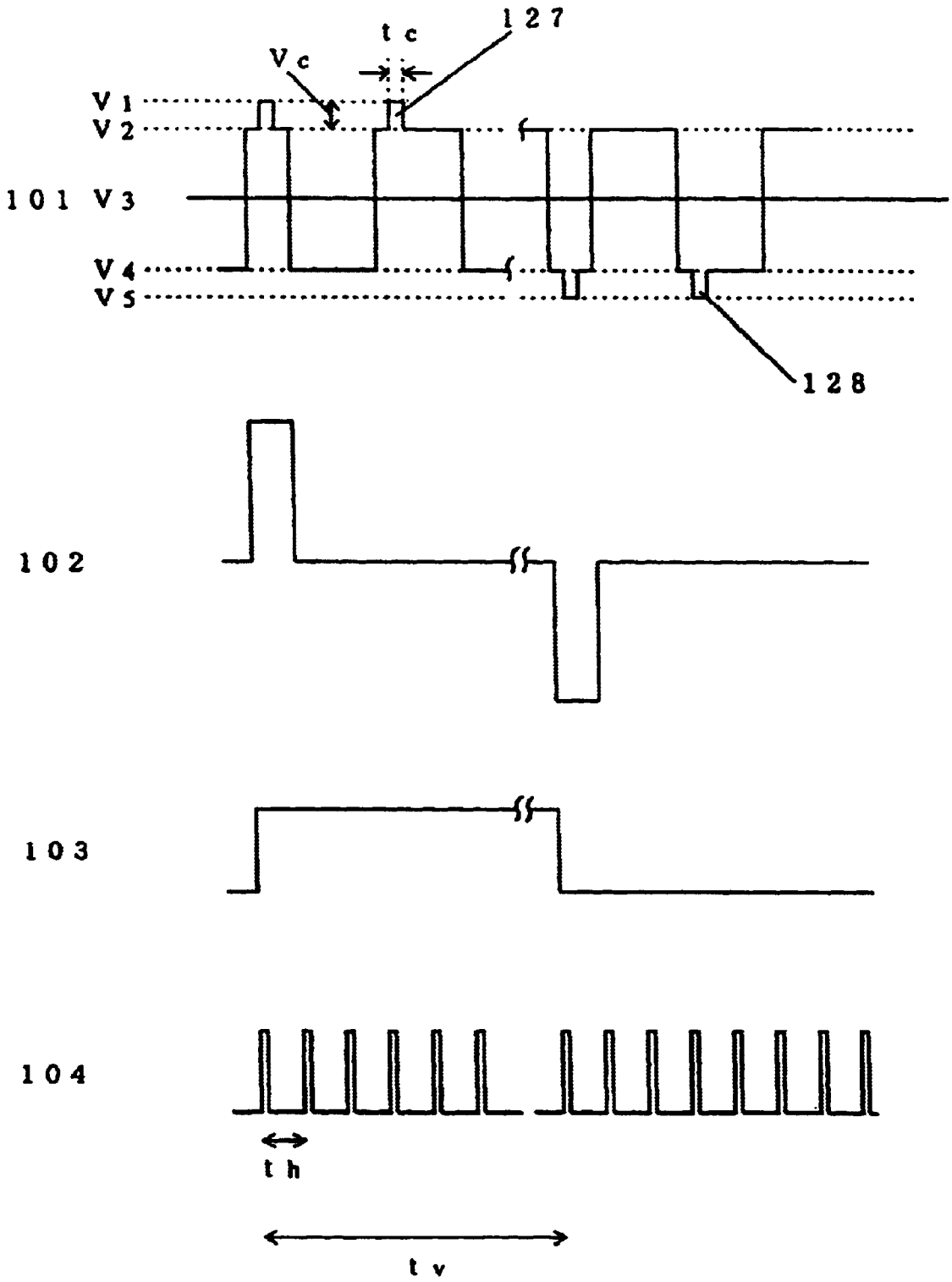
FIG. 12 shows waveforms for a method of driving an LCD according to an eleventh embodiment of the present invention.

FIG. 12 shows drive waveforms of the drive method according to an eleventh embodiment of the present invention. This embodiment is a combination of the drive method according to the eighth embodiment and the drive waveform of the first embodiment (FIG. 1). In FIG. 12, the compensating pulse 127, 128, which have a height vc and width tc, are added when the data signal is switched from on to off. The original voltage level V2 or V4 of the signal voltage is output at first, and after some period the compensating voltage V1 or V5 is added.

In this embodiment, in the same way as the eighth embodiment, the character crosstalk is eliminated or reduced substantially even if the output resistance of the IC for supplying the compensating voltage is high, the current capacity of the external power source is small, or the resistance of the wire and bus line for supplying the compensating voltage is high. By using the drive method according to this embodiment, the simultaneous output number of the signal drive IC is only three, so that the drive IC and circuit can be simplified more than in the drive method according to the eighth embodiment.

The timing or phase for adding the compensating pulse is preferably set within the range explained in the eighth embodiment.

The pulse height Vc and width tc are preferably changed according to the output resistance of the switch for supplying the compensating voltage. It is preferable to set the product of Vc and tc at twice of the value explained in the eighth embodiment since the number of the compensating pulse becomes half of that in the eighth embodiment. The pulse width tc may be set within the range that will be explained in the fourteenth embodiment.

Twelfth Embodiment

A drive IC and circuit for generating the drive waveforms shown in FIG. 12 are explained as a twelfth embodiment.

The block diagram of the drive IC and circuit is the same as that shown in FIG. 3 (second embodiment). In this embodiment, if the voltage switching is generated toward to V1 or V5, the voltage difference is always small. Similar to the eighth embodiment, by making the output resistance of the Switch 2 high for supplying the compensating voltage, the LCD can be compacted and reduced in cost. By using the technology explained in this embodiment, the chip area can be reduced by 5–10% compared to the second embodiment. The output resistance of the Switch 2 is preferably set within the range explained in the ninth embodiment.

By reducing the current capacity of the power source and the resistance of the wiring and the bus line in the drive IC for the voltage levels V1 and V5, the LCD can be compacted and reduced in cost.

Moreover, the configuration of FIG. 4, where the drive IC includes a voltage inverter circuit, can be used instead of the configuration shown in FIG. 3

Thirteenth Embodiment

A drive IC and circuit according to a thirteenth embodiment are explained. This embodiment is a combination of the drive IC and circuit according to the fifth embodiment (FIG. 6) and the technology explained in the ninth or twelfth embodiment so that the LCD is compacted and reduced in cost. The drive IC and circuit shown in FIG. 6 generate drive waves shown in FIG. 5 (fourth embodiment). The switching of large voltage is always toward V1 or V5, and the switching toward V2 or V4 is a change of rather small voltage.

Therefore, similar to the ninth embodiment, the LCD can be compacted and reduced in cost by making the output resistance of the Switch 2 high for output of the compensating voltage level. By using the technology of this embodiment, the chip area of the drive IC is reduced by 5–10% compared with the fifth embodiment. The output resistance of the Switch 2 is preferably set within the range shown in the ninth embodiment.

The current capacity and the resistance of the wire and bus line in the drive IC for supplying V2 and V4 also can be reduced to make the LCD compact and reduced in cost.

Moreover, the configuration of FIG. 7, where the drive IC includes a voltage inverter circuit can be used instead of the configuration shown in FIG. 6

Fourteenth Embodiment

Figure 13:
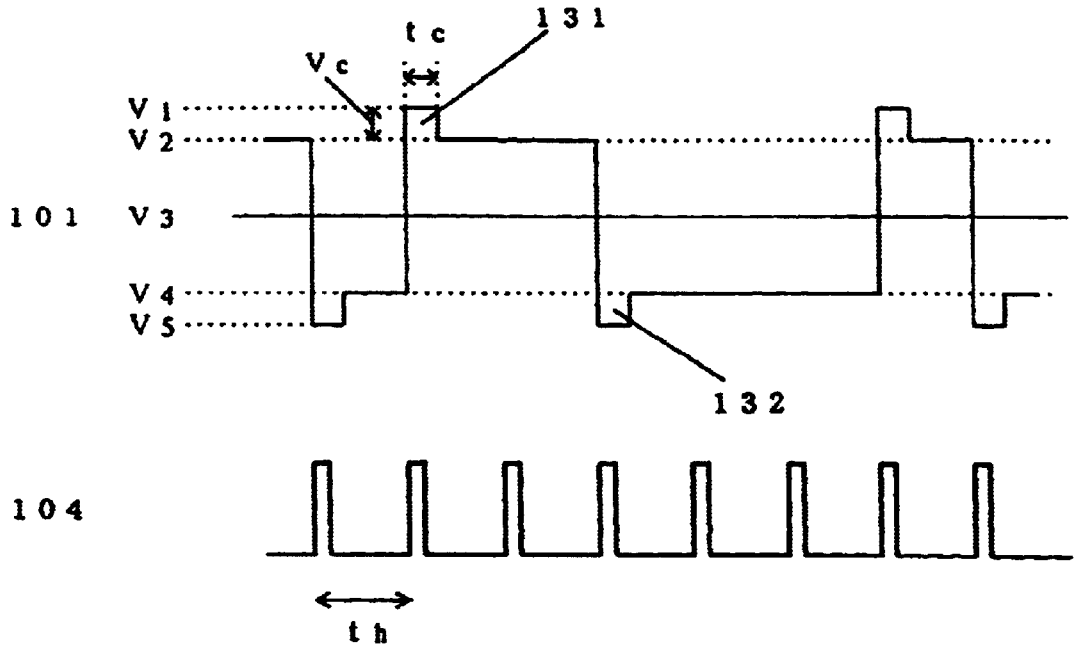
FIG. 13 shows waveforms for a method of driving an LCD according to a fourteenth embodiment of the present invention.

FIG. 13 shows drive waveforms for a method of driving an LCD according to a fourteenth embodiment of the present invention. In the Figure, numeral 101 is data signal voltage, which is V2 or V4 depending on the display pattern. In the same way as the conventional drive waveform, the compensating pulses 131, 132, which have a height Vc and a width tc, are added to the signal voltage when a polarity of the signal voltage changes. Numeral 104 is a latch pulse, and th is a horizontal scanning period for one line.

Figure 14:
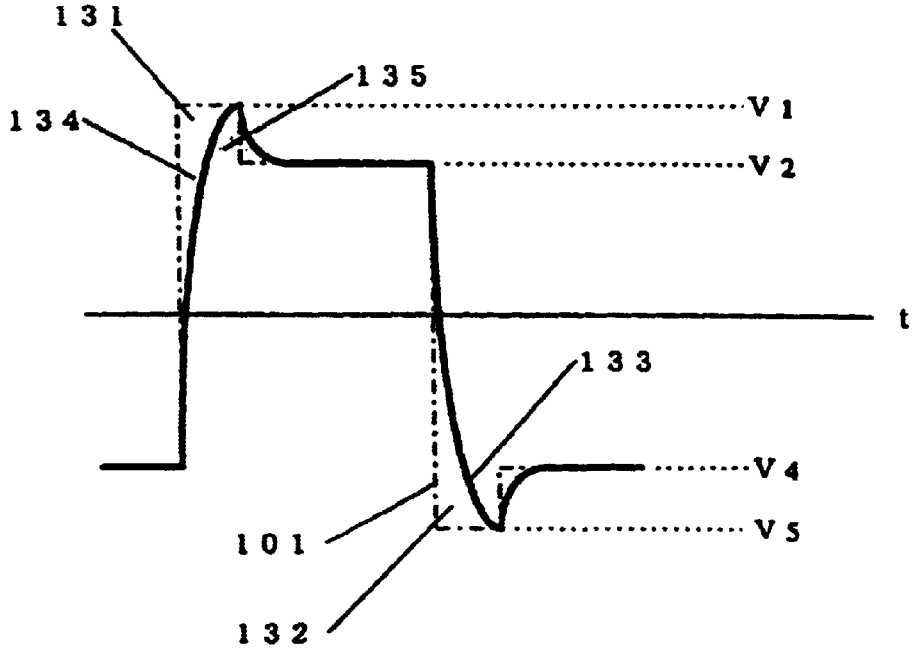
FIG. 14 shows waveforms for explaining the effect of the compensating pulse of the drive method shown in FIG. 13.

FIG. 14 shows an effect of the above mentioned compensating pulse. Similar to the explanation about the first embodiment, the data signal voltage 101 applied from the external source has a distortion due to a CR circuit of the LCD panel, so that the real voltage applied to the pixel has a waveform shown by numeral 133. In this case, an rms voltage decreasing portion 134 is generated due to the waveform distortion. However, a compensating portion 135 whose level is higher than the original voltage is generated by the effect of the compensating pulses 131, 132, and the compensating portion compensates the decrease of the rms voltage so that an adequate rms voltage is applied to each pixel. Thus, the adequate rms voltage is added to each pixel independently from a display data, so that the character crosstalk is substantially reduced.

Figure 15:
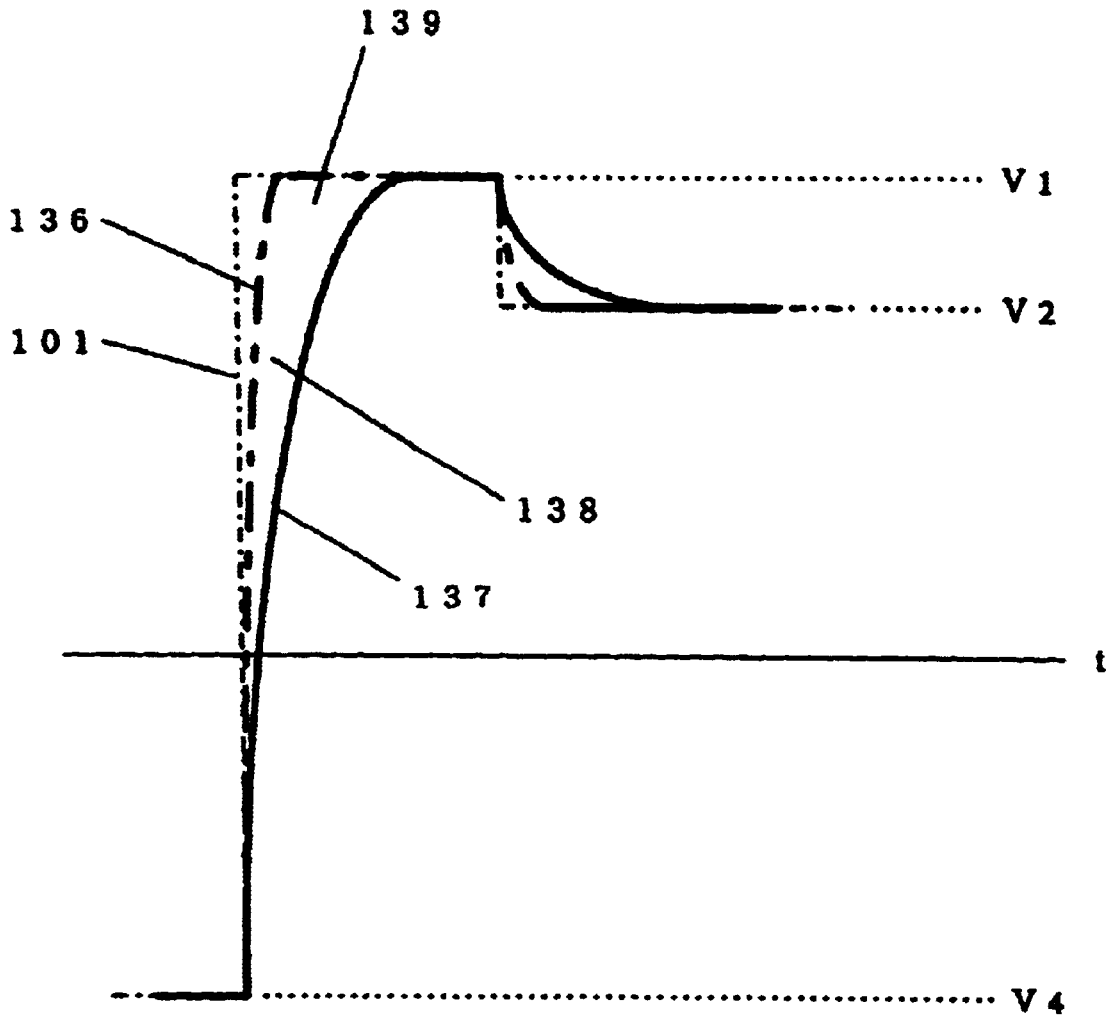
FIG. 15 shows waveforms for explaining a decrease of the signal voltage and the compensating pulse of the drive method shown in FIG. 13.

However, the applied voltage from the outside is gradually decreased inside of the LCD panel due to the CR circuit formed by an electrode resistance and pixel capacitance. FIG. 15 shows an example of this phenomenon, where the compensating pulse is added to the signal voltage whose level changes from V4 to V2. The waveform of the signal voltage applied to the pixel nearest to the power source is indicated with the numeral 136 and its distortion is rather small. On the other hand, the waveform of the signal voltage applied to the pixel farthest from the power source is indicated with the numeral 137 and its distortion is large. The farthest pixel has a larger loss as indicated with 138 and smaller compensating voltage as indicated with 139 than the nearest pixel. Therefore, the farthest pixel tends to suffer from a lack of the crosstalk compensation, while an excessive amount of the crosstalk compensation is added to the nearest pixel. Thus it is difficult to obtain the adequate compensation in whole LCD panel.

According to an experiment using a color STN type LCD panel, in which the sheet resistance of the electrode is 7.5 ohm, the screen is 10.4 inch 640×480 dots, and the signal electrode is not divided into the upper and lower parts, it was found that the generally satisfactory display can be obtained if the pulse width tc of the compensation pulse is more than one micro second, and that the good uniform display can be obtained if the width tc is more than 3 micro seconds. It was also found that the pulse width tc can be determined in accordance with the CR time constant of the pixel portion, excluding a peripheral portion such as a lead wire or a connection portion of the LCD panel.

A CR time constant of the pixel portion of the LCD panel is given by the following approximate equation.

$$\text{Bin}=(R\text{pix}\times n)\times(C\text{pix}\times n)/2, \tag{8}$$

where Rpix is the resistance of a signal electrode per one pixel, Cpix is the capacitance per one pixel, and n is the number of pixel per one signal line.

If the width tc of the compensating pulse is more than one and one-half of the Bin given by the above equation, a substantially satisfactory display can be obtained. If the pulse width tc is more than four times the Bin, the good uniform display can be obtained. Since the capacitance of the liquid crystal varies depending on the applied voltage, the average capacitance of the on pixel and off pixel may be used as Cpix.

A product of the height and the width of the compensating pulse is found to be preferable after a similar investigation if it is 0.2–5.0 volt microseconds, and more preferably it is 0.5–3.0 volt microseconds for good compensation. The product of Vc and tc should be adjusted in accordance with the size and pixel numbers of an LCD panel. Since the distortion of the signal voltage is determined if a load of the signal electrode is known, the voltage distortion due to the switching of the signal voltage is substantially proportional to "A" given by the equation (9).

$$A=(R\text{pix}\times n)\times(C\text{pix}\times n)\times(V2-V4), \tag{9}$$

Using the value of "A", the product of Vc and tc is preferably in the range given by the expression (10), and more preferably by the expression (11).

$$0.04 \times A < Vc \times ct < 0.9 \times A, \quad (10)$$

$$0.09 \times A < Vc \times ct < 0.5 \times A, \quad (11)$$

Figure 16:
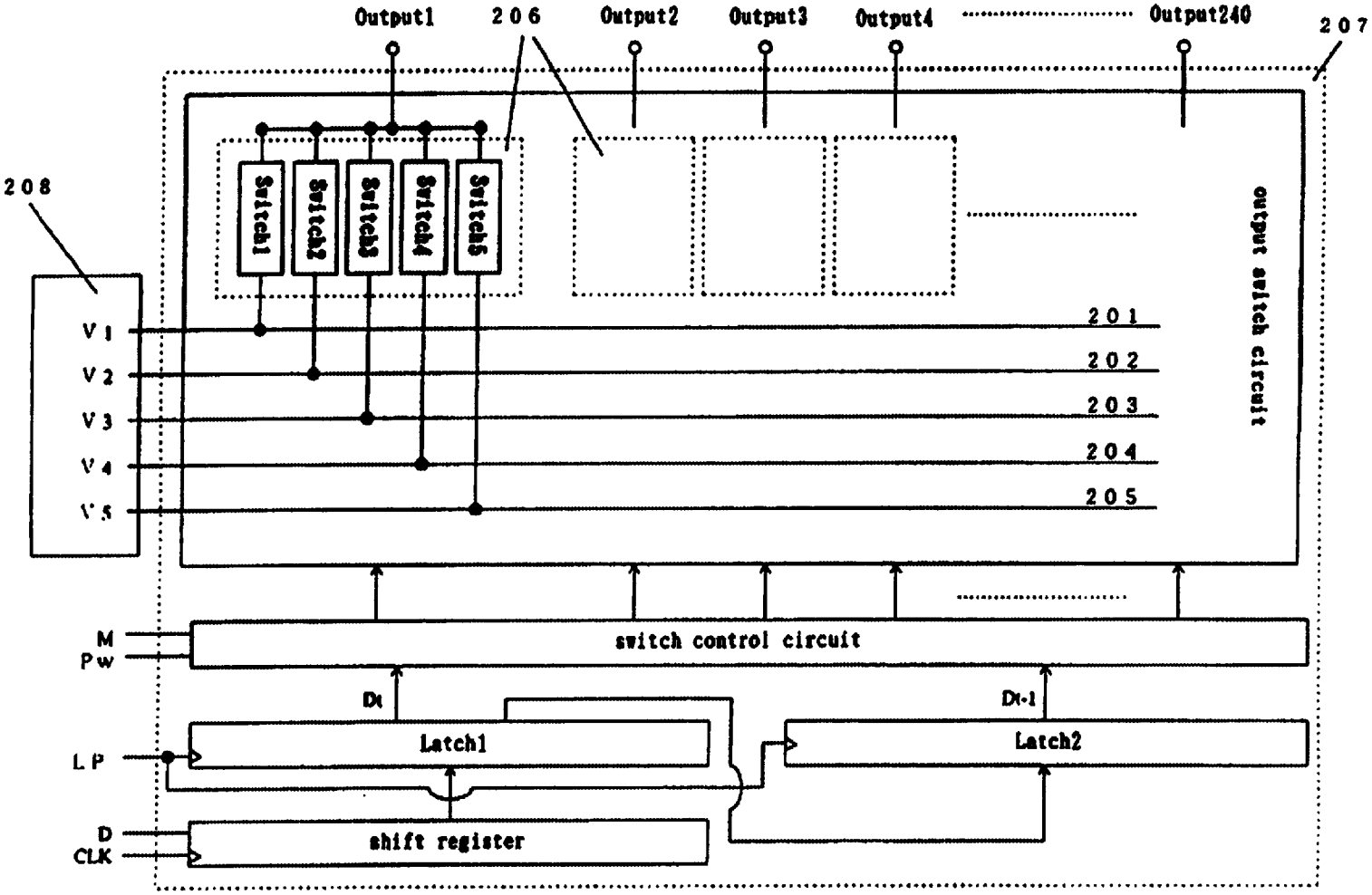
FIG. 16 is a block diagram showing a drive IC and circuit that is used for the drive method shown in FIG. 13.

The waveforms for this embodiment can be generated by the drive IC and circuit shown in FIG. 16. In FIG. 16, the same members as in FIG. 3 of the fifth embodiment are indicated with the same numerals. This embodiment (FIG. 16) is different from FIG. 3 in that there are five voltage levels V1–V5 in the external power source and five bus lines 201–205. V2 and V4 are levels of the data signal voltage, V1 and V5 are levels of the compensating voltage, and V3 is a non-selecting voltage on the scanning electrode. V3 is used if necessary to make the applied voltage to the liquid crystal zero. V3, bus line 203 and Switch 3 connected to V3 can be eliminated to yield the drive IC and circuit shown in FIG. 10.

The operation of the drive IC and circuit is similar to that explained in the second embodiment. The logic table for determining the output is the same as Table 11 explained in the ninth embodiment. The output t is determined according to this logic table.

The switch control circuit controls the switch set 206 according to the above mentioned determination. The drive IC has 240 output terminals, for example. The polarity signal M and the pulse width control signal of the compensating pulse work in the same way as the second embodiment.

In this embodiment, the compensating pulses 131, 132 are added to the signal voltage at the top of the signal voltage when the signal voltage changes its level. However, the compensating pulse can be added anywhere in the horizontal scanning period th with Vc and tc adjusted within the range explained above.

The preferable range of the width tc of the compensating pulse explained in this embodiment is valid for every drive waveform that performs crosstalk compensation by adding a rectangular pulse, for example, the first embodiment (FIG. 1), the fourth embodiment (FIG. 5), the seventh embodiment (FIG. 19), the eighth embodiment (FIG. 8), the tenth embodiment (FIG. 11), and the eleventh embodiment (FIG. 12). By setting the width tc of the compensating pulse at more than one and one half of Bin given by the equation 8 in the above mentioned embodiments, the substantially satisfactory display can be obtained, and the good uniform display can be obtained by setting the width tc at more than four times Bin.

Fifteenth Embodiment

Figure 17:
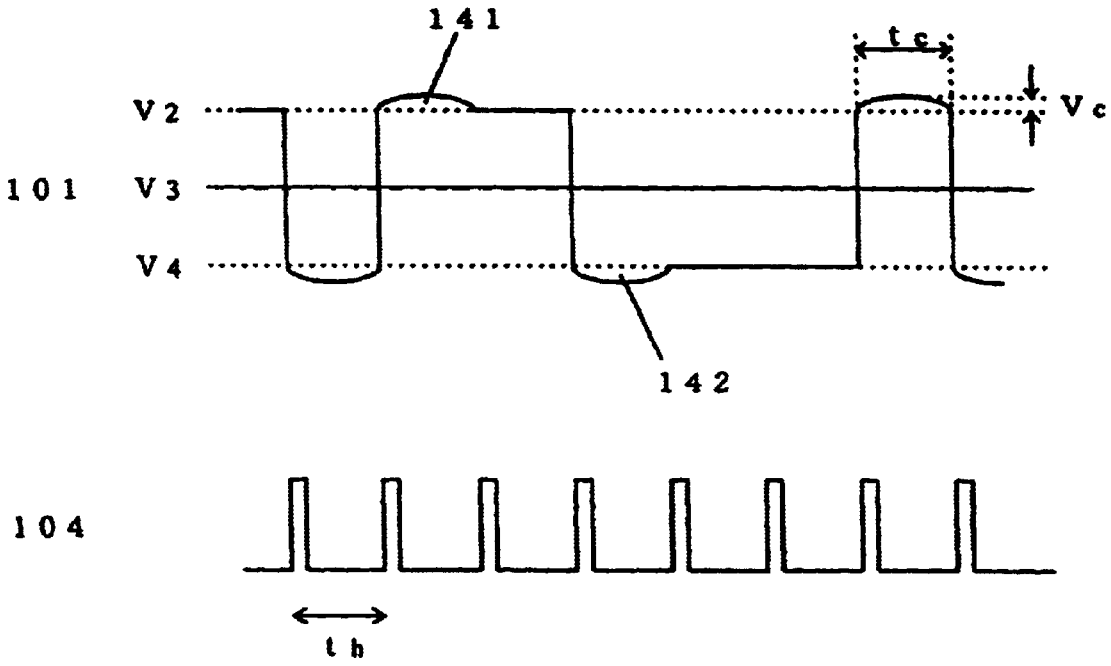
FIG. 17 shows waveforms for a method of driving an LCD according to a fifteenth embodiment of the present invention.

FIG. 17 shows drive waveforms for a method of driving an LCD according to a fifteenth embodiment of the present invention. In this embodiment, the compensation pulses 141, 142 have a shape of a sine wave, though the fourteenth embodiment uses the compensation pulse having the rectangular shape.

The compensation pulses 141, 142 compensate the rms voltage drop of the signal voltage due to the waveform distortion so that an adequate rms voltage is applied to each pixel. This embodiment uses the compensating pulse having a sine wave shape, whose frequency components are lower than that of the compensation pulse having rectangular shape. Therefore, the compensation pulse of this embodiment is hardly distorted or decreased in the LCD panel. As a result, this embodiment is suitable even for a large panel or a high speed panel that has a large CR time constant, and the compensation amount is uniform for the whole LCD panel.

In an example using a 14 inch LCD or a larger LCD (having a diagonal distance more than 35 cm), a good and uniform compensation of crosstalk was performed by using the sine wave compensation pulse, though it is difficult to compensate over the whole screen of such a large LCD panel if the compensating pulse with a rectangular shape is used.

In FIG. 17, the pulse width tc looks equal to the horizontal scanning period th, though they are not required to be equal. It is preferable that the width tc is wide for decreasing the high frequency components, but it is acceptable for use if the width tc is more than one and one half of Bin given by the equation (8). The width tc is preferably more than four times and more preferably eight times Bin.

If the width tc of the compensation pulse is shorter than the horizontal scanning period th, the timing or phase of adding the compensating pulse can be shifted between the pulse added to V2 and the pulse added to V4. Therefore the flexibility of designing the drive IC and external circuit increases. Furthermore, a high accuracy is not required.

The product of the height Vc and the width tc depends on the size, electrode resistance and capacitance of an LCD panel. In an example using a color STN type 10.4 inch 640×480 dots LCD panel whose electrodes have a sheet resistance of 7.5 ohm, and the signal electrode is not divided to the upper and lower parts, the product of Vc and tc shown in FIG. 17 was selected within 0.2–5.0 volt microseconds, preferably 0.5–3.0 volt microseconds.

The product of the pulse height Vc and the width tc can be determined in accordance with the equations (9), (10) and (11) if the condition of the LCD panel is different from the above mentioned condition. The compensation amount of the sine wave pulse is smaller than that of the rectangular pulse when the Vc as well as tc is equal between them. However, the sine wave pulse has little distortion while the rectangular pulse has a substantial distortion, so that the compensation amount may be equal between them.

The drive waveform for this embodiment can be generated by using the drive IC and circuit shown in FIG. 16 (or FIG. 10) of the fourteenth embodiment and setting the proper compensating voltage V1 and V5.

In this embodiment, the compensating pulse has a shape of a sine wave. However, the compensating pulse may have a triangle or arc shape instead of the sine wave, whose frequency components are low compared with a rectangular wave.

Figure 18:
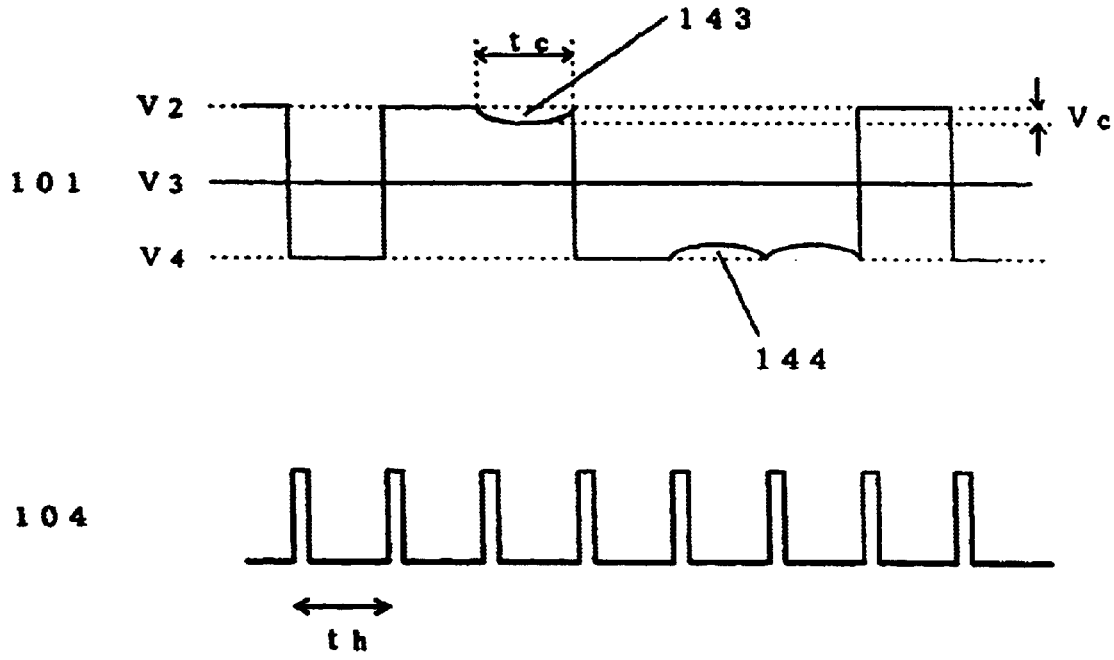
FIG. 18 shows waveforms for a variation of the drive method shown in FIG. 17.

Moreover, the compensating pulse is added for increasing the rms voltage when the data signal changes its level in this embodiment. However, even if the compensating pulses 143, 144 are added for decreasing the rms voltage when the data signal maintains its level as shown in FIG. 18, the compensating pulse having lower frequency components than the rectangular wave may improve the compensation effect uniformly.

Sixteenth Embodiment

Figure 20:
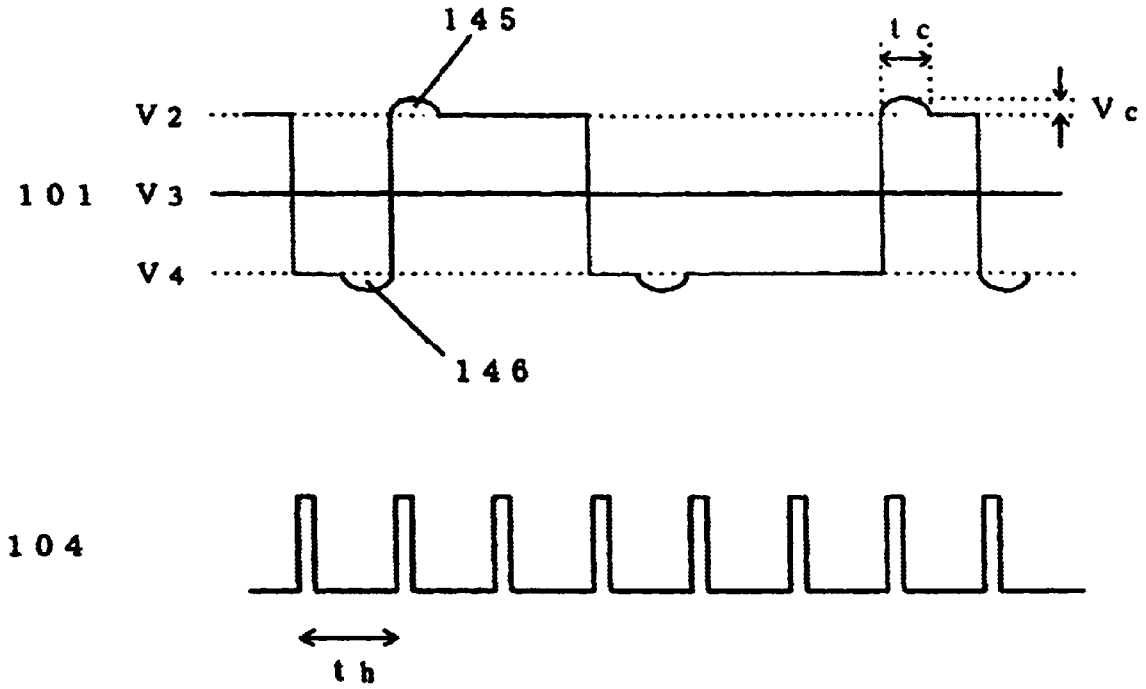
FIG. 20 shows waveforms for a method of driving an LCD according to a sixteenth embodiment of the present invention.

FIG. 20 shows drive waveforms for a method of driving an LCD according to a sixteenth embodiment of the present invention. This embodiment uses the compensating pulses 145, 146 having a shape of a sine wave in the drive method explained in the seventh embodiment.

In this embodiment, the compensating pulse 145 is added to V2 in the first half of the horizontal scanning period th, and the compensating pulse 146 is added to V4 in the second half of the horizontal scanning period th, so that the two compensation pulses are never output simultaneously, even taking plural signal electrodes into account. Therefore, only three voltage levels are required for the drive IC, so that the drive IC and circuit can be simplified and the compensation amounts can be adjusted easily between the positive and negative compensating pulses as mentioned in the seventh embodiment.

This embodiment uses the compensating pulse having a sine wave shape, whose frequency components are lower than that of the compensation pulse having rectangular shape. Therefore, as mentioned in the fifteenth embodiment, this embodiment is suitable even for a large panel or a high speed panel that has a large CR time constant, and the compensation amount is uniform for the whole LCD panel. Thus, in an example using a 14 inch LCD or a larger LCD (having a diagonal distance more than 35 cm), a good and uniform display could be obtained easily without a substantial reduction of the CR time constant by lowering the electrode resistance, etc.

The product of the height Vc and the width tc may be set as mentioned in the fifteenth embodiment.

In this embodiment, the compensating pulse has a shape of a sine wave. However, the compensating pulse may have a triangle or arc shape instead of the sine wave, whose frequency components are low compared with a rectangular wave.

In this embodiment, the compensating pulse is added for increasing the rms voltage when the data signal changes its level in this embodiment. However, even if the compensating pulses are added for decreasing the rms voltage when the data signal maintains its level as show in FIG. 21, the compensating pulse having lower frequency components than the rectangular wave may improve the compensation effect uniformly.

In this embodiment, the positive and negative compensating pulses are added at the different timing in the horizontal period. However, the condition for adding the compensating pulse can be fixed according to the first or fourth embodiment. In this case too, the positive and negative compensation pulses are never output simultaneously.

Seventeenth Embodiment

Figure 22:
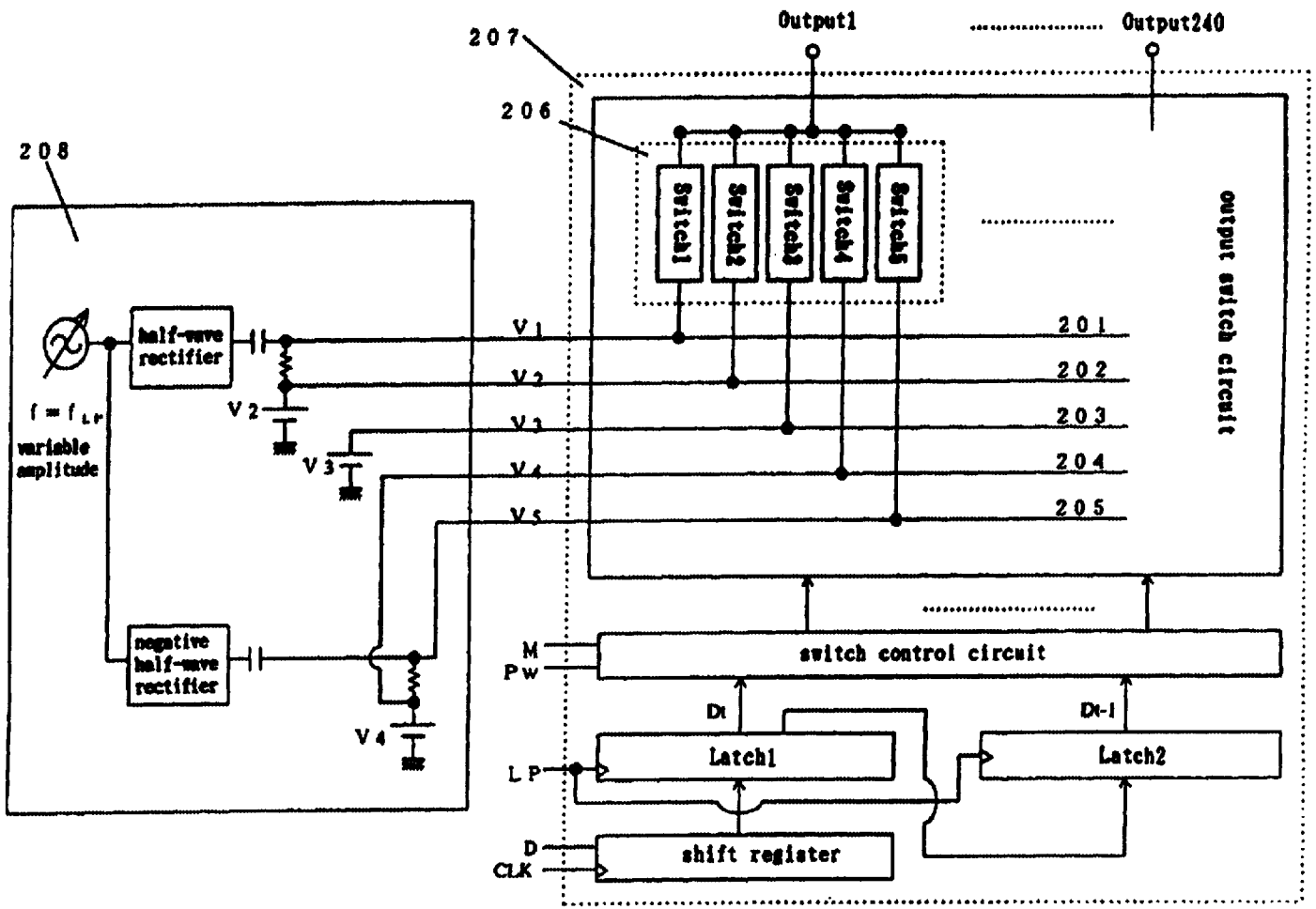
FIG. 22 is a block diagram showing a drive IC and circuit for an LCD according to a seventeenth embodiment of the present invention.
Figure 23:
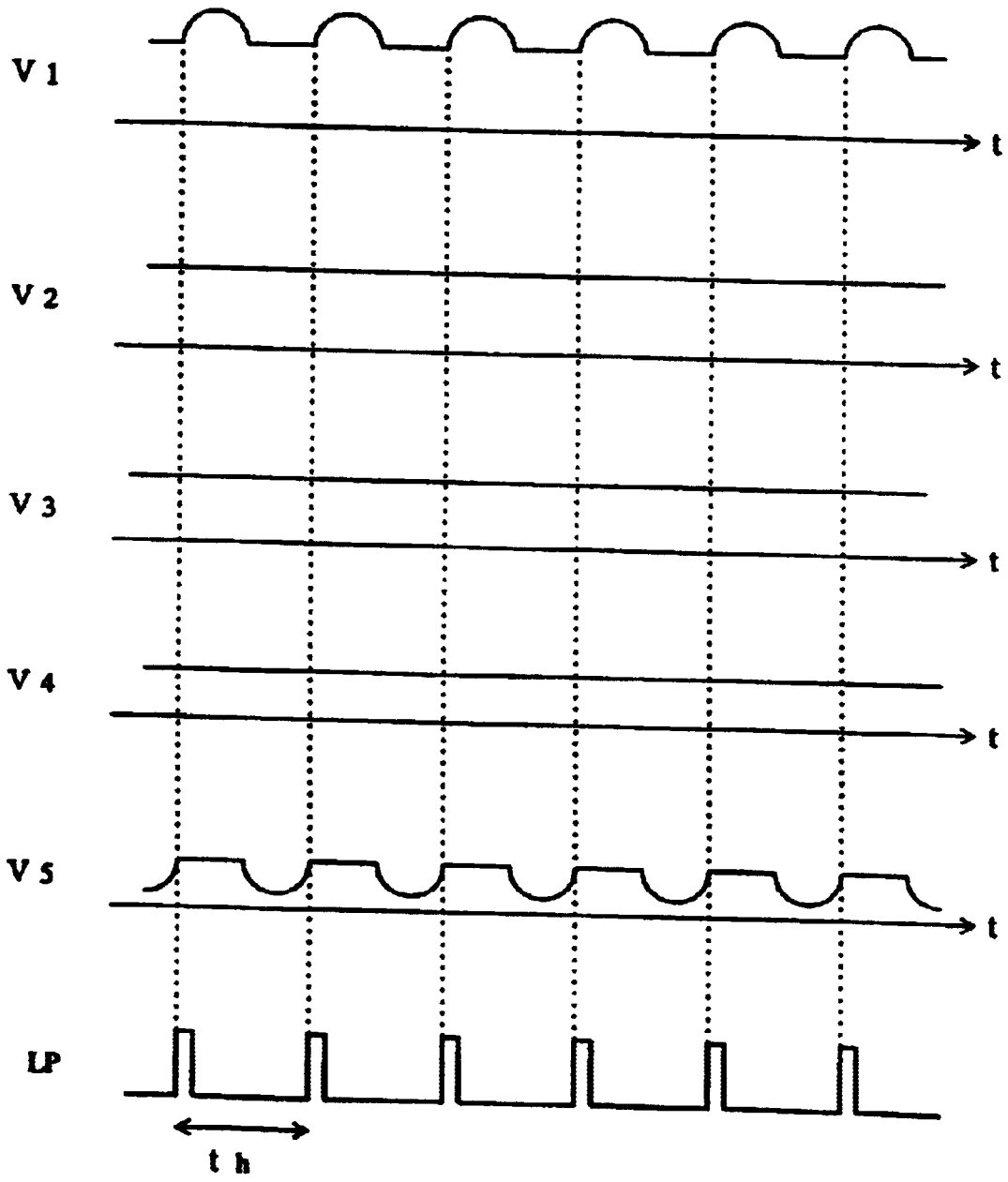
FIG. 23 shows waveforms for explaining an operation of the drive circuit shown in FIG. 22.

FIG. 22 shows a block diagram of a drive IC and circuit for an LCD according to a seventeenth embodiment of the present invention. The drive IC generates drive waveforms shown in FIG. 20. In FIG. 22, the same members as in FIG. 16 of the fourteenth embodiment are indicated with the same numerals. This embodiment uses an external power source 208 that is different from that in FIG. 16. The external power source in FIG. 22 uses a signal source generating a sine wave and a half-wave rectifier. Thus, V1 includes a dc level V2 and a half wave added on V2, while V5 includes a dc level V4 and a half wave subtracted from V4. FIG. 23 shows these waveforms. As shown in the Figure, the sine waves added on V1 and subtracted from V5 are phase-shifted by 180 degrees with respect to a latch pulse LP. The output waveform to the LCD panel is shown in FIG. 20. The half wave pulse for compensating the rms voltage is added in the second half of the horizontal scanning period th when the output level changes from V2 to V4, while the half wave pulse is added in the first half of the horizontal scanning period th when the output level changes from V4 to V2

The operation of the switch control circuit is the same as the fourteenth embodiment, and the output signal for each output line is determined according to Table 11.

Figure 24:
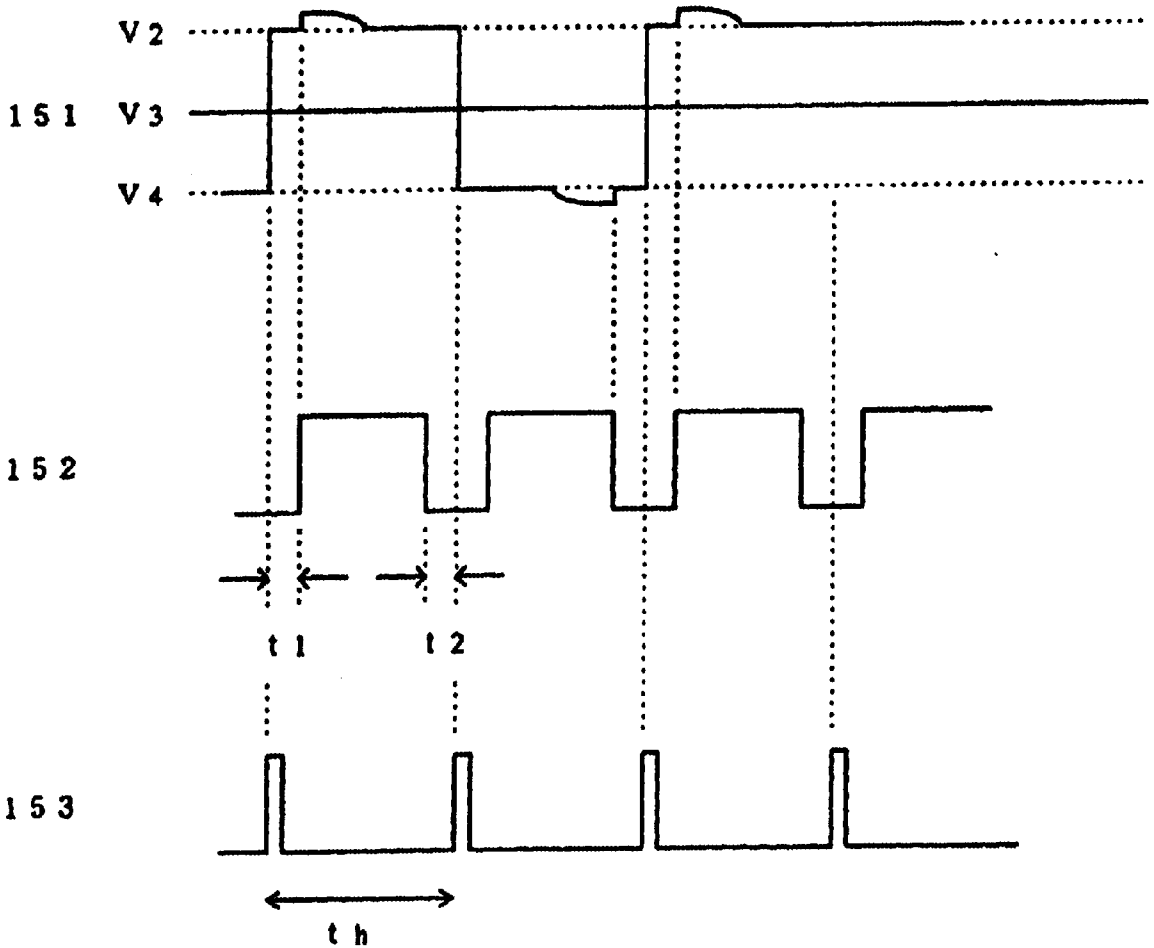
FIG. 24 shows waveforms for a variation of the drive method shown in FIG. 22.

In this embodiment, the half wave pulse can be suppressed in part using Pw for adjusting the compensation characteristics between V1 and V5. FIG. 24 shows an example, where 151 is the output of the drive IC, 152 is the Pw signal, and 153 is the latch pulse. The Pw signal is low during the start period t1 and the end period t2, and high during other period of the horizontal scanning period. In the logic condition where V1 is output, if Pw becomes low, then the output becomes V2. Therefore, when the output waveform rises in FIG. 24, V2 is output for the period t1 at the start edge of the half wave, then Pw changes to high-level and the compensating voltage V1 is output. Thus the start portion of the half wave is cut for the period t2. In the period t2, V1 has a level equal to V2, so there is no influence of Pw being low. Similarly, when the output waveform falls, an end portion of the half wave is cut for a period t2 since the output is changed from V5 to V4 for the period t2. There is no influence of Pw being low since the V5 is equal to V4 for the period t1. It may be possible that a part of the half wave for either V1 or V2 is cut, and that an other part (not the start or end portion) of the half wave is cut.

In an example, a STN type LCD was made for 800×600 dots color display using the above explained IC as a signal drive IC and a normal drive IC as a scanning drive IC. As a result, a very good display was obtained that scarcely had crosstalk. The period of polarity change was set equal to one vertical scanning period (frame period) in this example.

In FIG. 22, the half-wave rectifier and the negative-phase half-wave rectifier can be exchanged. In this case, the waveform shown in FIG. 21 can be obtained in accordance with Table 13.

TABLE 13

| $D_{t-1}$ | $D_t$ | M | $P_w$ | output t |
|---|---|---|---|---|
| * | L | L | L | V2 |
| * | H | L | L | V4 |
| * | L | H | L | V4 |
| * | H | H | L | V2 |
| L | L | L | H | V1 |
| H | L | L | H | V2 |
| L | H | L | H | V4 |
| H | H | L | H | V5 |
| L | L | H | H | V5 |
| H | L | H | H | V4 |
| L | H | H | H | V2 |
| H | H | H | H | V1 |

*: L or H

This circuit can be replaced with another kind of signal generator so that the compensating pulse has another shape such as the fifteenth embodiment. For example, the compensating pulse can be formed by a triangle wave instead of the sine wave if the half-wave rectifier is replaced with a generator of the triangle wave.

In FIG. 22, V3 is the non-selecting level of the scanning voltage, and is not output in the normal driving. Therefore, V3, the switch and the bus line 203 connected to V3 can be eliminated.

Eighteenth Embodiment

Figure 25:
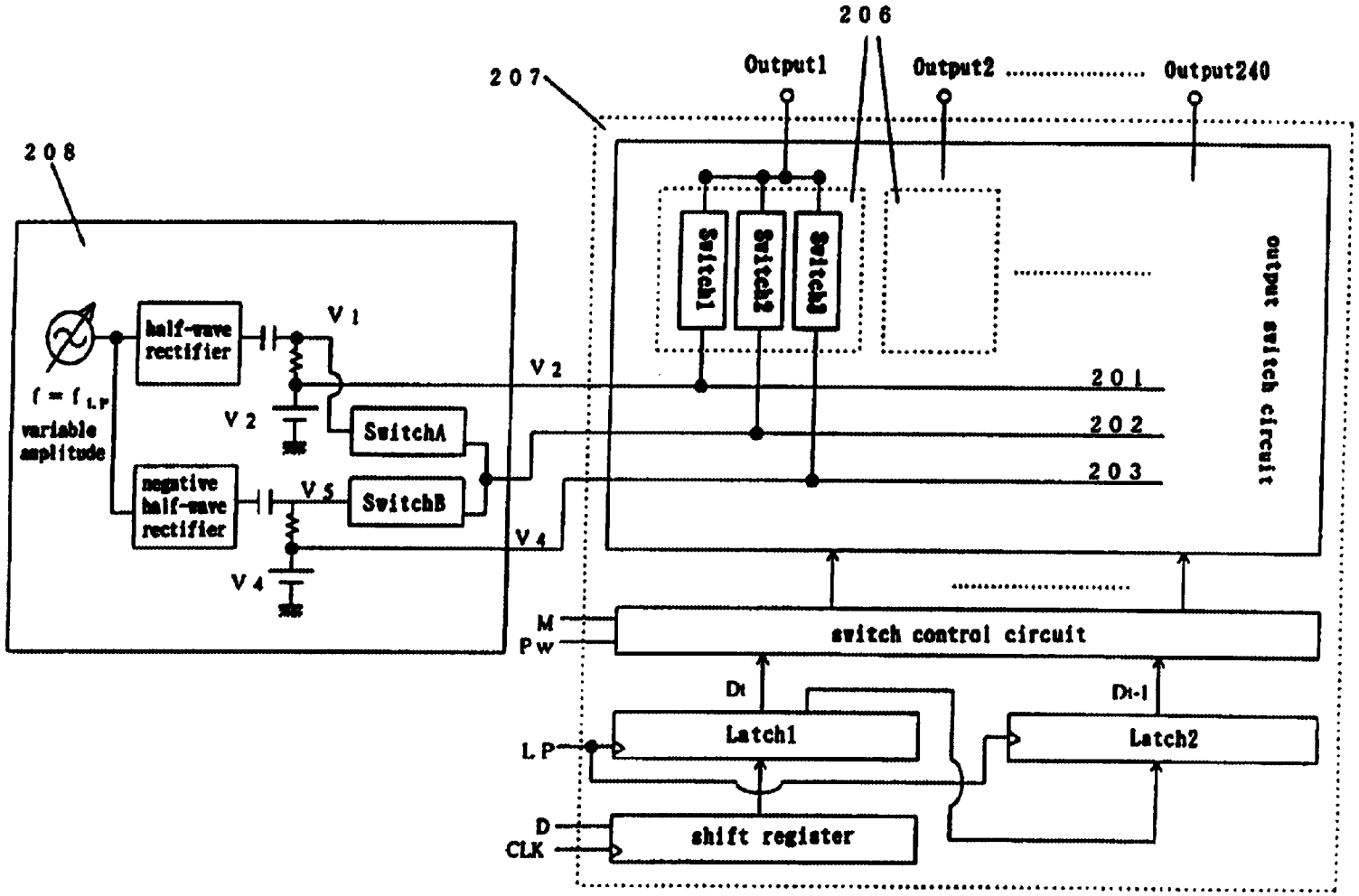
FIG. 25 is a block diagram showing a drive IC and circuit for an LCD according to an eighteenth embodiment of the present invention.
Figure 26:
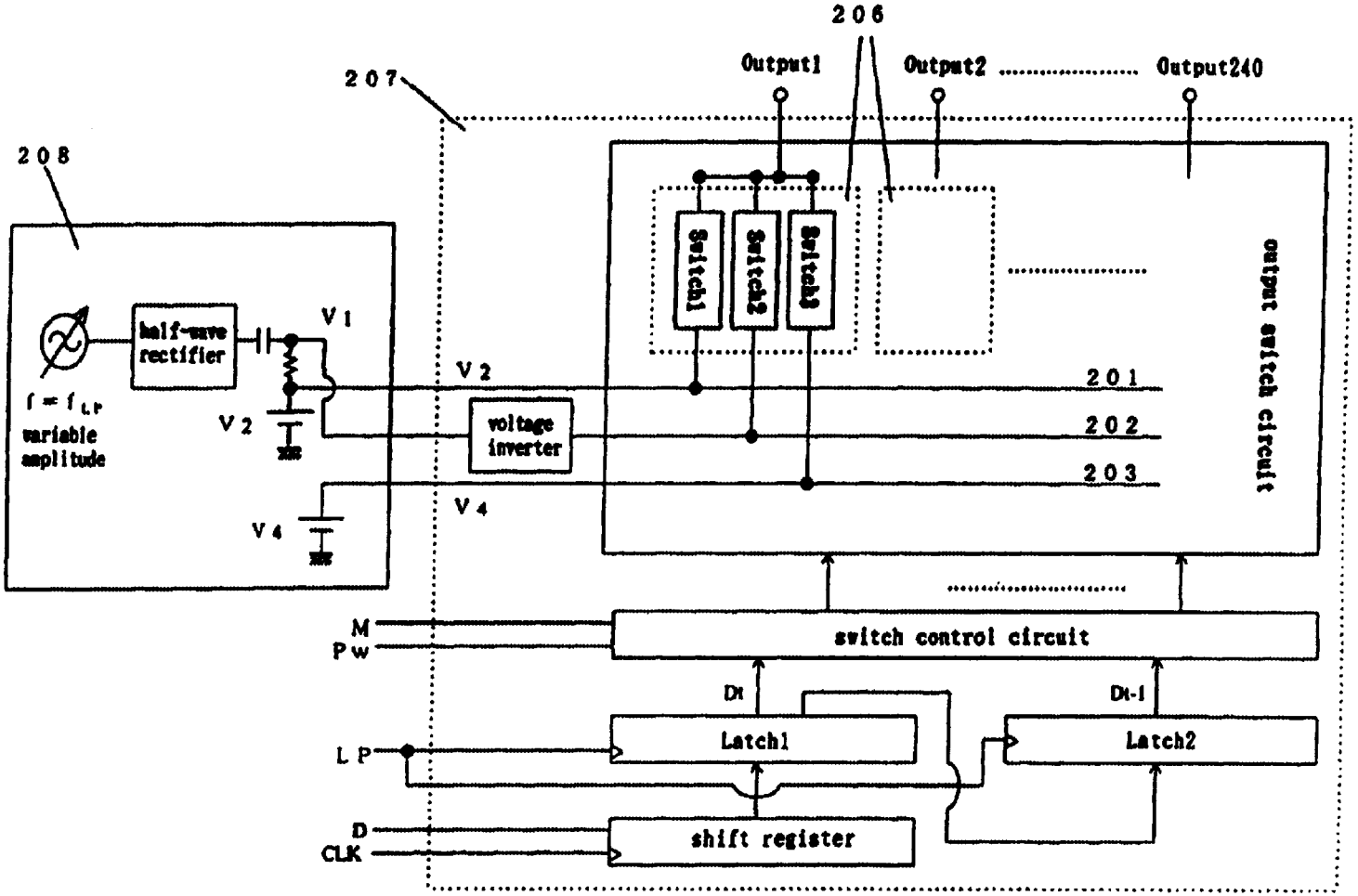
FIG. 26 is a block diagram showing a variation of the drive IC and circuit shown in FIG. 25.

FIGS. 25 and 26 show block diagrams of a drive IC and circuit for an LCD according to an eighteenth embodiment of the present invention. In this drive IC and circuit, the bus line 202 is shared by two compensating voltage levels for generating the drive waveforms shown in FIG. 20.

The bus line 202 is supplied with V1 in the first half of the horizontal period th, and is supplied with V5 in the second half. For this purpose, the voltage level is switched using an external switch in FIG. 25, and is switched by the inverter circuit in the drive IC in FIG. 26. Two logic tables are provided for the first and second halves of the horizontal scanning period th. Thus, the voltage level on the bus line 202 is output through the switch set 206 in the first half of the horizontal scanning period th when the signal voltage changes from V4 to V2 and in the second half of the horizontal scanning period th when the signal voltage changes from V2 to V4.

By using the drive IC and circuit of this embodiment, in the same way as the second or third embodiment, crosstalk can be compensated properly in spite of the use of only three bus lines and three switches for one output in the drive IC. Therefore, the chip area can be reduced by 10–20% compared with the conventional drive IC. Thus, the area of the periphery of the LCD panel can be reduced so that the LCD can be compacted and reduced in cost. In addition, using the compensating pulse having a sine wave shape in the same way as the seventeenth embodiment, a uniform display can be obtained even in a large LCD panel.

Figure 21:
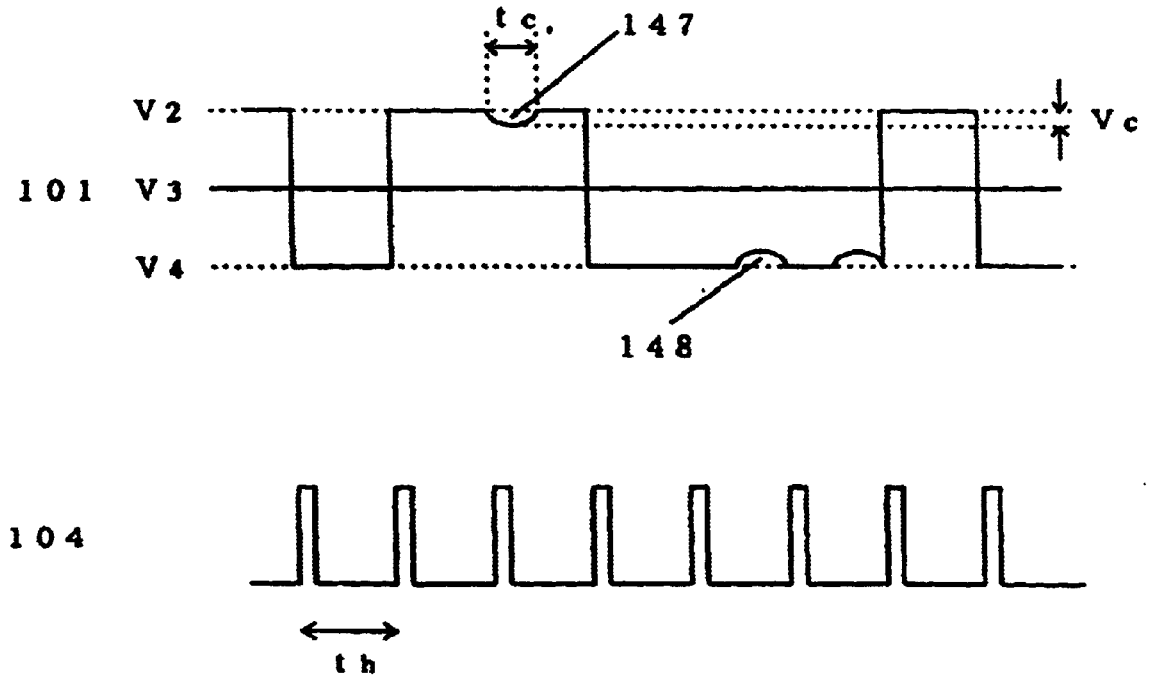
FIG. 21 shows waveforms for a variation of the drive method shown in FIG. 20.

In FIG. 25 or 26, the half-wave rectifier and the negative-phase half-wave rectifier can be exchanged and the waveform shown in FIG. 21 can be obtained using a revised logic table. This circuit can be replaced with another kind of signal generator. For example, the compensating pulse can be formed by a triangle wave instead of the sine wave if the half-wave rectifier is replaced with a generator of the triangle wave.

Nineteenth Embodiment

Figure 42:
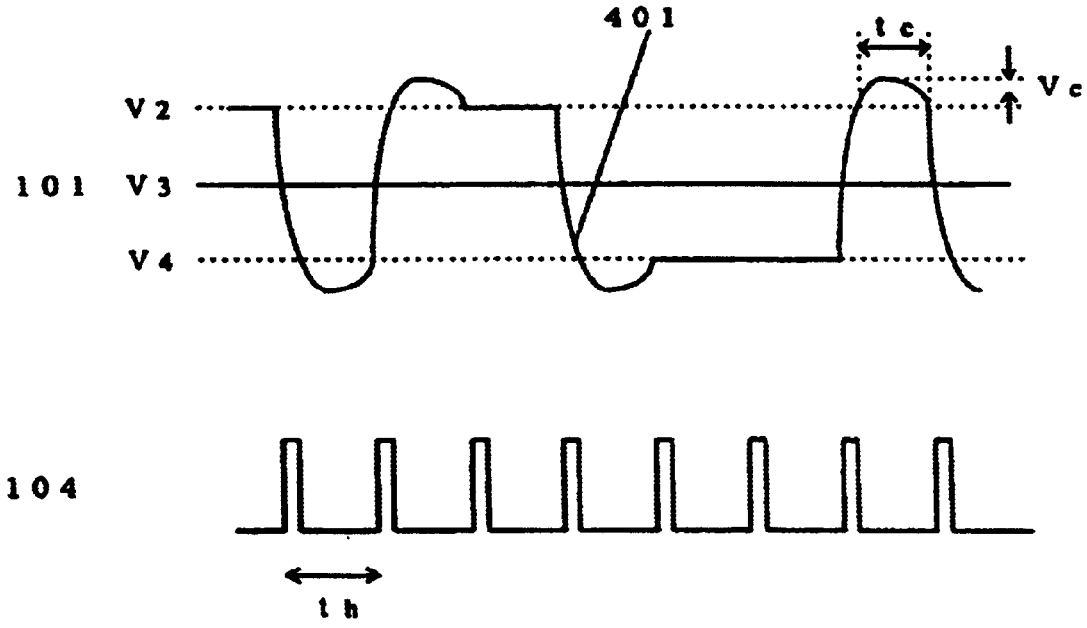
FIG. 42 shows waveforms for a method of driving an LCD according to a nineteenth embodiment of the present invention.

FIG. 42 shows drive waveforms for a method of driving an LCD according to a nineteenth embodiment of the present invention. This embodiment improves the drive method of the fifteenth embodiment. In this embodiment, the rising and falling edge of the data signal is smoothed to drop frequency components of the data signal waveform.

The rms voltage of the data signal 401 with the compensating pulse decreases at the rising and falling edge in this embodiment, too. However, the waveform portion that exceeds V2 or V4 compensates the decrease of the rms voltage. Thus, the actual rms voltage applied to each pixel is adjusted to the same value as that of the waveform portion having no level change.

The rising and falling edges of the data signal wave form in this embodiment are smoothed compared with the fifteenth embodiment, the compensating pulse as well as the data signal voltage itself is hardly distorted in the LCD panel. Therefore, this embodiment is suitable even for a large panel or a high speed panel that has a large CR time constant, and the voltage level supplied to each pixel is uniform for the whole LCD panel. For example, using a 14 inch LCD or a larger LCD (having a diagonal dimension more than 35 cm), a good and uniform display was obtained easily even though the scan and signal voltages are supplied from one side.

The height Vc and the width tc of this embodiment should be set larger than that of the foregoing embodiment.

Twentieth Embodiment

Figure 27:
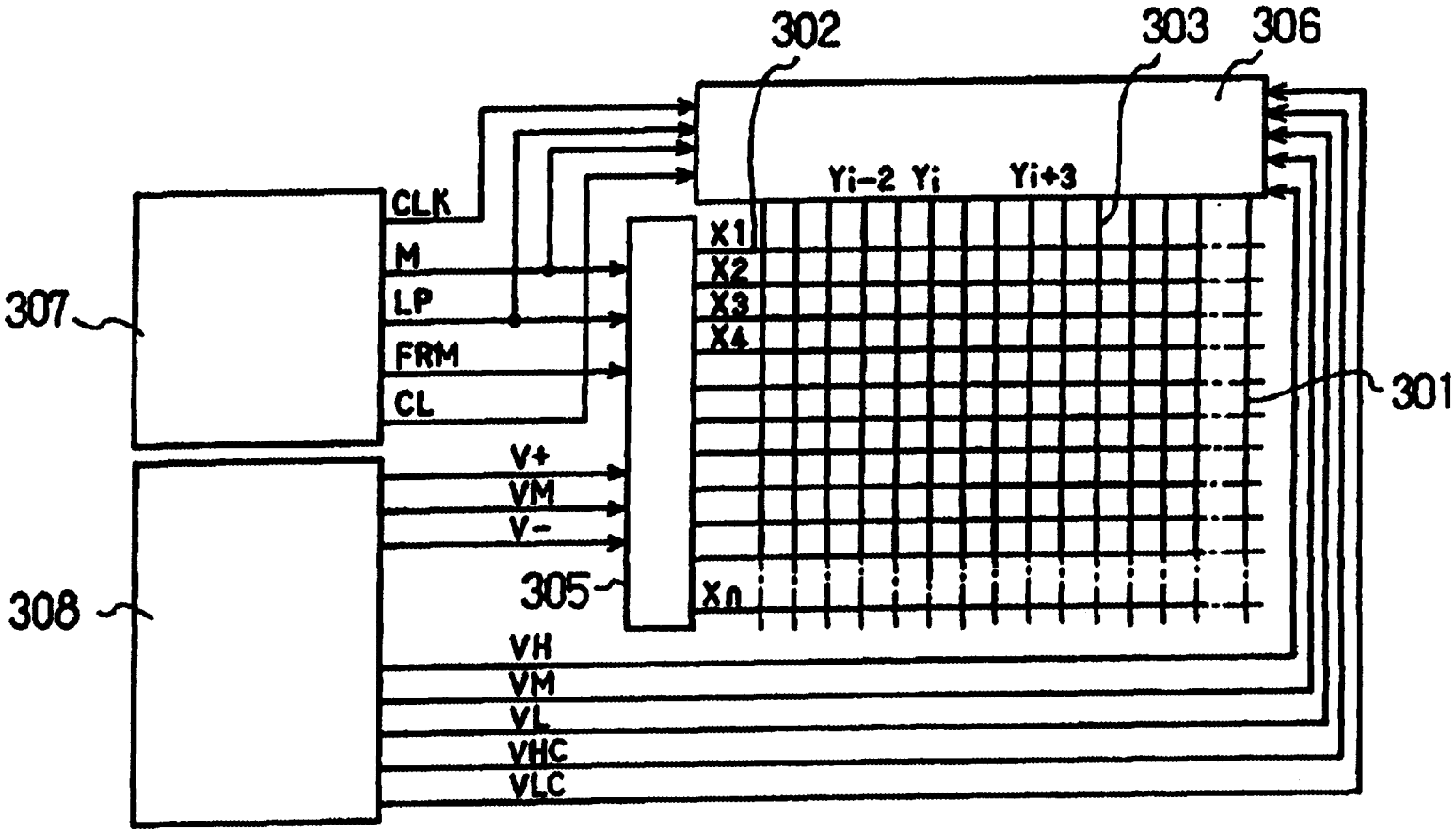
FIG. 27 is a block diagram of an LCD for explaining a drive method according to a twentieth embodiment of the present invention.

FIG. 27 shows a block diagram of an LCD according to the twentieth embodiment of the present invention. In the FIGURE, 301 is an LCD panel comprising plural scanning electrodes 302 (X1, X2, X3, . . . , Xn) and plural signal electrodes 303 (Y1, Y2, Y3 . . . , Yn) arranged in a matrix, and a liquid crystal layer disposed between the electrodes. Numeral 305 is a scanning drive circuit connected to the scanning electrodes 302, and 306 is a signal drive circuit connected to the signal electrodes. Numeral 307 is a control circuit for controlling the signal drive circuit.

The scanning drive circuit 305 is supplied with a horizontal synchronizing signal LP, scan start signal FRM and alternating signal (plarity signal) M from the control circuit 307. The signal drive circuit 306 is supplied with display data, data shift clock CLK, data latch pulse (same as the horizontal synchronizing signal) LP and the alternating signal M. As explained in the above embodiment, the signal drive circuit outputs the compensating pulse added to the data signal voltage for crosstalk compensation. A CL signal is a control pulse for controlling the height and width of the compensating pulse.

Numeral 308 is a drive power source circuit for generating a predetermined voltage for driving an LCD panel. The positive and negative scanning voltage V+, V− and non-selecting level VM are supplied to the scanning drive circuit 305. The data signal voltage VH, VL corresponding to on/off of the display data, and the compensating voltage VHC, VLC are supplied to the signal drive circuit 306.

Figure 28:
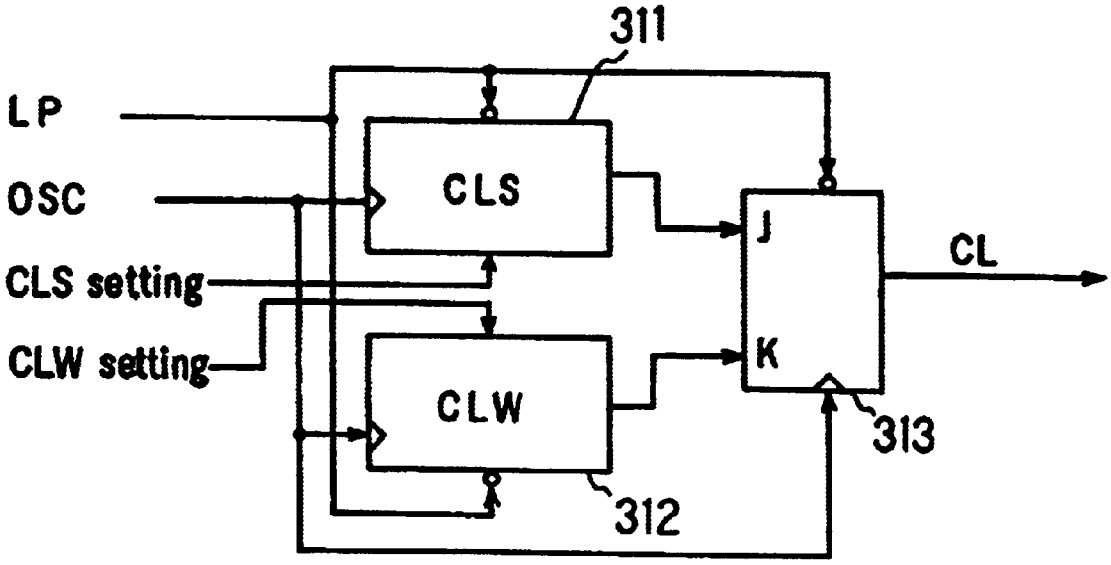
FIG. 28 shows a circuit for generating the compensating pulse control signal of the LCD shown in FIG. 27.

FIG. 28 shows a part of the control circuit, which generates the compensating pulse control signal. Numeral 311 and 312 are counter circuit counting the external clock OSC. Numeral 313 is a JK flip-flop (JKFF), whose set input is connected to the output of the counter circuit 311, and reset input is connected to the output of the counter circuit 312.

A CLS setting terminal is connected to the counter circuit 311 for counting the time from the rising or falling edge of the latch pulse LP until the compensating pulse control signal becomes high. A CLW setting terminal is connected to the counter circuit 312 for determining a pulse width of the compensating pulse control circuit. Clock terminals of the counter circuit 311 and 312 are connected to the external clock OSC, and reset inputs of the counter circuit 311 and 312 are connected to the latch pulse LP.

Figure 29:
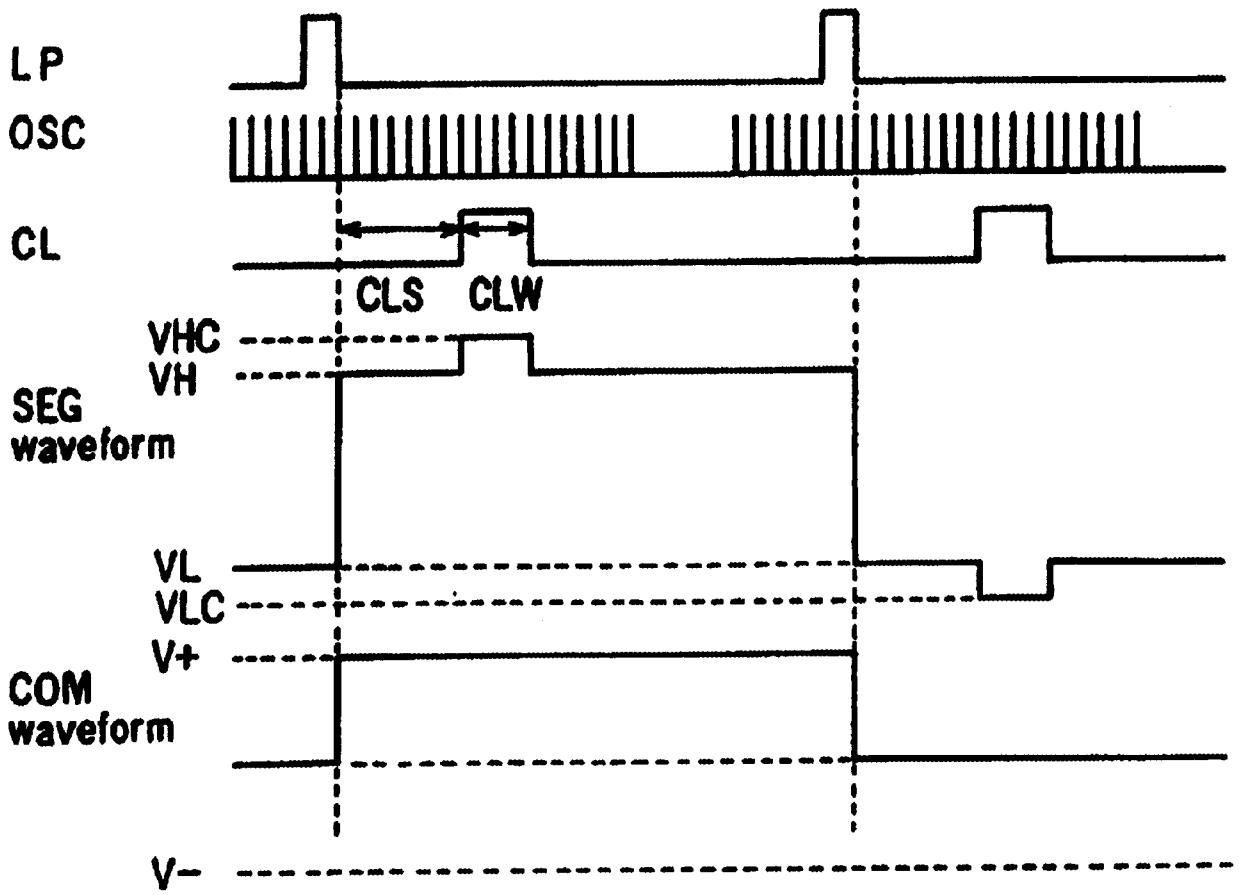
FIG. 29 shows waveforms for explaining an operation of the compensating pulse control signal generating circuit shown in FIG. 28.

FIG. 29 shows a timing chart of the circuit shown in FIG. 28. The latch pulse LP is generated once every horizontal scanning period. For example, a STN type LCD having 1/300 duty factor generates 300 latch pulses per one frame. OSC is a signal supplied from the outside and generated by a resonator of several MHz for example. CL is the compensating pulse control signal generated by the control circuit 307 in FIG. 27. SEG waveform is a voltage (data signal voltage) supplied from the signal drive circuit to the LCD panel. COM waveform is a voltage (scanning voltage) supplied from the scanning drive circuit to the LCD panel. Each pixel of the LCD panel is a crossing of the signal and scanning electrodes, so the voltage corresponding to a difference between the SEG waveform and the COM waveform is applied to the pixel.

Synchronizing with the rising or falling edge of the latch pulse LP, the counter circuit 311s start counting the external clock OSC. When the count value of the counter circuit 311 reaches the value that was set with the CLS setting terminal, the set input signal is supplied to the JKFF 313 and the compensating pulse control signal becomes high. At the same time, the counter circuit 312 starts counting the external clock OSC. When the count value of the counter circuit 312 reaches the value that was set with the CLW setting terminal, the reset input signal is supplied to the JKFF 313 and the compensating pulse control signal becomes low. Thus, the output of the JKFF 313, i.e., the compensating pulse control signal CL is high only for the period that was set with CLS setting terminal and CLW setting terminal.

The signal drive circuit 306 outputs the compensating pulse while the compensating pulse control signal CL is high if the display data satisfy a predetermined condition during the two consecutive horizontal scanning periods, in accordance with the logic table explained before. In FIG. 29, SEG waveform is VHC or VLC level while CL is high.

As explained above, the drive method of this embodiment uses the external clock, two counter circuits counting the external clock, and JKFF whose inputs are connected to the outputs of the two counter circuits, so that the compensating pulse control signal can be generated easily for changing the timing and the width of the compensating pulse. Thus, the rms voltage of the compensating pulse can be optimized in an LCD panel having a different capacitance, electrode resistance or other material characteristics, or drive duty factor. As a result, the crosstalk can be eliminated or reduced effectively.

In addition, by using the externally set clock (OSC) for the counter, compared with the case using a data shift clock CLK for the counter, the compensation property is hardly influenced by a difference in the VGA chip, frame frequency or other conditions for driving the LCD panel. Thus, the crosstalk is compensated independently from the conditions of the equipment connected to the LCD panel.

The circuit for generating the compensating pulse control signal may have a configuration other than the above mentioned configuration including two counter circuits and a JKFF. This circuit should be capable of adjusting the timing and width of the compensating pulse control signal CL using an external clock.

This embodiment can be combined with foregoing embodiments. For example, the drive method using a compensating pulse having a sine wave shape, or the method where the compensating pulse is added when the data signal maintains its level.

Twenty-First Embodiment

Figure 30:
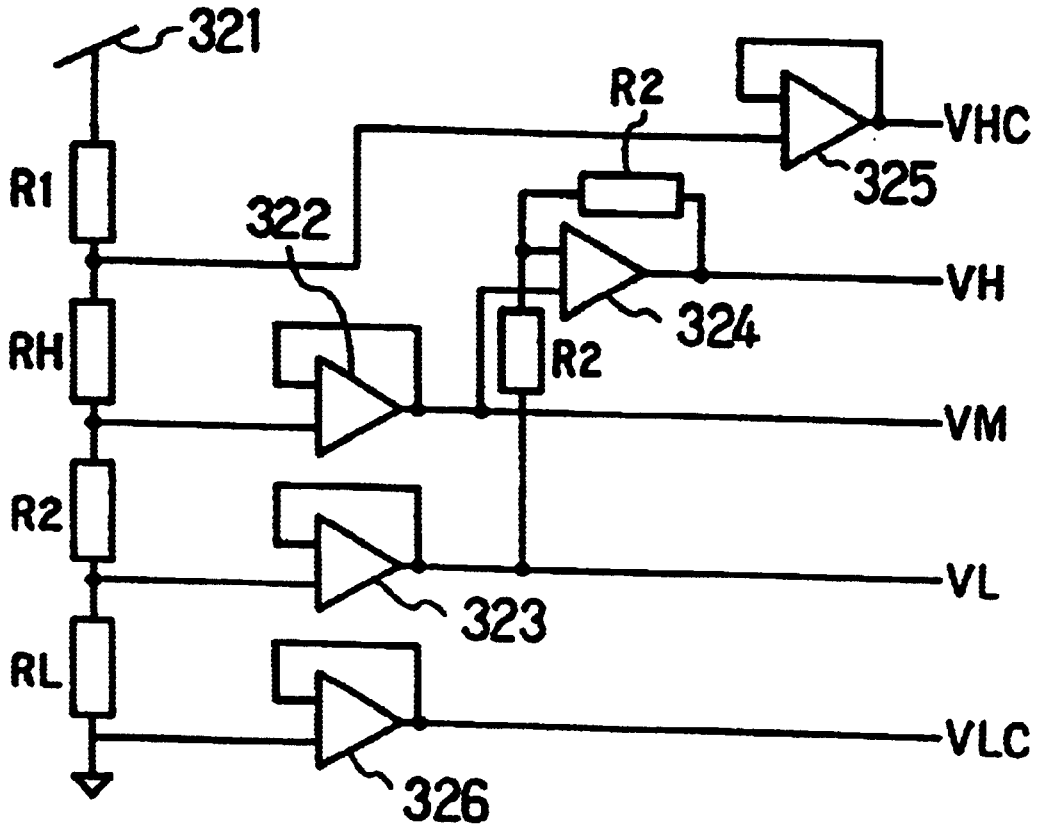
FIG. 30 shows a drive power source circuit of an LCD according to a twenty-first embodiment of the present invention.

FIG. 30 shows a circuit to supply a driving power in the LCD, according to a twenty-first embodiment of the present invention. R1 and R2 are bias resistors making a bias circuit for driving the LCD. The ratio of R1 and R2 corresponds to a bias ratio, i.e., a ratio of the scanning voltage and signal voltage. RH and RL, which are connected to the bias resistors in series, are variable resistors for generating the compensating voltage VHC and VLC that is added to the signal voltage.

A voltage of 20–30 volts is applied to the power terminal 321. This voltage is divided by the resistors R1, RH, R2 and RL. The non-selecting level VM of the scanning and signal voltages is obtained between RH and R2 via a buffer 322. The negative level VL of the signal voltage is obtained between R2 and RL via a buffer 323. An operational amplifier 324 inverts VL with respect to VM and makes another level VH of the signal voltage. The compensating voltages VHC and VLC are obtained from the upper side of the resistor RH and the lower side of the resister RL via buffers 325 and 326.

Since RH and RL are both variable resistors, two compensating voltage levels can be adjusted independently for varying the height of the compensating pulse to minimize the crosstalk, or for adjusting the compensating amount to balance between the positive and negative pulses. Thus, the dc component and/or the flicker is eliminated. However, if one of RH and RL is variable, the flicker can be eliminated substantially and the crosstalk can be reduced but cannot be eliminated completely.

In addition, since RH and RL are connected to the bias circuit in series, when the drive voltage is varied for adjusting contrast, for example, the compensating voltage also varies following the LCD drive voltage. Thus, the crosstalk compensation can be performed effectively. If the R1 is replaced with a resistor having a different resistance for changing the display properties in the manufacturing process or installing process for example, the compensating condition is maintained since the compensating voltage levels alter with regard to VH or VL.

As explained above, according to this embodiment, the crosstalk compensating voltage levels are generated from the scanning and signal voltage levels using the dividing resistors, so that the crosstalk can be compensated adequately.

By using the circuit of this embodiment, the compensating voltage levels can follow the varying LCD drive voltage or the bias ratio, and the compensating condition is maintained adequately in spite of the varying drive condition.

The effect of this embodiment is the same if the compensating pulse is added for decreasing the rms voltage of the data signal when the data signal maintains the same level.

Twenty-Second Embodiment

Figure 31:
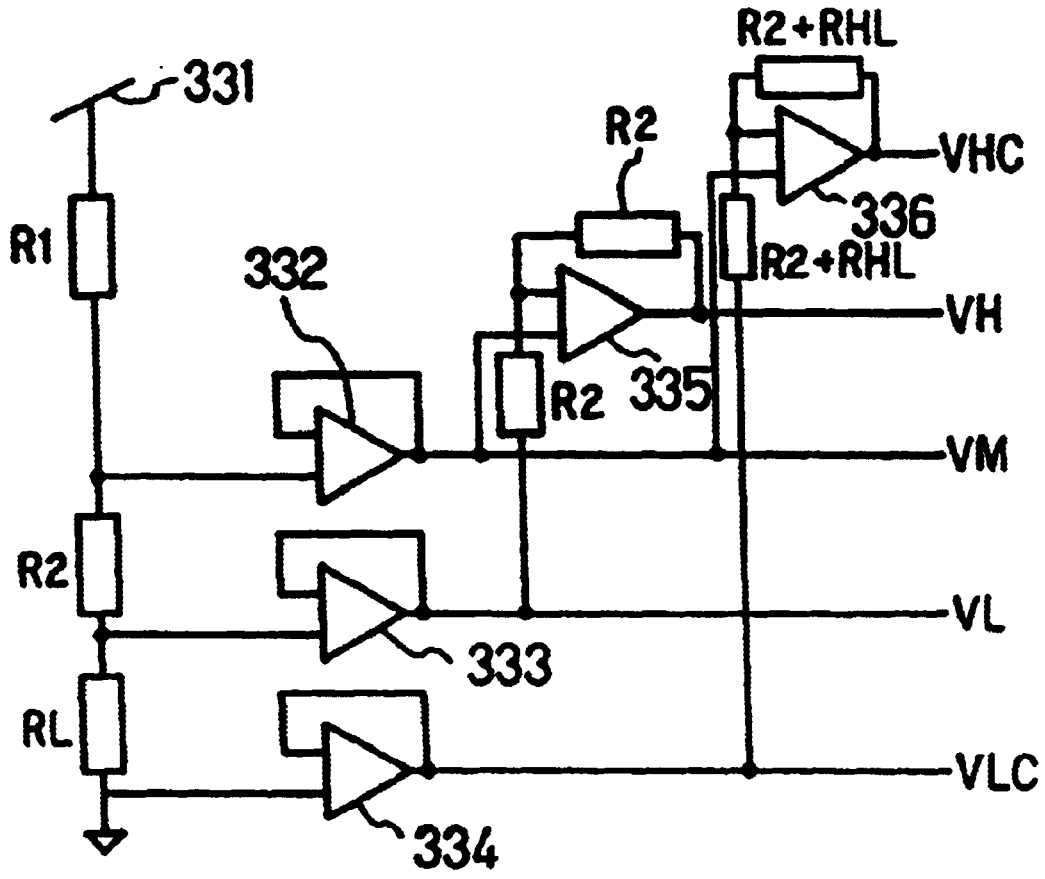
FIG. 31 shows a drive power source circuit of an LCD according to a twenty-second embodiment of the present invention.

FIG. 31 shows a circuit for supplying a driving power in the LCD, according to a twenty-second embodiment of the present invention. The circuit of this embodiment, which is different from the twenty-first embodiment, has only one variable resistor RHL for adjusting the compensating voltage level. RHL is connected to the bias circuit in series.

A voltage of 20–30 volts is applied to the power terminal 331. This voltage is divided by the resistors R1, R2 and RL. The non-selecting level VM of the scanning and signal voltages is obtained between R1 and R2 via a buffer 332. VM is dropped by a resistor R2 and the negative level VL of the signal voltage is obtained via a buffer 333. This level VL is further dropped by RHL and the negative level VLC of the compensating voltage is obtained via a buffer 334.

Two other levels are generated by operational amplifier circuits. The operational amplifier circuit 335 inverts VL with respect to VM and generates another level VH of the signal voltage. The operational amplifier circuit 336 inverts VLC with respect to VM and generates positive level VHC of the compensating voltage.

Since RHL is a variable resistor, two compensating voltage levels VHC, VLC can be adjusted for varying the height of the compensating pulse to minimize the crosstalk.

In this embodiment, two compensating voltage levels vary together. Therefore, if the balance between the positive and negative compensating amount is already adjusted, the balance is maintained when the VHL is varied for adjusting the height of the compensating pulse. The balance can be preadjusted by varying the resistance of the operational amplifier circuit 336.

Since RHL is connected to the bias circuit in series, the crosstalk compensation can be performed effectively as explained in the twenty-first embodiment if the power supply voltage or the bias ratio is changed.

As explained above, according to this embodiment, the crosstalk compensating voltage levels are generated from the scanning and signal voltage levels using the dividing resistors including a variable resistor, so that the crosstalk can be compensated adequately.

By using the circuit of this embodiment, the compensating voltage levels can follow the varying LCD drive voltage or the bias ratio, and the compensating condition is maintained in an adequate condition in spite of the varying drive condition.

The effect of this embodiment is the same if the compensating pulse is added for decreasing the rms voltage of the data signal when the data signal maintains the same level.

Twenty-Third Embodiment

Figure 32:
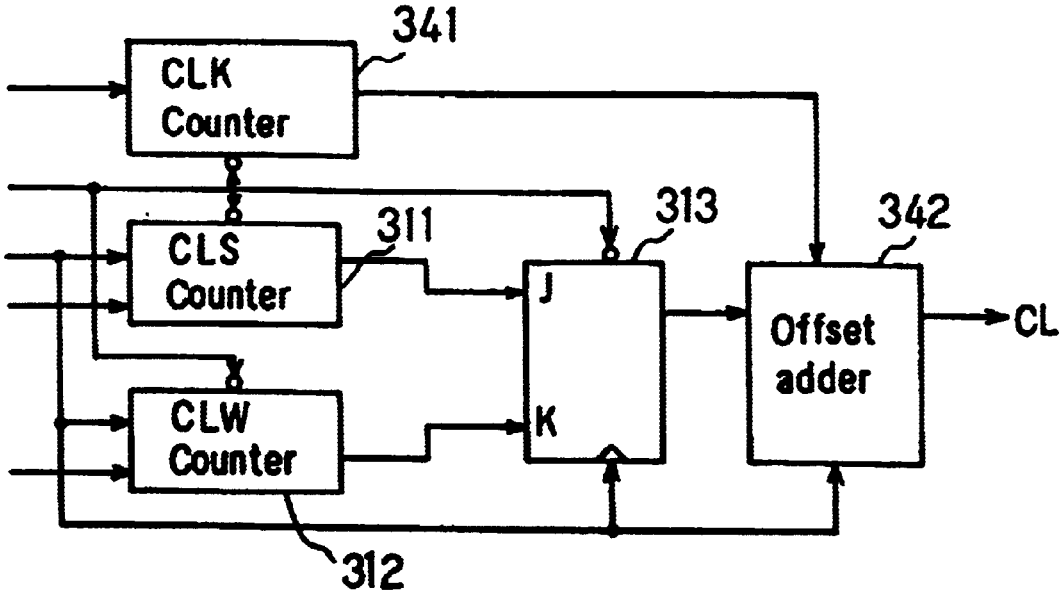
FIG. 32 shows a compensating pulse control signal generating circuit of an LCD according to a twenty-third embodiment of the present invention.

FIG. 32 shows a circuit for generating the compensating pulse control signal according to a twenty-third embodiment of the present invention. This circuit corresponds to one part of the control circuit (307 in FIG. 27) explained in the twentieth embodiment. In this Figure, the same members as in FIG. 28 are indicated with the same numerals.

In this embodiment, the operation of the CLS counter circuit 311, the CLW counter circuit 312 and JKFF 313 is the same as the twentieth embodiment. The output signal of JKFF 313 (the compensating pulse control signal in the twentieth embodiment) is given to the offset adder circuit 342.

The CLK counter circuit 341 counts the data shift clock from the rising or falling edge of the latch pulse. The CLK counter circuit outputs the signal corresponding to the count number, which is another input of the offset adder circuit.

Figure 33:
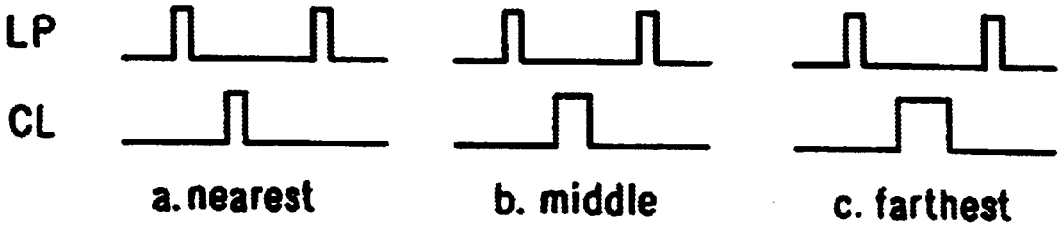
FIG. 33 shows waveforms for explaining the compensating pulse control signal generated by the circuit shown in FIG. 32.

The offset adder circuit 342 varies the width of the compensating pulse control signal by these two signals. FIG. 33 shows waveforms of the compensating pulse control signal. According to the effect of the offset adder circuit, the pulse width increases in the order of a. nearest, b. middle and c. farthest, which mean the distance from the power source. Therefore, the width of the compensating pulse also increases in the order. On the other hand, if the input signal to the offset adder circuit is inverted to perform subtraction, the pulse width increases in the order of a. nearest, b. middle and c. farthest.

Figure 34:
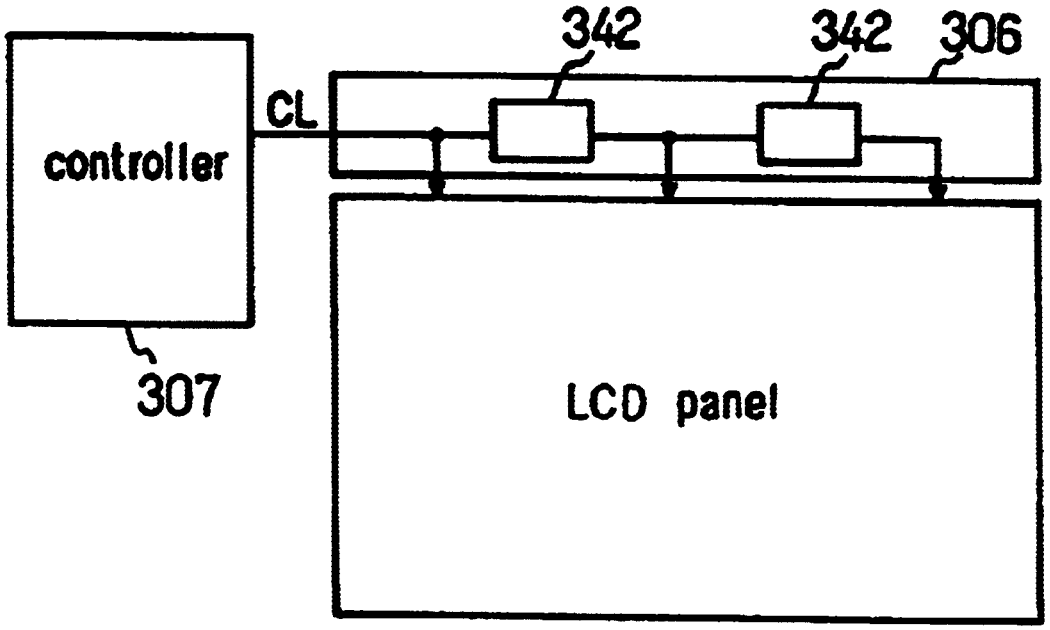
FIG. 34 shows an LCD using the circuit shown in FIG. 32.

The offset adder circuit is included in the control circuit in this embodiment. However, it is preferable that the offset adder is included in the signal drive circuit for easy control of the pulse width control. The actual offset adder circuit is made up with a delay circuit for example, and inserted in the signal drive circuit 306 for varying the width of the compensating pulse added to each signal electrode. For example, the width of the compensating pulse control signal is varied for each drive IC disposed in the signal drive circuit so that the width of the compensating pulse can be varied easily. In FIG. 34, two offset adder circuits 342 are inserted between the nearest and the middle as well as between the middle and the farthest.

Figure 35:
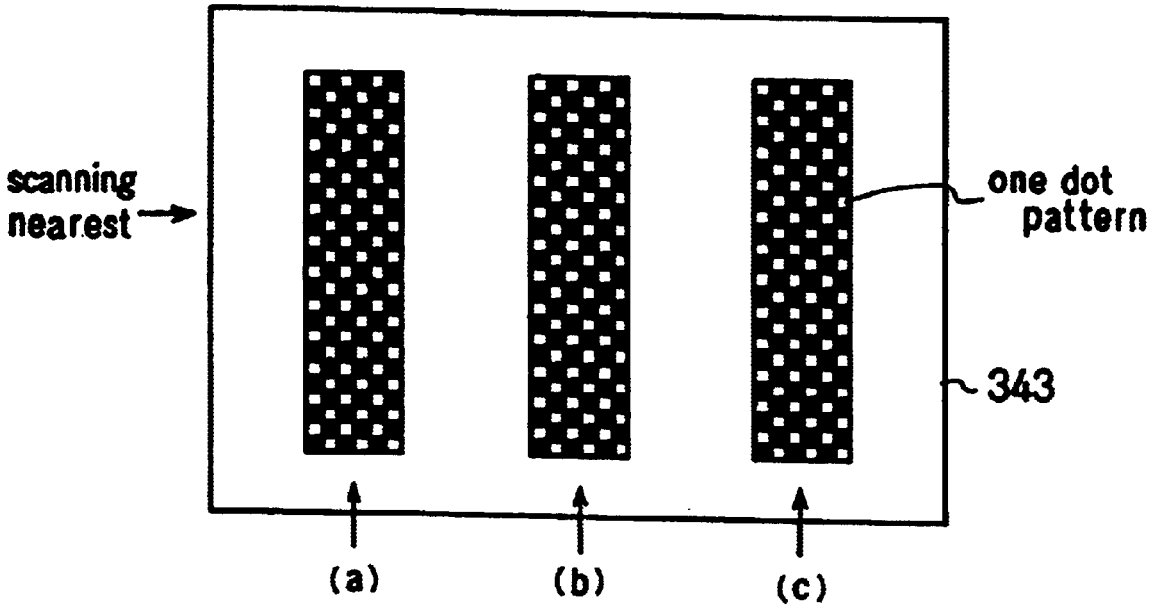
FIG. 35 shows an example of a display pattern that generates the crosstalk.
Figure 36:
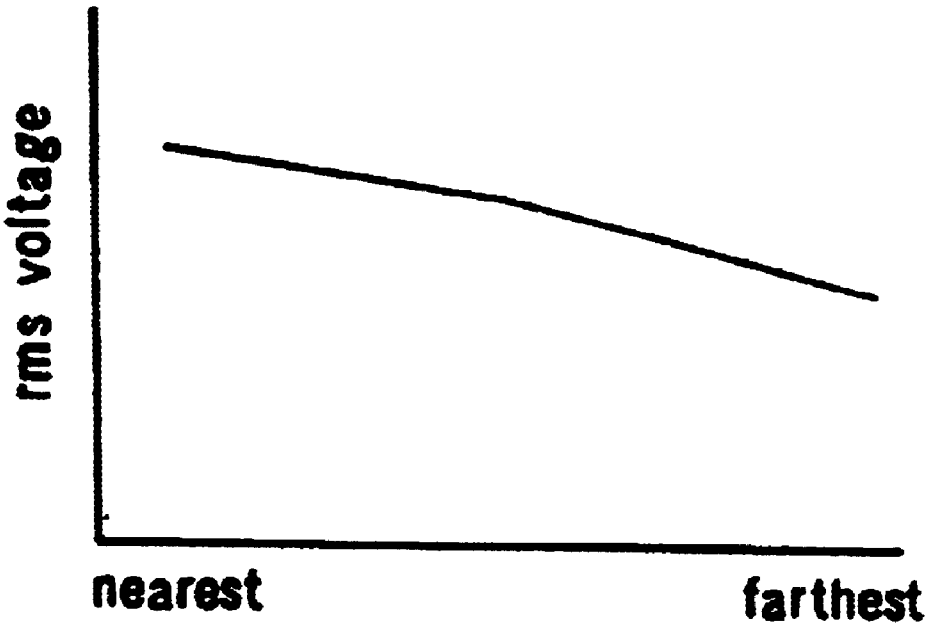
FIG. 36 is a graph showing a relation between the compensating voltage and the display location.

The effect of varying the width of the compensating pulse added to the data signal in accordance with the distance from the power source is as follows. In an LCD panel, the scanning voltage level decreases along with the distance from the power source, i.e., from the nearest to the farthest, due to the CR circuit formed by the resistance of the scanning electrode and the capacitance of the pixel. The voltage applied to the pixel is the difference voltage between the voltage levels of the scanning electrode and the signal electrode. Therefore, the crosstalk amount is different depending on the location on the scanning line even if the same compensation pulse is added to the data signal. In an experiment, a checkerboard pattern with black and white dots was displayed in three locations (a), (b) and (c) of an LCD panel 343 as shown in FIG. 35. Compensating pulses are added to the three checkerboard patterns independently. The width of each compensating pattern was varied to find the adequate width when the crosstalk is eliminated, i.e., the intensity of the crosstalk portion becomes the same as the background. As the result of this experiment, the adequate width for eliminating the crosstalk decreases in the order of (a), (b) and (c). FIG. 36 shows this result with a graph, whose vertical axis indicates the rms compensating voltage. The drive method according to this embodiment uses the compensating pulse whose width decreases along with the distance from the power source, so that the crosstalk can be compensated adequately in each portion of the LCD panel.

Instead of the width, the height of the compensating pulse may be varied in accordance with the distance from the power source. The height of the compensating pulse can be varied by using a voltage shift circuit instead of the offset adder circuit and controlling a shift amount of the voltage shift circuit with the output of the CLK counter circuit, for example.

This embodiment, which improves the uniformity of the compensation along the scanning electrode in the horizontal direction, can be combined with the fourteenth or fifteenth embodiment where the sine wave is used for improving the uniformity of the compensation along the signal electrode in the vertical direction.

This embodiment can be combined with other foregoing embodiments, for example, the drive method where the compensating pulse has a sine wave shape, or the drive method where the compensating pulse for decreasing the rms voltage is added when the signal voltage maintains its level.

Twenty-Fourth Embodiment

A drive method according to a twenty-fourth embodiment of the present invention improves a uniformity of the display by varying the width of the compensating pulse in accordance with the number of on/off pixels on the two neighboring scanning lines.

Figure 37:
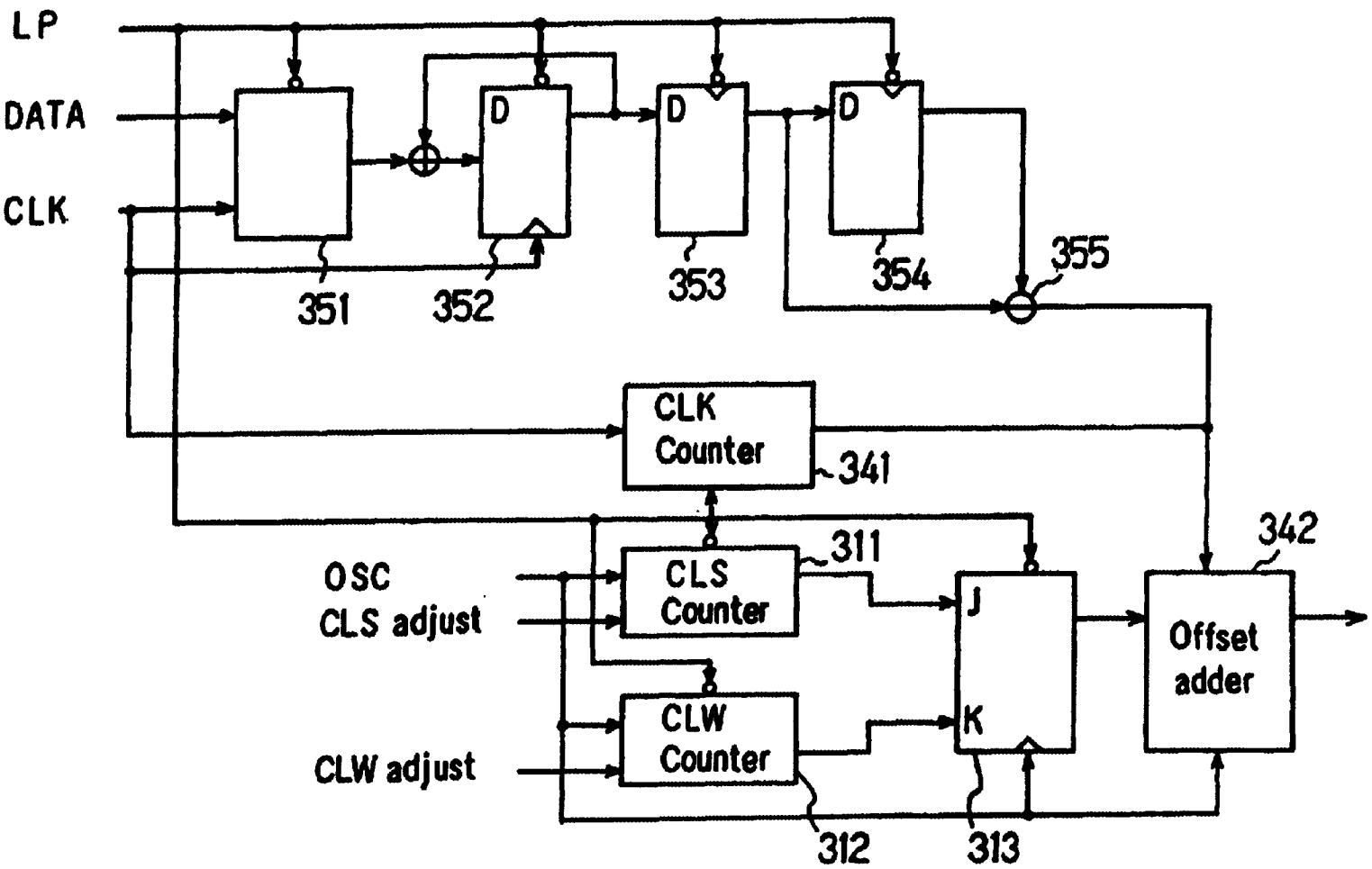
FIG. 37 shows a compensating pulse control signal generating circuit of an LCD according to a twenty-fourth embodiment of the present invention.

FIG. 37 shows a circuit for generating the compensating pulse control signal of this embodiment. This circuit corresponds to the generator portion of the control circuit explained in the twentieth embodiment (307 in FIG. 27). In FIG. 37, the same members as in FIG. 28 or 32 are indicated with the same numerals.

In this embodiment, the operations of the CLS counter circuit 311, the CLW counter circuit 312 and the JKFF 313 are the same as the twentieth embodiment. The output signal of the JKFF (the compensating pulse control signal in the twentieth embodiment) is given to the offset adder circuit.

In FIG. 37, numeral 351 is a decoder circuit, which decodes data given as 8 bit parallel data by the data shift clock, and outputs the number of the off-pixels (or on-pixels) of the data signal. Numeral 352 is an accumulator circuit, which accumulates the number of the off-pixels (or on-pixels) on a scanning line until the latch pulse LP clears it.

Numeral 353 and 354 are registers. The output of the accumulator 352 is the input of the first register 353, and the output of the first register 353 is the input of the second register 354. The latch pulse LP makes each data output to the next register. As a result, the first register stores the number of the off-pixels (or on-pixels) on a n-th scanning line, and the second register stores the number of the off-pixels (or on-pixels) on the previous (n−1th) scanning line. A calculator 355 calculates the difference of the off-pixels (or on-pixels) on the neighboring two scanning lines, and outputs the result to the offset adder circuit 342. The offset adder circuit varies the width of the compensating pulse control signal in accordance with the calculated difference, so that the width of the compensating pulse is varied.

In this embodiment, in the same way as the twenty-third embodiment, the following effect is obtained by disposing the offset adder circuit in the signal drive circuit.

Figure 38:
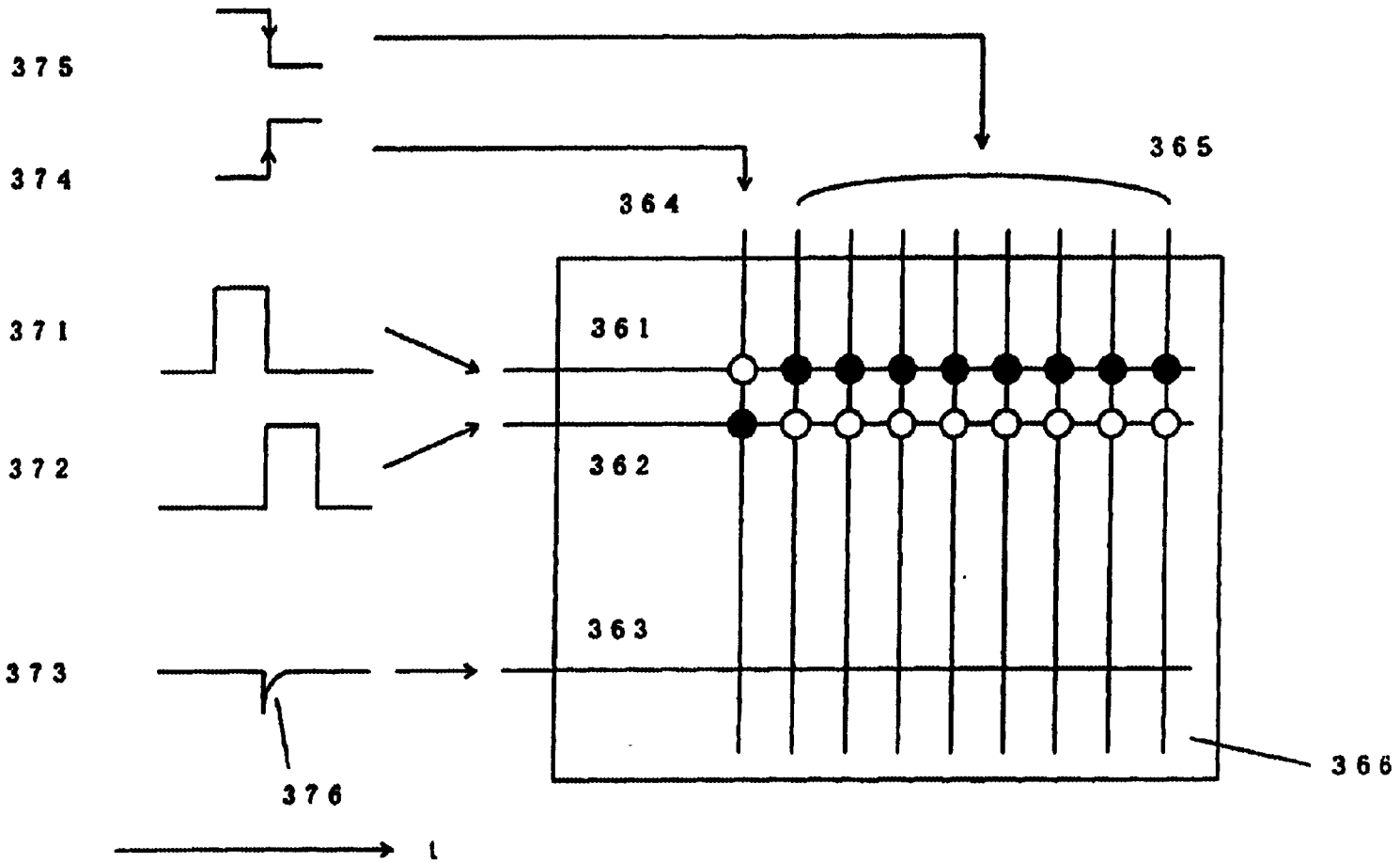
FIG. 38 shows a display pattern and waveforms for explaining a distortion generated depending on the display pattern.

As shown in FIG. 38, an LCD panel 366 has scanning electrodes 361–363 and signal electrodes 364, 365. Crossings of the scanning electrodes and the signal electrodes form pixels. White circles mean on-pixels, and black circles mean off-pixels. These scanning electrodes, signal electrodes and pixels are illustrated partially in FIG. 38.

Drive waveforms are illustrated in the left portion of FIG. 38, when the scanning electrode 361 or 362 is selected by the positive scanning pulse 371 or 372. Numeral 373 is a waveform of the scanning electrode 363 that is not selected at that time. Numeral 374 is a waveform of the signal electrode 364 whose signal voltage changes from on to off. Numeral 375 is a waveform of the signal electrode 365 whose signal voltage changes from off to on.

In a simple matrix type LCD, a differential waveform distortion appears on the scanning electrode due to the capacitance coupling of the pixels when the data signal voltage changes. The signal waveform 374 generates a positive differential distortion and the signal waveform 375 generates a negative differential distortion. In FIG. 38, there are more of the pixels that change from off to on more than the pixels that change from on to off, so the influence of the negative differential distortion is larger than that of the positive differential distortion. Therefore, the negative differential distortion 376 appears on the scanning electrode 363. On the contrary, if there are more of the pixels that change from on-state to off-state than the pixels that change from off-state to on-state, the positive differential distortion will appear on the scanning electrode. The states (on/off) of the pixels on the scanning electrode 363 do not influence this distortion directly. The signal electrodes that maintain their level do not influence this distortion since the signal waveform does not change.

A voltage applied to a pixel of the LCD panel is a difference voltage of the scanning voltage and the signal voltage, so the above mentioned distortion influences the rms voltage applied to a pixel via a rms voltage during a non-selected period. This distortion on the scanning line can be eliminated by a charge current from the scan drive circuit. However, a time constant of the CR circuit, which is made of a resistance of the scanning electrode and a capacitance of the pixel, depends on the distance from the scan drive circuit, so that the distortion is larger at the farthest portion and smaller at the nearest portion.

Figure 39:
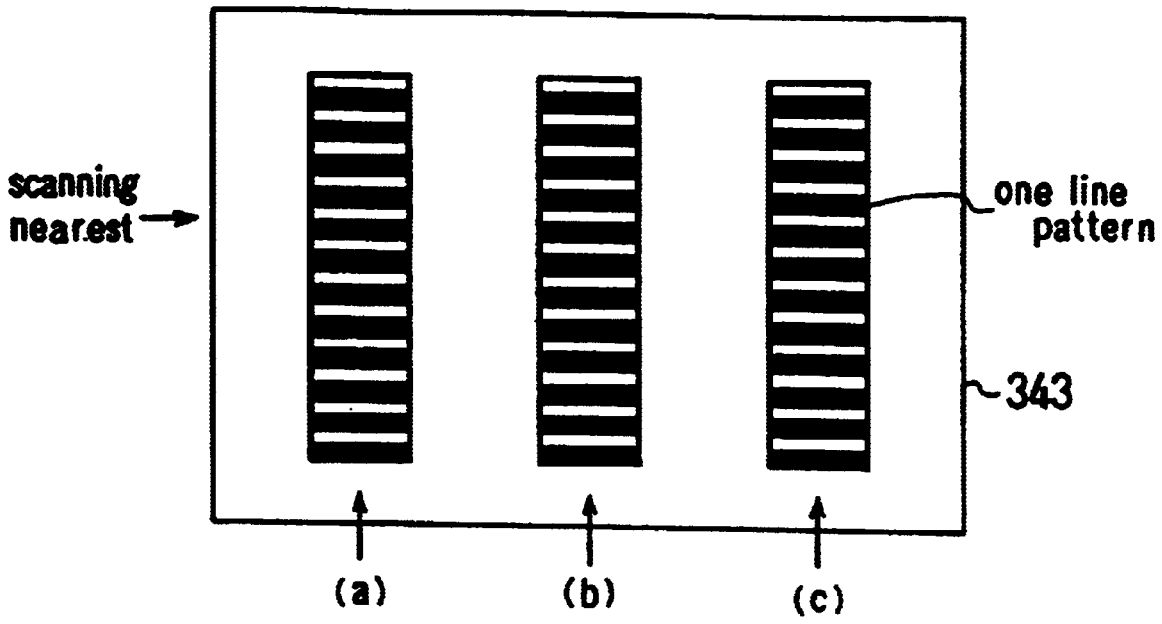
FIG. 39 shows an example of a display pattern that generates the crosstalk.
Figure 40:
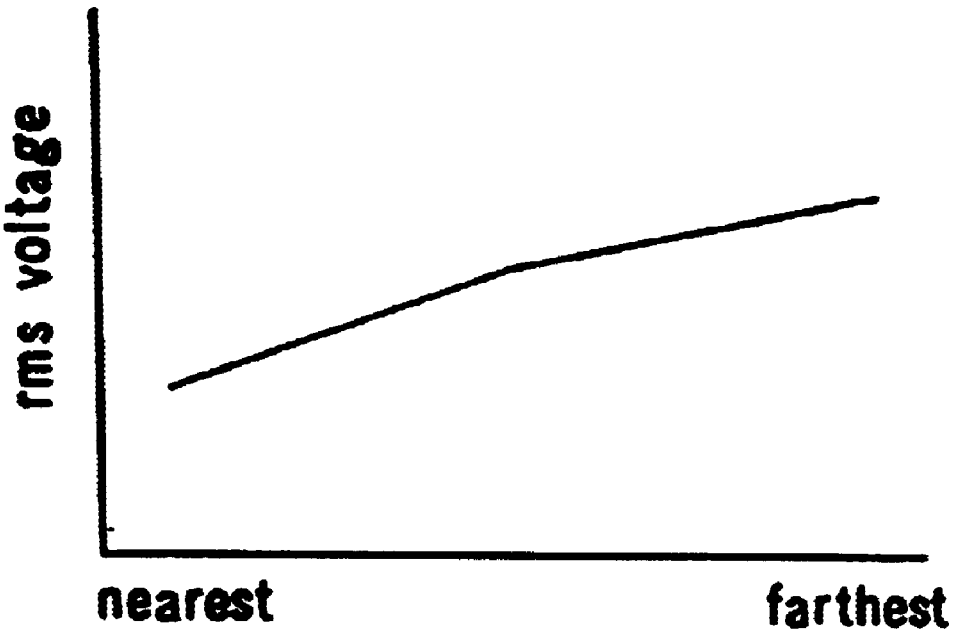
FIG. 40 is a graph showing a relation between the compensating voltage and the display location.

FIG. 39 shows a horizontal stripe pattern with black and white lines displayed in three locations (a), (b) and (c) of an LCD panel 343. In this display pattern, two neighboring scan lines have a large difference of the on-pixel (or off-pixel) numbers, though the checkerboard pattern shown in FIG. 35 has no difference of the on-pixel (or off-pixel) numbers between two neighboring scan lines. Therefore, the crosstalk conditions of the checkerboard pattern and the stripe pattern are different. An experiment was performed for finding the proper width of the compensating pulse in the same way as the twenty-third embodiment. Contrary to the result of the twenty-third embodiment, the proper width of the compensating pulse for eliminating the crosstalk increases along the scanning line in the order of (a), (b) and (c). FIG. 40 shows this result with a graph, whose vertical axis indicates the rms compensating voltage. The distortion on the scanning electrode varies depending on the width of the area that the stripe pattern is displayed so that the inclination of the graph varies in FIG. 40. If the width of the area becomes wider, the inclination becomes larger and the characteristic difference between the left and right ends increases.

This embodiment varies the width of the compensating pulse along the scanning line in accordance with the difference of the numbers of the on-pixels between two neighboring scan lines. Therefore, if the crosstalk amount or position varies, the width of the compensating pulse can be varied so that the uniform compensation can be obtained in the whole panel.

In the circuit shown in FIG. 37, the output of the CLK counter circuit 341, explained in the twenty-third embodiment, as well as the output of the subtract circuit 355 is used as an input of the offset adder circuit. Thus, by controlling the offset adder circuit 342 with two output signals, the display uniformity is improved as explained in the twenty-third embodiment when the difference of the on-pixel numbers does not exist, while the effect of this embodiment is added when the difference of the on-pixel numbers exists.

Instead of the width, the height of the compensating pulse may be varied in accordance with the distance from the power source. Alternatively, both of the height and the width can be varied, and one of them can be varied in accordance with the method of this embodiment, and another can be varied in accordance with the method of the twenty-third embodiment.

This embodiment can be combined with other foregoing embodiments, for example, the drive method where the compensating pulse has a sine wave shape, or the drive method where the compensating pulse for decreasing the rms voltage is added when the signal voltage maintains its level.

Twenty-Fifth Embodiment

Figure 41:
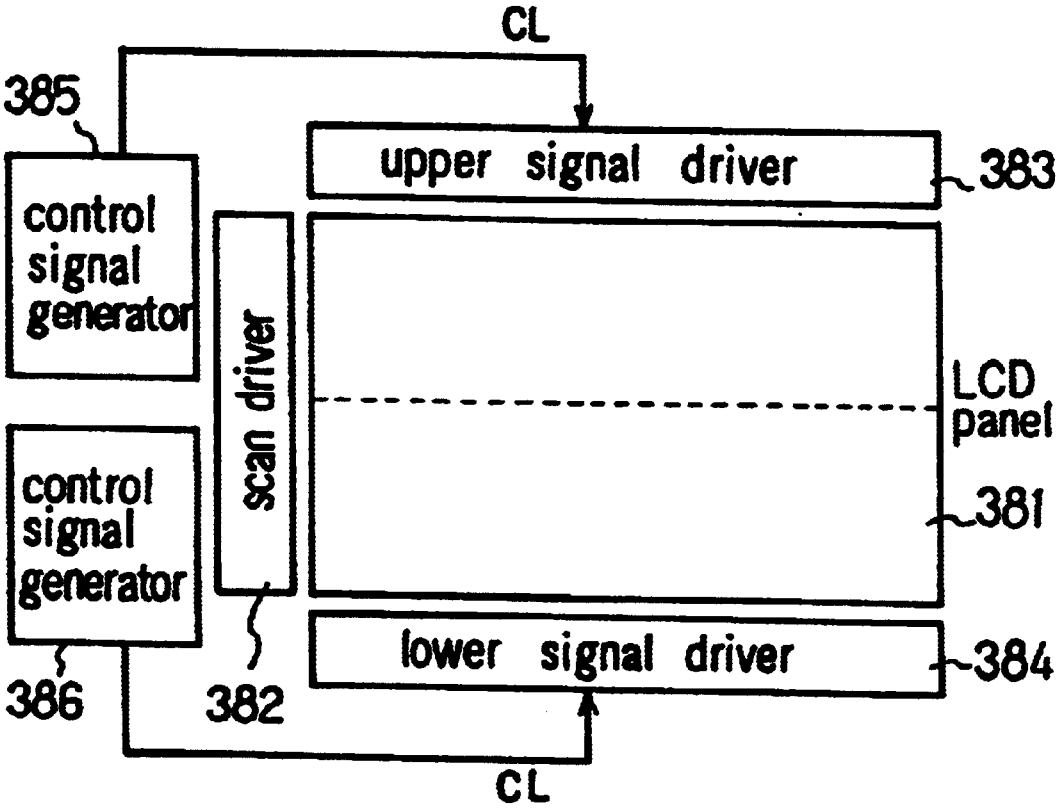
FIG. 41 is a block diagram of an LCD according to a twenty-fifth embodiment of the present invention.

FIG. 41 shows a block diagram of the LCD according to the twenty-fifth embodiment of the present invention. Numeral 383 is an LCD panel, in which the signal electrodes are divided into upper and lower portions. A scan drive circuit 382 is connected to the left side of the LCD panel for generating scan pulses. Upper and lower signal drive circuits 383, 384 are connected to the upper and lower sides of the LCD panel.

In this embodiment, a control signal generator circuit 385 is connected to the upper signal drive circuit 383, and a control signal generator circuit 386 is connected to the lower signal drive circuit 384. Each control signal generator circuit generates the compensating pulse control signal for compensating the crosstalk of upper or lower screen independently. The compensating pulse control signal is generated in the same way as explained in the twentieth through twenty-fourth embodiments.

A STN type LCD is usually divided into upper and lower screens that are driven independently so that good contrast can be obtained with a reduced duty factor. The crosstalk is generated due to a distortion of the signal voltage or the scanning voltage. This distortion varies depending on the display pattern. Therefore, if the display patterns of the upper and lower screen are different, the crosstalk amounts are different between the upper and lower screens, so the compensation amount should be different between them. In this case, if the same compensation is performed in the upper and lower portion, the crosstalk cannot be eliminated completely, and the intensity difference is generated between the upper and lower portion. Thus, a boundary line, which does not exist in the display data, appears and deteriorates the display quality.

The configuration of FIG. 41 includes two control signal generator circuits, which generate the compensating pulse control signal independently. The upper compensating pulse control signal generating circuit 385 is for compensating the upper screen display pattern, while the lower compensating pulse control signal generating circuit 386 is for compensating the lower screen display pattern. Therefore, suitable compensation can be performed even if the display patterns of the upper and lower screen are different. In addition, the boundary line due to the intensity difference does not appear in the screen.

As mentioned above, the compensating pulses are added in the upper and lower screen independently in a STN type LCD that has the upper and lower screen driven separately. Thus, the proper compensation of the crosstalk can be performed to obtain a good display.

This embodiment can be combined with other foregoing embodiments, for example, the drive method where the compensating pulse has a sine wave shape, or the drive method where the compensating pulse for decreasing the rms voltage is added when the signal voltage maintains its level.

Twenty-Sixth Embodiment

Figure 43:
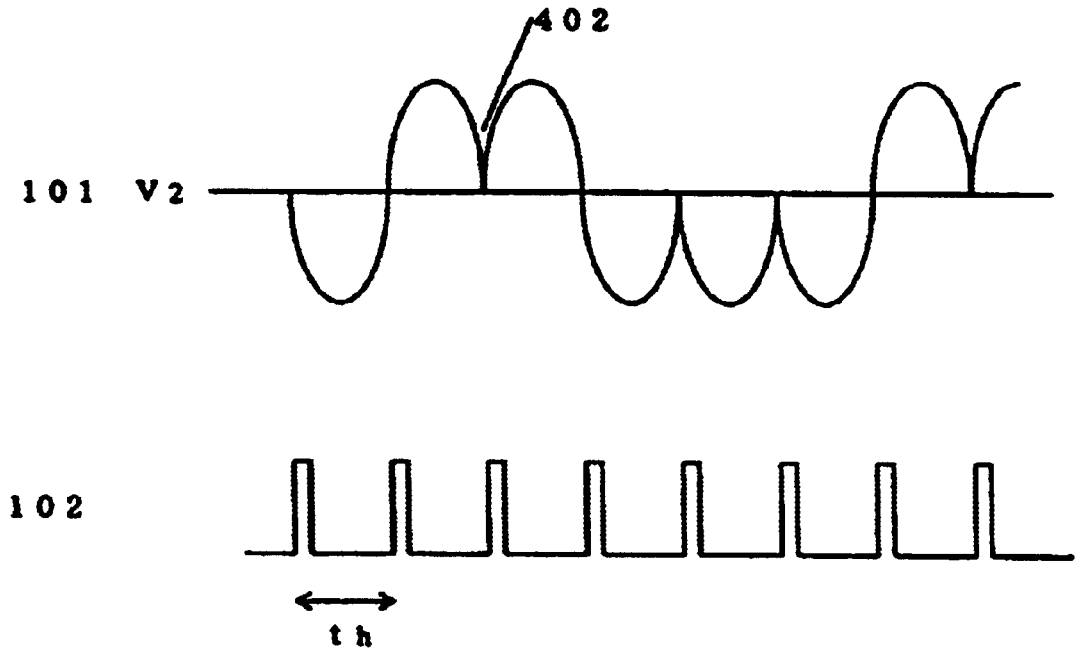
FIG. 43 shows waveforms for a method of driving an LCD according to a twenty-sixth embodiment of the present invention.

FIG. 43 shows drive waveforms of the drive method according to the twenty-sixth embodiment of the present invention. In this drive method, the data signal voltage is made of a sine wave whose half period is equal to the horizontal scanning period. If the data signal voltage is positive, the positive half cycle of the sine wave is output, while if the data signal voltage is negative, the negative half cycle of the sine wave is output. In FIG. 43, a portion 402 corresponds to the compensating pulse for decreasing the rms signal voltage when the data signal maintains its level in the conventional method or the tenth embodiment. In this embodiment, the rms voltage loss when the data signal changes its level is the same as that when the data signal maintains its level. Therefore, the rms voltages applied to the liquid crystal when the data signal changes its level are the same as when the data signal maintains its level. Thus, the character crosstalk is eliminated or reduced.

The signal voltage waveform in this embodiment has gentle rising and falling edges, i.e., frequency components are low, so that the waveform distortion is small compared with the waveform shown in FIG. 11. As a result, this embodiment is suitable even for a large panel or a high speed panel that has a large CR time constant, and the voltage level supplied to each pixel is uniform in the whole LCD panel. For example, using a 14 inch LCD or a larger LCD (having a diagonal distance more than 35 cm), a good and uniform display was obtained easily even though the scan and signal voltage are supplied from one side.

Twenty-Seventh Embodiment

Figure 44:
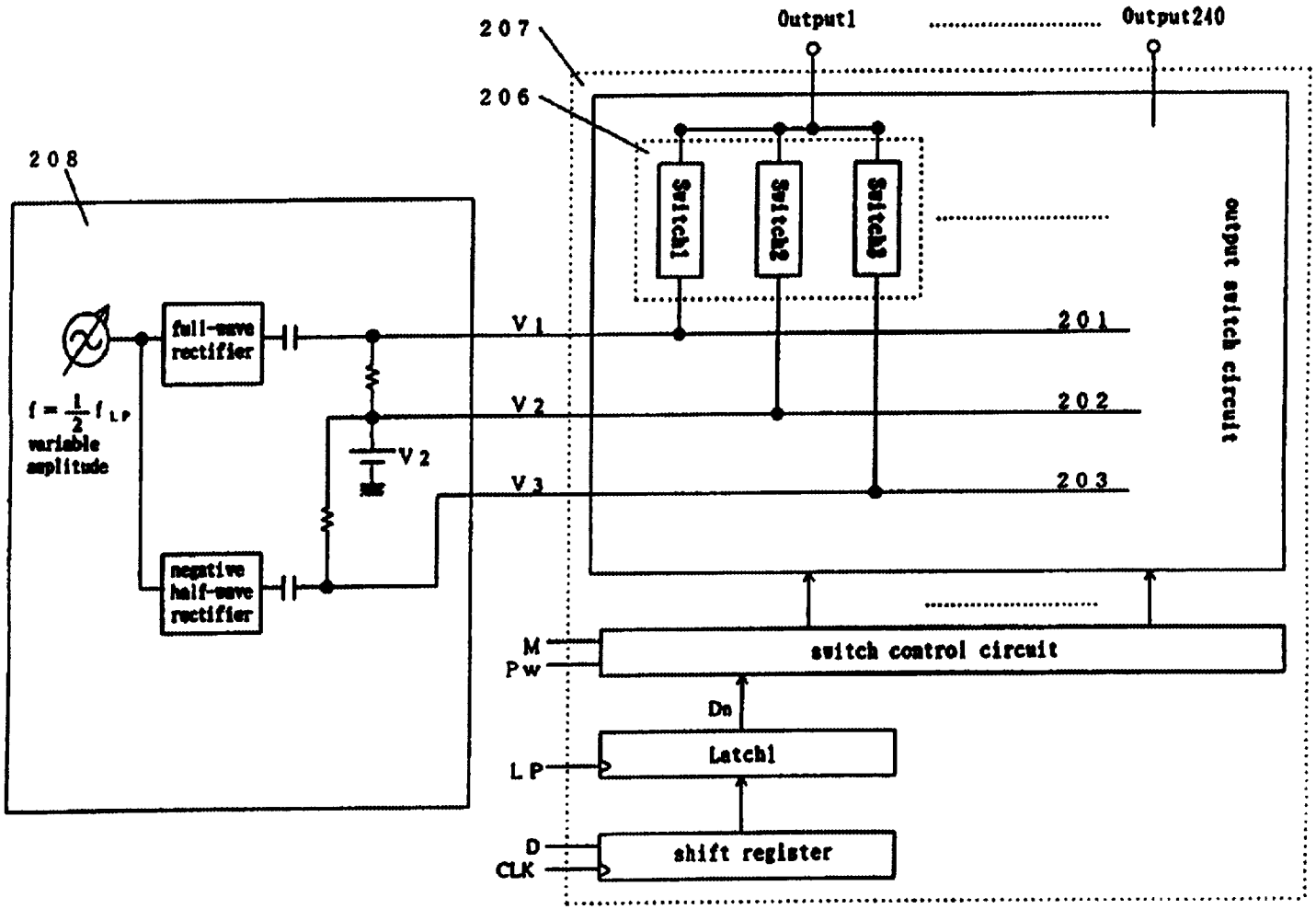
FIG. 44 is a block diagram showing a drive IC and circuit for an LCD according to a twenty-seventh embodiment of the present invention.
Figure 45:
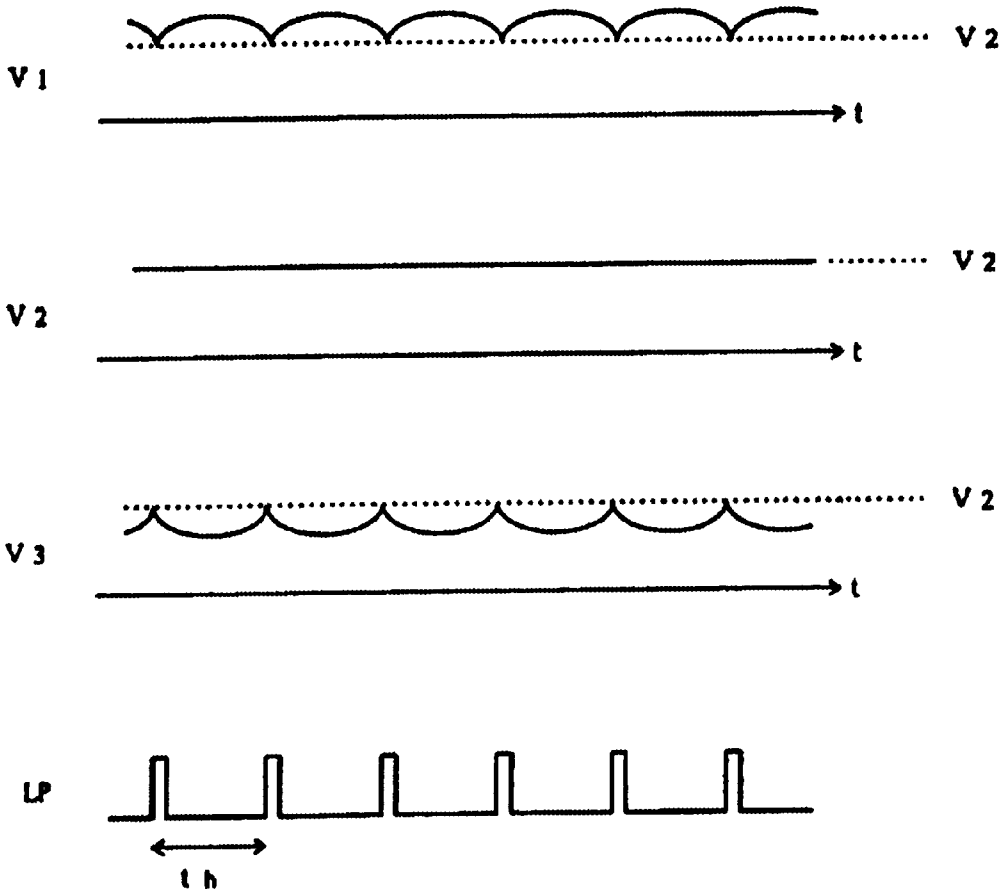
FIG. 45 shows waveforms for explaining an operation of the drive circuit shown in FIG. 44.

FIG. 44 shows a block diagram of a drive IC and circuit according to a twenty-seventh embodiment of the present invention for generating the waveforms shown in FIG. 43. In FIG. 43, the same members as in FIG. 25 are indicated with the same numerals. The number of the voltage levels in this embodiment is three, the same as the eighteenth embodiment. This embodiment is different from the eighteenth embodiment in the external power source and in that the configuration in FIG. 44 does not include Latch 2. The power source in FIG. 44 generates a voltage waveform V1 including the dc voltage V2 and the positive full wave added to V2, as well as a voltage waveform V3 including the dc voltage V2 and the negative full wave added to V2. In this case, the Latch 2 in FIG. 25 is not required since the signal voltage in a horizontal scanning period can be determined independently from that in the previous horizontal scanning period. FIG. 45 shows these waveforms.

In this embodiment, the output t is determined from the display data Dt on the scanning line, the polarity signal M and the compensating pulse control signal Pw using Table 14.

TABLE 14

| $D_t$ | M | $P_w$ | output t |
|---|---|---|---|
| L | L | L | V2 |
| H | L | L | V2 |
| L | H | L | V2 |
| H | H | L | V2 |
| L | L | H | V1 |
| H | L | H | V3 |
| L | H | H | V3 |
| H | H | H | V1 |

If the compensating pulse control signal Pw is low, the output voltage is V2, which can be used for making the data signal level constant. For example, by setting the scan voltage at V2 and setting the Pw at low, the voltage applied to the liquid crystal during a fly-back time is set at zero The chip area of the drive IC according to this embodiment can be reduced in the same way as the eighteenth embodiment since the IC requires only three bus lines and not Latch 2.

In an example, a STN type LCD was made for 800×600 dots color display using the above explained IC as a signal drive IC and a normal drive IC as a scanning drive IC. As a result, a very good display was obtained that scarcely had crosstalk. The period of polarity change was set equal to one vertical scanning period in this example.

Twenty-Eighth Embodiment

Figure 46:
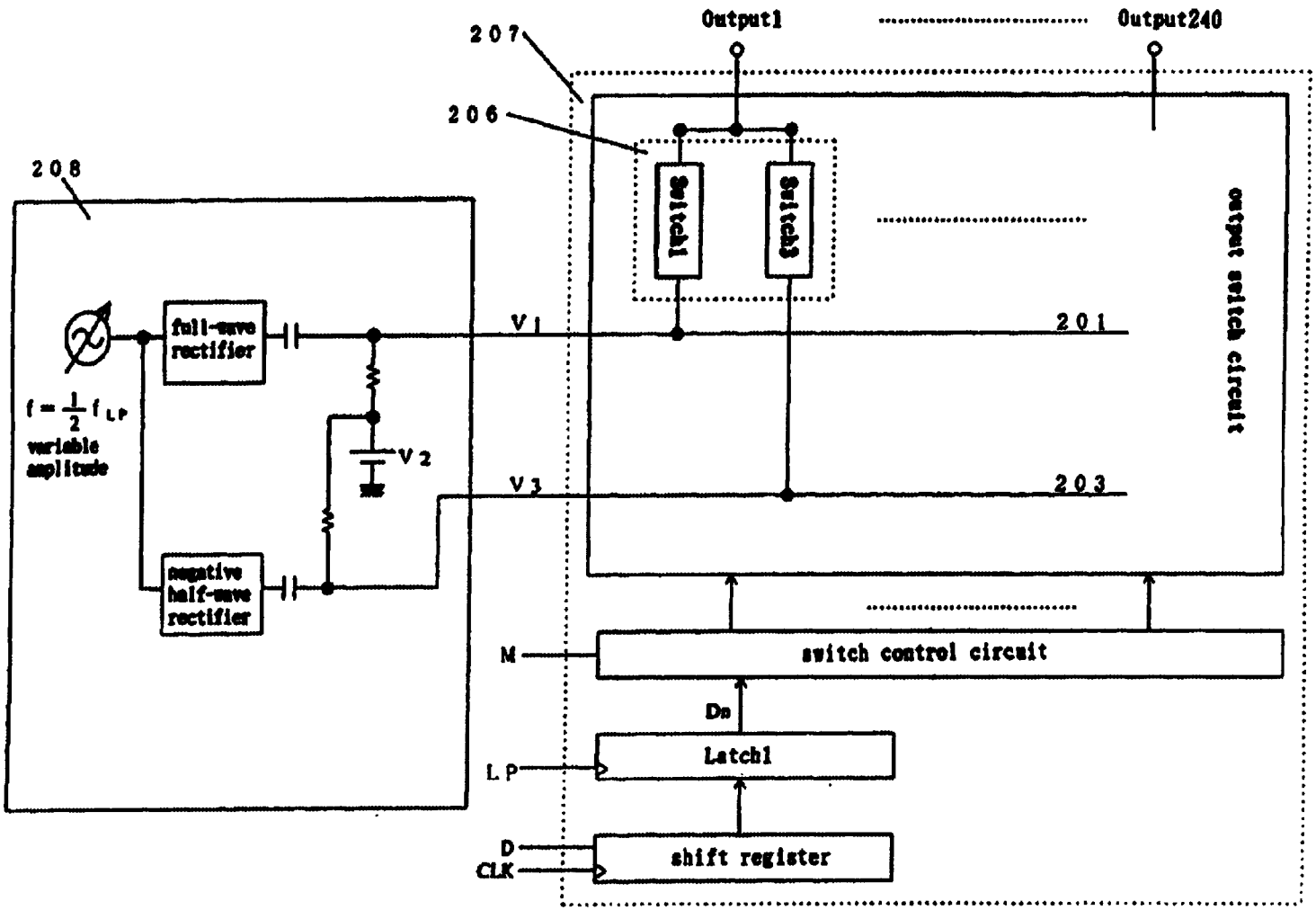
FIG. 46 is a block diagram showing a drive IC and circuit for an LCD according to a twenty-eighth embodiment of the present invention.
Figure 47:
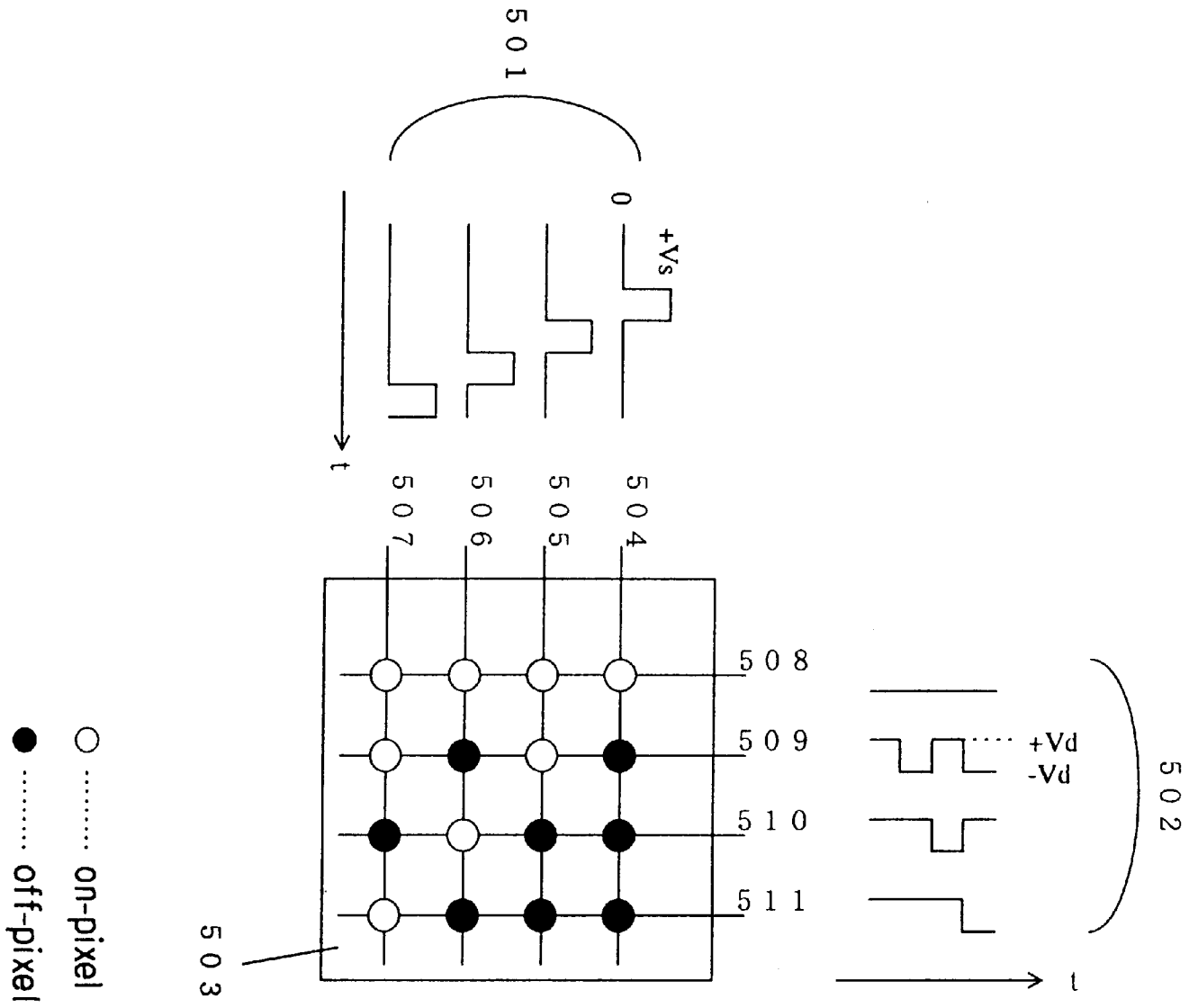
FIG. 47 shows a display pattern and waveforms for driving a STN type LCD in the prior art.
Figure 48:
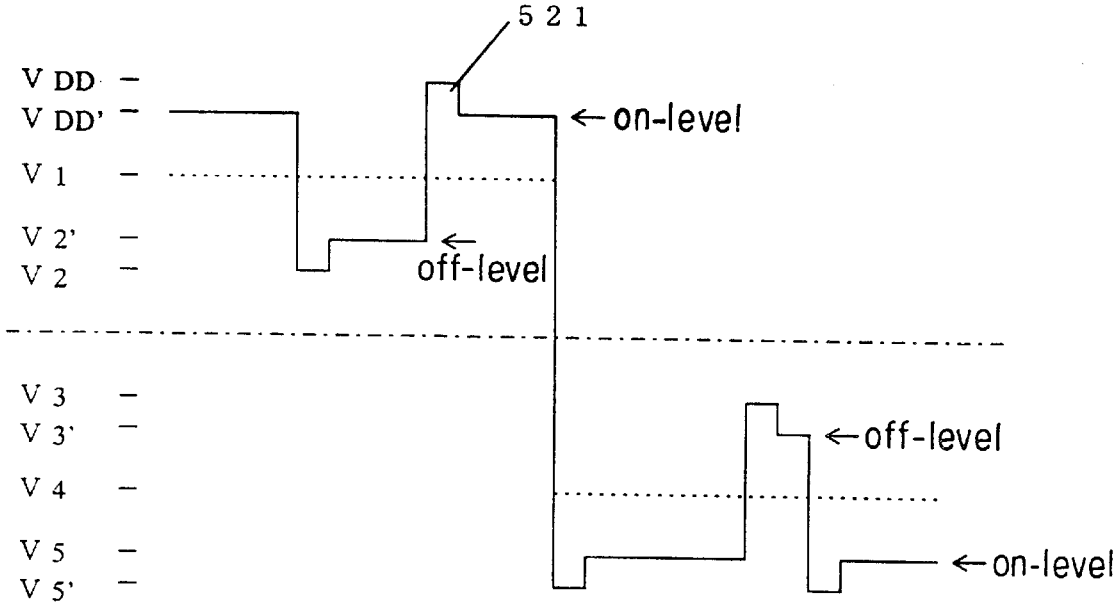
FIG. 48 shows a waveform for a drive method including the crosstalk compensation in the prior art.
Figure 49:
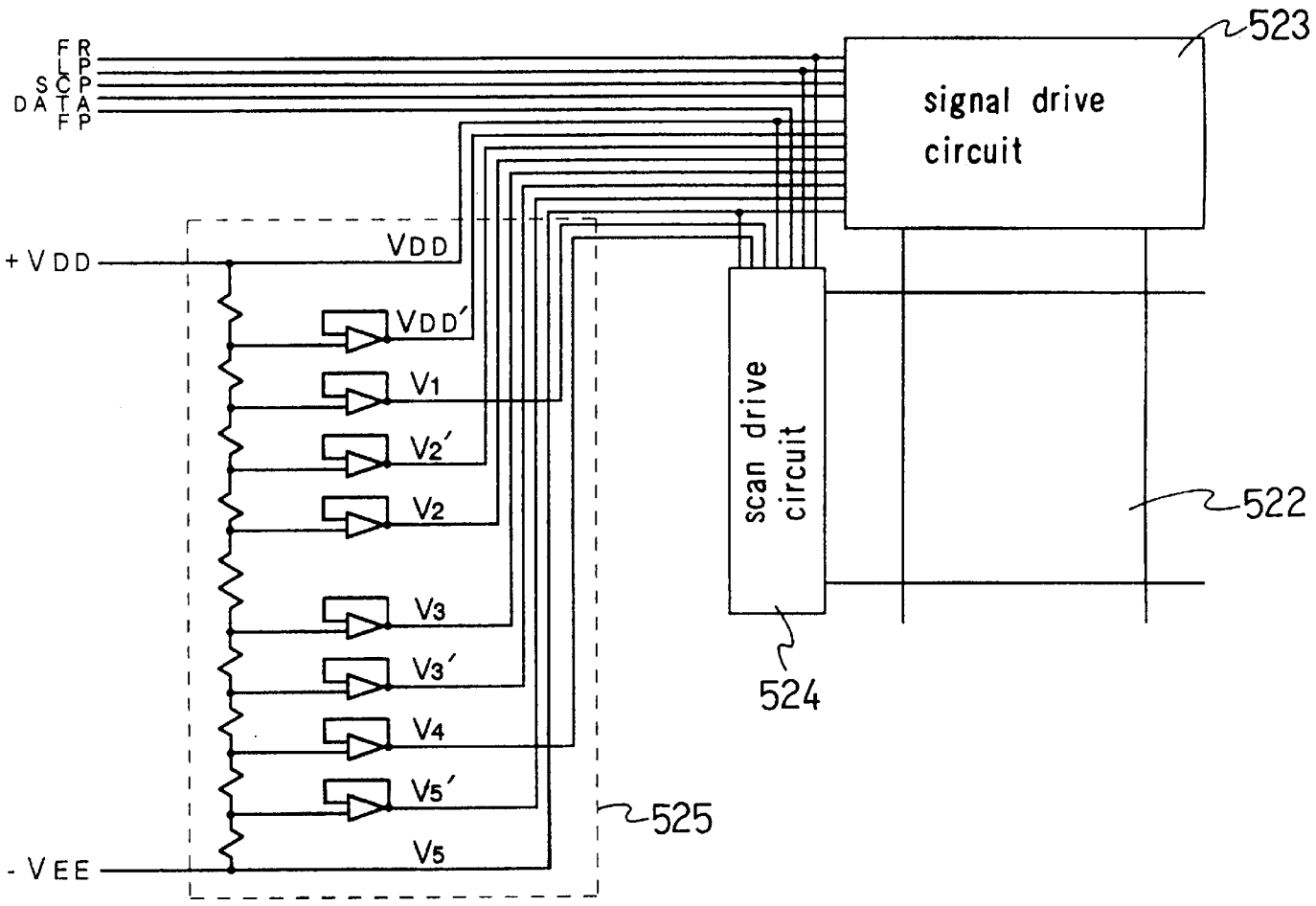
FIG. 49 shows a drive circuit generating the waveform shown in FIG. 48.
Figure 50:
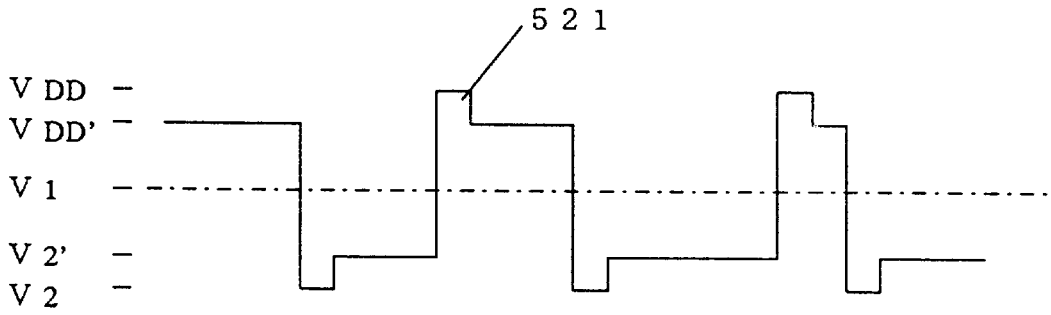
FIG. 50 shows a waveform for a variation of the drive method shown in FIG. 48.

FIG. 46 shows a block diagram of a drive IC and circuit according to a twenty-eighth embodiment of the present invention. The configuration of this embodiment can be obtained by eliminating V2 and the compensating pulse control signal Pw in FIG. 44 of the twenty-seventh embodiment. The operation of this embodiment is basically the same as the twenty-seventh embodiment. However, the output has two values, so Table 15 is used for determining the output E.

TABLE 15

| $D_t$ | M | output t |
|---|---|---|
| L | L | V1 |
| H | L | V3 |
| L | H | V3 |
| H | H | V1 |

In this embodiment, the output voltage is either V1 or V3, so that the signal voltage cannot be kept constant by the switch control circuit. However, only two bus lines are required since the compensating pulse control signal is eliminated. In addition, only two switches are required for one output. Therefore, a more compact and inexpensive drive IC can be obtained compared with the drive IC of the twenty-seventh embodiment. If the data signal output should be V2, the amplitude of the sine wave in the external power source is reduced to zero.

In an example, a STN type LCD was made for 800×600 dots color display using the above explained IC as a signal drive IC and a normal drive IC as a scanning drive IC. As a result, a very good display was obtained that scarcely had crosstalk. The period of polarity change was set equal to one vertical scanning period in this example.

In each embodiment explained above, the polarity of the scanning voltage is changed every one frame period. More frequent polarity change is not required since the compensating pulse eliminates or reduces the character crosstalk. Such a long period of polarity change eliminates a vertical line crosstalk so that display properties are improved substantially in all kinds of display patterns. By changing the polarity in one frame, a distortion of the scanning voltage along with the polarity change decreases, and the vertical line crosstalk is reduced substantially.

It is found in an experiment that the similar effect can be obtained by decreasing the frequency of the polarity change to four times per one frame.

In each embodiment, the preferable value range of the width tc as well as the product of the height Vc and the width tc of the compensating pulse were explained. If this value range is satisfied, excessive power consumption due to the switching of the compensating pulse hardly occur. However, if the height Vc exceeds the switching amplitude (e.g., the difference between V2 and V4 in FIG. 2), the power consumption may increase undesirably. In this case, it is preferable to increase the width and to decrease the height Vc a little.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A method for driving a liquid crystal display including a plurality of scanning electrodes and signal electrodes arranged in a matrix, the method comprising the steps of:

applying a scanning voltage to the plural scanning electrodes in order;

applying a signal voltage to the plural signal electrode via a first electric path; and adding a compensating pulse to the signal voltage via a second electric path whose impedance is higher than that of the first electric path, so as to compensate a drop of a rms voltage due to a waveform distortion accompanying the level change of the signal voltage.

2. A drive IC for a liquid crystal display, comprising:

a first latch circuit for keeping first signal data in a first horizontal scanning period;

a second latch circuit for keeping second signal data in a second horizontal scanning period adjacent to the first horizontal scanning period; and a set of switch circuits for selecting one of plural input voltages and supplying the selected voltage in accordance with output signals of the first and second latches;

wherein at least one of the switch circuits has a larger output resistance than other switch circuits, and the switch circuit for selecting the voltage level of the compensating pulse has a larger output resistance than other switch circuits.

3. A drive IC for a liquid crystal display, comprising:

a first latch circuit for keeping first signal data in a first horizontal scanning period;

a second latch circuit for keeping second signal data in a second horizontal scanning period adjacent to the first horizontal scanning period; and a set of switch circuits for selecting one of plural input voltages and supplying the selected voltage in accordance with output signals of the first and second latches;

wherein at least one of the switch circuits has a larger output resistance than other switch circuits, and the larger output resistance switch circuit has an output resistance within 2–50 times of the resistance of other switch circuits.

4. A drive IC for a liquid crystal display, comprising:

a first latch circuit for keeping first signal data in a first horizontal scanning period;

a second latch circuit for keeping second signal data in a second horizontal scanning period adjacent to the first horizontal scanning period; and a set of switch circuits for selecting one of plural input voltages and supplying the selected voltage in accordance with output signals of the first and second latches;

wherein at least one of the switch circuits has a larger output resistance than other switch circuits, the larger output resistance switch circuit has an output resistance within 5–20 times of the resistance of other switch circuits.

5. A drive IC for a liquid crystal display, comprising:

a first latch circuit for keeping first signal data in a first horizontal scanning period;

a second latch circuit for keeping second signal data in a second horizontal scanning period adjacent to the first horizontal scanning period;

a set of switch circuits for selecting one of plural input voltages and supplying the selected voltage in accordance with output signals of the first and second latches; and a plurality of bus lines;

wherein at least one of the bus lines has a larger resistance than other bus lines, and the bus line supplied with the voltage level of a compensating pulse has a larger resistance than other bus lines.

* * * * *